US009594318B2

(12) United States Patent
Nakata et al.

(10) Patent No.: US 9,594,318 B2
(45) Date of Patent: Mar. 14, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Koichi Nakata, Kashiwa (JP); Shinji Takagi, Yokohama (JP); Masaki Nonaka, Toride (JP); Ryoichi Tokimitsu, Kashiwa (JP); Haruki Mori, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/832,421

(22) Filed: Aug. 21, 2015

(65) Prior Publication Data

US 2016/0070184 A1 Mar. 10, 2016

(30) Foreign Application Priority Data

Sep. 4, 2014 (JP) ..... 2014-180398
Jun. 10, 2015 (JP) ..... 2015-117104

(51) Int. Cl.
*G03G 5/00* (2006.01)
*G03G 5/147* (2006.01)
*G03G 5/047* (2006.01)

(52) U.S. Cl.
CPC ..... *G03G 5/14786* (2013.01); *G03G 5/047* (2013.01)

(58) Field of Classification Search
CPC ..... G03G 5/14786
USPC ..... 430/66
See application file for complete search history.

(56) References Cited

U.S. PATENT DOCUMENTS

| | | | |
|---|---|---|---|
| 7,186,489 | B2 | 3/2007 | Uematsu et al. |
| 7,226,711 | B2 | 6/2007 | Amamiya et al. |
| 7,333,752 | B2 | 2/2008 | Kawahara et al. |
| 7,534,534 | B2 | 5/2009 | Nakata et al. |
| 7,732,113 | B2 | 6/2010 | Nakamura et al. |
| 7,910,274 | B2 | 3/2011 | Tanaka et al. |
| 8,088,541 | B2 | 1/2012 | Tanaka et al. |
| 8,343,699 | B2 | 1/2013 | Nagasaka et al. |
| 8,465,889 | B2 | 6/2013 | Sekido et al. |

(Continued)

FOREIGN PATENT DOCUMENTS

| | | |
|---|---|---|
| JP | S49-074945 | 7/1974 |
| JP | S49-076849 | 7/1974 |

(Continued)

OTHER PUBLICATIONS

U.S. Appl. No. 14/653,610, filed Jun. 18, 2015. Inventor(s): Nobuo Kosaka, et al.

*Primary Examiner* — Mark A Chapman
(74) *Attorney, Agent, or Firm* — Fitzpatrick, Cella, Harper & Scinto

(57) ABSTRACT

Provided is an electrophotographic photosensitive member, including: a support; and a photosensitive layer formed on the support, in which a surface layer of the electrophotographic photosensitive member contains a polymerized product of a compound represented by the following structural formula (1).

(1)

11 Claims, 1 Drawing Sheet

(56) References Cited

U.S. PATENT DOCUMENTS

| | | | |
|---|---|---|---|
| 8,524,430 | B2 | 9/2013 | Takagi et al. |
| 8,546,050 | B2 | 10/2013 | Maruyama et al. |
| 8,632,931 | B2 | 1/2014 | Sekido et al. |
| 8,669,030 | B2 | 3/2014 | Fujiwara et al. |
| 2007/0212626 | A1 | 9/2007 | Toshine et al. |
| 2014/0255837 | A1 | 9/2014 | Nakata et al. |

FOREIGN PATENT DOCUMENTS

| | | | |
|---|---|---|---|
| JP | S64-017064 | | 1/1989 |
| JP | H09-152734 | | 6/1997 |
| JP | H09-319107 | | 12/1997 |
| JP | H11-038648 | | 2/1999 |
| JP | 2007-11005 | A | 1/2007 |
| JP | 2007-272191 | A | 10/2007 |
| JP | 2007-272192 | A | 10/2007 |
| JP | 2007-279678 | A | 10/2007 |
| JP | 2008-70761 | A | 3/2008 |
| JP | 2008-170977 | A | 7/2008 |
| JP | 2008-203697 | | 9/2008 |

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus each including the electrophotographic photosensitive member.

Description of the Related Art

A surface of an electrophotographic photosensitive member is required to have wear resistance and chemical stability because a stress caused by a series of electrophotographic processes including charging, exposure, development, and transfer, and cleaning as required is repeatedly applied to the surface.

Means for improving the wear resistance of the surface of the electrophotographic photosensitive member is, for example, a method involving incorporating a curable resin into a surface layer of the electrophotographic photosensitive member.

However, when a surface layer having high wear resistance is formed in the electrophotographic photosensitive member, the surface layer hardly wears, and hence a surface of the surface layer is hardly refreshed and chemical deterioration is liable to accumulate on the surface. The chemical deterioration is the one caused by a chemical change of a hole transportable compound (hole transporting substance) owing to the stress generated by the series of electrophotographic processes. The chemical change of the hole transportable compound may be a cause for the occurrence of a phenomenon in which an electrophotographic image output under a high-temperature and high-humidity environment becomes blurred (hereinafter sometimes referred to as "image deletion").

Therefore, suppression of the image deletion requires suppression of the chemical change of the hole transportable compound.

A technology involving incorporating an additive into the surface layer together with the hole transportable compound is known as a technology for suppressing the chemical change of the hole transportable compound, i.e., improving chemical stability of the hole transportable compound.

Japanese Patent Application Laid-Open No. 2007-11005 discloses a technology for alleviating the image deletion through addition of a specific fluorine atom-containing monomer having a polymerizable functional group to the surface layer.

Japanese Patent Application Laid-Open No. 2007-272191, Japanese Patent Application Laid-Open No. 2007-272192, and Japanese Patent Application Laid-Open No. 2007-279678 each disclose a technology for alleviating the image deletion through addition of a specific amine compound to the surface layer.

Japanese Patent Application Laid-Open No. 2008-70761 discloses a technology for alleviating the image deletion through addition of a specific siloxane compound having a specific polymerizable functional group to the surface layer.

However, the technologies each involving using an additive disclosed in the patent publications are technologies for alleviating the stress on the hole transportable compound and are not technologies for improving the chemical stability of the hole transportable compound itself.

In recent years, an improvement in durability of the electrophotographic photosensitive member has been progressing and hence a demand for additional alleviation of the image deletion has been growing. The alleviation of the image deletion requires not only the alleviation of the stress but also an improvement in chemical stability of the hole transportable compound itself. In addition, the electrophotographic photosensitive member has been required to suppress an image defect in association with occurrence of, for example, a flaw in the surface of the electrophotographic photosensitive member and to satisfy electrical characteristics.

SUMMARY OF THE INVENTION

The present invention is directed to providing an electrophotographic photosensitive member which has high wear resistance, is suppressed in image defect in association with the occurrence of, for example, a flaw in its surface, has good electrical characteristics, and is suppressed in image deletion. Further, the present invention is directed to providing a process cartridge and an electrophotographic apparatus each including the electrophotographic photosensitive member.

According to one aspect of the present invention, there is provided an electrophotographic photosensitive member, including: a support; and a photosensitive layer formed on the support, in which a surface layer of the electrophotographic photosensitive member contains a polymerized product (polymer) of a compound represented by the following structural formula (1):

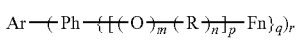

(1)

in the structural formula (1): Ar represents a substituted or unsubstituted condensed polycyclic aromatic hydrocarbon group, and a substituent of the condensed polycyclic aromatic hydrocarbon group is a group selected from the group consisting of an alkyl group, an alkoxy group, an aralkyl group, a halogen atom, and a halogen-substituted alkyl group; Ph represents a substituted or unsubstituted group obtained by removing q+1 hydrogen atoms from benzene, and a substituent of the group obtained by removing q+1 hydrogen atoms from benzene is a group selected from the group consisting of an alkyl group, an alkoxy group, an aralkyl group, a halogen atom, and a halogen-substituted alkyl group; Ar and Ph are bonded to each other through an aromatic ring in Ar and Ph; R represents a linear or branched alkylene group having 1 to 12 carbon atoms; Fn represents a reactive functional group; m and n each independently represent 0 or 1; p represents an integer of 0 or more and 4 or less, and when p represents 2 or more, structures in p sets of parentheses may be identical to or different from each other, provided that when p represents 2 or more, a case where oxygen atoms (O) are continuous is excluded; q represents an integer of 0 or more and 3 or less, and when q represents 2 or more, structures in q sets of parentheses may be identical to or different from each other; r represents an integer of 1 or more and 6 or less, and when r represents 2 or more, structures in r sets of parentheses may be identical to or different from each other; and the structural formula (1) has at least one Fn.

According to another aspect of the present invention, there is provided a process cartridge, including: the electrophotographic photosensitive member; and at least one unit selected from the group consisting of a charging unit, a developing unit, a transferring unit, and a cleaning unit, the electrophotographic photosensitive member and the at least one unit being integrally supported, in which the process cartridge is detachably mountable to a main body of an electrophotographic apparatus.

According to still another aspect of the present invention, there is provided an electrophotographic apparatus, including: the electrophotographic photosensitive member; a charging unit; an exposing unit; a developing unit; and a transferring unit.

According to the aspect of the present invention, the electrophotographic photosensitive member which has high wear resistance, is suppressed in image defect in association with the occurrence of, for example, a flaw in its surface, has good electrical characteristics, and is suppressed in image deletion can be provided. In addition, according to the aspects of the present invention, the process cartridge and the electrophotographic apparatus each including the electrophotographic photosensitive member can be provided.

Further features of the present invention will become apparent from the following description of exemplary embodiments with reference to the attached drawings.

DESCRIPTION OF THE EMBODIMENTS

Figure 1:
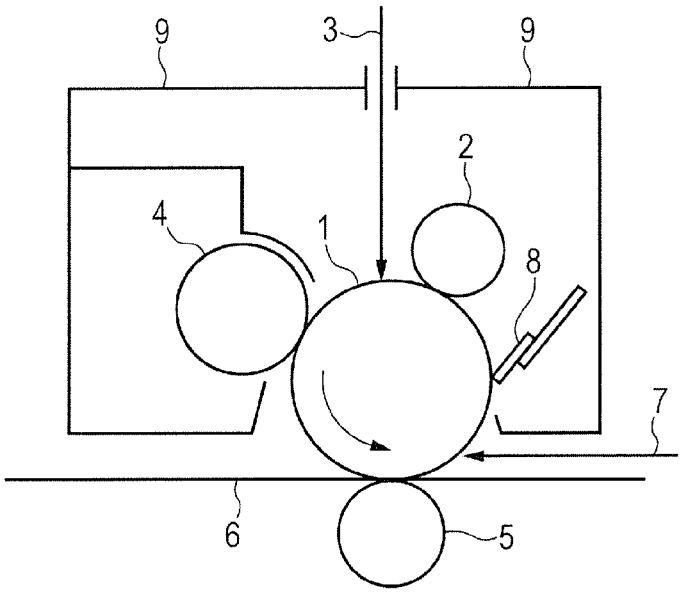
FIG. 1 is a schematic view for illustrating an example of a process cartridge including an electrophotographic photosensitive member.

Preferred embodiments of the present invention will now be described in detail in accordance with the accompanying drawings.

An electrophotographic photosensitive member of the present invention includes a surface layer containing a polymerized product of a compound represented by the structural formula (1). That is, the surface layer contains a polymerized product of a compound having one substituted or unsubstituted condensed polycyclic aromatic hydrocarbon group, and having one or more benzene ring structures bonded to the group, the structures each having introduced therein a reactive functional group.

The inventors of the present invention have considered that the occurrence of the chemical change of the amine structure of a hole transportable compound to be incorporated into the surface layer of a related-art electrophotographic photosensitive member is one cause for image deletion. In view of the foregoing, the inventors have searched for a hole transportable compound for an electrophotographic photosensitive member free of any amine structure and have reached the present invention.

Hitherto, an amine compound such as an arylamine compound has been often used as the hole transportable compound (hole transporting substance) to be used in an electrophotographic photosensitive member in order to secure a hole transporting property. The term "hole transportable" as used in the present invention means that the compound has a hole transporting ability. A measure of the hole transporting ability can be known by evaluating the electrophotographic photosensitive member for its electrophotographic characteristics such as sensitivity.

The hole transporting property of the arylamine compound may be based on the expression of the electron-donating property of its amine structure by the interaction of an aryl group or a group formed of a group of carbon atoms having an sp2 hybrid orbital (hereinafter sometimes referred to as "sp2 carbon atoms") around its nitrogen atom.

Meanwhile, its arylamine moiety may be in a state susceptible to a chemical reaction or the like because the transfer of charge is vigorously performed through a repeated electrophotographic process. In particular, the arylamine moiety may tend to be susceptible to a change such as oxidation caused by: discharge energy in a charging step; or the action of ozone or an oxidizing substance produced by discharge. The inventors of the present invention have assumed that the chemical change of the arylamine moiety is caused as a result of the foregoing.

As a result of their extensive investigations, the inventors of the present invention have found that the use of the polymerized product of the compound represented by the structural formula (1) in the surface layer can improve the wear resistance and electrical characteristics of the electrophotographic photosensitive member, suppress an image defect in association with the occurrence of, for example, a flaw in the surface of the electrophotographic photosensitive member, and suppress the image deletion. The inventors of the present invention have considered the reason for the foregoing to be as described below. The compound represented by the structural formula (1) is a hole transportable compound free of any arylamine structure, and is hence superior in chemical stability to the arylamine compound.

In the present invention, the hole transportable compound (hole transporting substance) means a compound (substance) that receives a hole from a charge generating layer, a charge transporting layer, or the like in the electrophotographic photosensitive member, and injects and transports the hole between respective layers. The compound represented by the structural formula (1) and the polymerized product thereof are hole transportable compounds (hole transporting substances).

The compound represented by the structural formula (1) is described in detail.

In the structural formula (1), Ar represents a substituted or unsubstituted condensed polycyclic aromatic hydrocarbon group.

In order to cause the compound to express an additionally good hole transporting ability, the number of sp2 carbon atoms forming one condensed polycyclic aromatic hydrocarbon group is preferably 12 or more, more preferably 14 or more, still more preferably 16 or more.

The number of sp2 carbon atoms forming the condensed polycyclic aromatic hydrocarbon group is preferably 20 or less, more preferably 18 or less from the viewpoints of the formability (film formability) of the layer and compatibility with a material to be used in combination.

In addition, with regard to the number of ring structures forming the condensed polycyclic aromatic hydrocarbon group, the group is constituted of preferably 6 or less rings, more preferably 5 or less rings from the viewpoints of the film formability and the flexibility of a molecule of the compound. The group is still more preferably constituted of 3 or 4 rings.

An example of the condensed polycyclic aromatic hydrocarbon group is a group obtained by removing r hydrogen atoms from any one of condensed polycyclic aromatic hydrocarbons such as naphthalene, acenaphthylene, acenaphthene, fluorene, anthracene, phenanthrene, fluoranthene, pyrene, chrysene, tetracene, pentacene, benzo[a]

anthracene, benzo[b]fluoranthene, benzo[i]fluoranthene, benzo[k]fluoranthene, benzo[a]pyrene, benzo[e]pyrene, benzo[ghi]perylene, indeno[1,2,3-cd]pyrene, and dibenzo[a,h]anthracene.

A group obtained by removing r hydrogen atoms from fluorene, anthracene, phenanthrene, pyrene, or fluoranthene is preferred as the condensed polycyclic aromatic hydrocarbon group from the viewpoint of the hole transporting ability.

A substituent that the condensed polycyclic aromatic hydrocarbon group can have is a group selected from the group consisting of an alkyl group, an alkoxy group, an aralkyl group, a halogen atom, and a halogen-substituted alkyl group.

Ph represents a substituted or unsubstituted group obtained by removing q+1 hydrogen atoms from benzene. A substituent that the group obtained by removing q+1 hydrogen atoms from benzene can have is a group selected from the group consisting of an alkyl group, an alkoxy group, an aralkyl group, a halogen atom, and a halogen-substituted alkyl group.

In the structural formula (1), Ar and Ph are bonded to each other through an aromatic ring in Ar and Ph. In order to express the hole transporting ability, the compound has a structure in which the sp2 carbon atom on the aromatic ring of Ar and the sp2 carbon atom of Ph are directly bonded to each other. The hole transporting ability is expressed by the formation of a conjugated structure in which the sp2 carbon atoms are continuously bonded to each other. A more extended conjugated structure is preferred.

It should be noted that Japanese Patent Application Laid-Open No. 2008-170977 discloses a monomer derived from bisphenolfluorene. The inventors of the present invention have considered that this bisphenolfluorene cannot express the hole transporting ability because fluorene and a benzene ring are bonded at a sp3 carbon part of fluorene, and thus the bisphenolfluorene does not have sufficient conjugation of the sp2 carbon atoms.

R represents a linear or branched alkylene group having 1 to 12 carbon atoms.

Examples of the alkylene group include a methylene group, an ethylene group, a n-propylene group, a 1-methylethylene group, a 2-methylethylene group, a n-butylene group, a 1,1-dimethylethylene group, a 1,2-dimethylethylene group, a 2,2-dimethylethylene group, a 1-ethylethylene group, a n-pentylene group, a 1-methylbutylene group, a 2-methylbutylene group, a 3-methylbutylene group, a 4-methylbutylene group, a 1,2-dimethylpropylene group, a 1,3-dimethylpropylene group, a 2-ethylpropylene group, a n-hexylene group, a 1,1-dimethylbutylene group, a 2,2-dimethylbutylene group, a 3,3-dimethylbutylene group, a 4,4-dimethylbutylene group, a 1,2-dimethylbutylene group, a 1,3-dimethylbutylene group, a 1,4-dimethylbutylene group, a 2,3-dimethylbutylene group, a 2,4-dimethylbutylene group, a 3,4-dimethylbutylene group, a 1-ethylbutylene group, a 2-ethylbutylene group, a 3-ethylbutylene group, a 4-ethylbutylene group, a 1,1-diethylbutylene group, a 2,2-diethylbutylene group, a n-heptylene group, a n-octylene group, a 2-ethylhexylene group, a 1,1-dimethylhexylene group, a 1,3-dimethylhexylene group, a 1,5-dimethylhexylene group, a 1,1,3,3-tetramethylbutylene group, a n-nonylene group, a 1-methyloctylene group, a 3-methyloctylene group, a n-decylene group, a 1-methylnonylene group, a 2-methylnonylene group, a 1,1-dimethyloctylene group, a 1-ethyloctylene group, a 1-(n-butyl)hexylene group, a 1,1-dimethyloctylene group, a 3,7-dimethyloctylene group, a n-dodecylene group, a 1-methylundecylene group, a 1,1-dimethyldecylene group, a 4,4-diethylhexylene group, and a 1,4-di(n-butyl)butylene group.

Specific examples of the substituent that Ar or Ph can have are described below.

Examples of the alkyl group include a methyl group, an ethyl group, a n-propyl group, an isopropyl group, a n-butyl group, an isobutyl group, a sec-butyl group, a tert-butyl group, a n-pentyl group, an isopentyl group, a neopentyl group, a tert-pentyl group, a cyclopentyl group, a n-hexyl group, a 1-methylpentyl group, a 4-methyl-2-pentyl group, a 3,3-dimethylbutyl group, a 2-ethylbutyl group, a cyclohexyl group, a 1-methylhexyl group, a cyclohexylmethyl group, a 4-tert-butylcyclohexyl group, a n-heptyl group, a cycloheptyl group, a n-octyl group, a cyclooctyl group, a tert-octyl group, a 1-methylheptyl group, a 2-ethylhexyl group, a 2-propylpentyl group, a n-nonyl group, a 2,2-dimethylheptyl group, a 2,6-dimethyl-4-heptyl group, a 3,5,5-trimethylhexyl group, a n-decyl group, a n-undecyl group, a 1-methyldecyl group, a n-dodecyl group, a n-tridecyl group, a 1-hexylheptyl group, a n-tetradecyl group, a n-pentadecyl group, a n-hexadecyl group, a n-heptadecyl group, a n-octadecyl group, and a n-eicosyl group.

The alkyl group may have as a substituent a halogen atom. That is, the alkyl group may be a halogen-substituted alkyl group.

Examples of the halogen-substituted alkyl group include a fluoromethyl group, a difluoromethyl group, a trifluoromethyl group, a 2,2,2-trifluoroethyl group, a pentafluoroethyl group, a 3,3,3-trifluoropropyl group, a 3,3,3,2,2-pentafluoropropyl group, a heptafluoropropyl group, a 2,2,2-trifluoro-1,1-dimethylethyl group, a 2,2,2-trifluoro-1,1-bis(trifluoromethyl)ethyl group, a 4,4,4-trifluorobutyl group, a 5,5,5-trifluoropentyl group, a 6,6,6-trifluorohexyl group, a 6,6,6,5,5-pentafluorohexyl group, a 6,6,6,5,5,4,4-heptafluorohexyl group, a 6,6,6,5,5,4,4,3,3-nonafluorohexyl group, a chloromethyl group, a dichloromethyl group, a trichloromethyl group, a 2,2,2-trichloroethyl group, a pentachloroethyl group, a 3,3,3-trichloropropyl group, a 3,3,3,2,2-pentachloropropyl group, a 3,3,3-trifluoro-2-chloropropyl group, a heptachloropropyl group, a 2,2,2-trichloro-1,1-dimethylethyl group, a 2,2,2-trichloro-1,1-bis(trifluoromethyl)ethyl group, a 4,4,4-trichlorobutyl group, a 5,5,5-trichloropentyl group, a 6,6,6-trichlorohexyl group, a bromomethyl group, a dibromomethyl group, a tribromomethyl group, a 2-iodoethyl group, a 3-iodopropyl group, and a 4-iodobutyl group.

Examples of the alkoxy group include a methoxy group, an ethoxy group, a n-propoxy group, an isopropoxy group, a n-butoxy group, an isobutoxy group, a sec-butoxy group, a tert-butoxy group, a n-pentyloxy group, and a n-hexyloxy group.

The alkoxy group may have as a substituent a halogen atom. That is, the alkoxy group may be a halogen-substituted alkoxy group.

Examples of the halogen-substituted alkoxy group include a fluoromethyloxy group, a difluoromethyloxy group, a trifluoromethyloxy group, a 2-fluoroethyloxy group, a 2,2-difluoroethyloxy group, a 2,2,2-trifluoroethyloxy group, a pentafluoroethyloxy group, a 3,3,3-trifluoropropyloxy group, a 4,4,4-trifluorobutyloxy group, a 5,5,5-trifluoropentyloxy group, and a 5,5,5,4,4-pentafluoropentyloxy group.

Examples of the aralkyl group include a benzyl group, a phenethyl group, an α-methylbenzyl group, an α,α-dimethylbenzyl group, a 1-naphthylmethyl group, a 2-naphthylmethyl group, an anthracenylmethyl group, a phenanthrenylmethyl group, a pyrenylmethyl group, a furfuryl group, a 2-methylbenzyl group, a 3-methylbenzyl group, a 4-methylbenzyl group, a 4-ethylbenzyl group, a 4-isopropylbenzyl group, a 4-tert-butylbenzyl group, a 4-n-hexylbenzyl group, a 4-n-nonylbenzyl group, a 3,4-dimethylbenzyl group, a 3-methoxybenzyl group, a 4-methoxybenzyl group, a 4-ethoxybenzyl group, a 4-n-butyloxybenzyl group, a 4-n-hexyloxybenzyl group, and a 4-n-nonyloxybenzyl group.

The alkylene moiety of the aralkyl group may have as a substituent a halogen atom.

Examples of the aralkyl group in which the alkylene moiety has as a substituent a halogen atom include a fluoromethylphenyl group (a specific example thereof is a group represented by the following structural formula (i)), a difluoromethylphenyl group (a specific example thereof is a group represented by the following structural formula (ii)), a 2,2-difluoro-2-phenylethyl group, a 2,2,1,1-tetrafluoro-2-phenylethyl group, a 3,3-difluoro-3-phenylpropyl group, and a 4,4-difluoro-4-phenylbutyl group.

Additional examples thereof include: a group obtained by substituting the fluorine atom in the aralkyl group in which the alkylene moiety has as a substituent a halogen atom with any other halogen atom (such as a chlorine atom, a bromine atom, or an iodine atom); and a group obtained by substituting the phenyl group in the aralkyl group in which the alkylene moiety has as a substituent a halogen atom with any other aryl group; and a group obtained by bonding an aryl group to a divalent group obtained from the group of the alkyl groups having as a substituent a halogen atom (halogen-substituted alkyl groups) listed above.

(i)

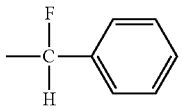

(ii)

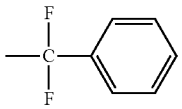

The aryl group of the aralkyl group may have a halogen atom such as a fluorine atom, a chlorine atom, a bromine atom, or an iodine atom, or a halogen-substituted alkyl group as a substituent at a substitutable position.

Examples of the halogen atom as a substituent include a fluorine atom, a chlorine atom, a bromine atom, and an iodine atom.

The halogen-substituted alkyl group that Ar or Ph can have is, for example, a group obtained by substituting a hydrogen atom of the alkyl group that Ar or Ph can have with a halogen atom (such as a fluorine atom, a chlorine atom, a bromine atom, or an iodine atom).

Fn represents a reactive functional group.

In the present invention, the reactive functional group means the following functional group: when a reaction occurs between molecules each having a reactive functional group, the functional group can bond the molecules through a covalent bond.

Examples of Fn include the following structures.

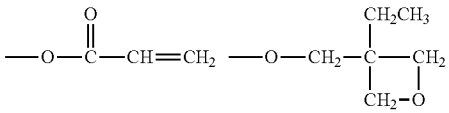

-continued

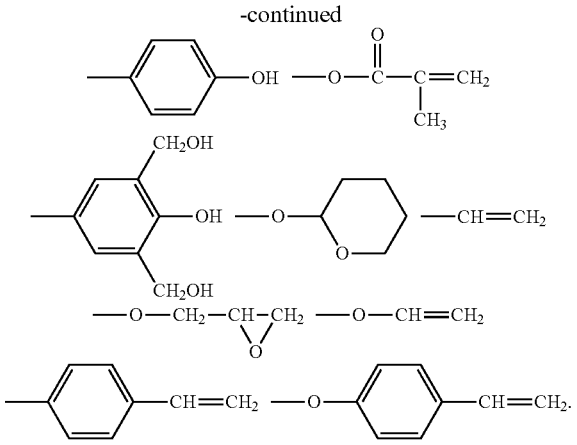

Fn preferably represents an acryloyloxy group or a methacryloyloxy group from the viewpoint of the wear resistance of the surface of the electrophotographic photosensitive member.

Different Fn's may be present in one molecule of the compound represented by the structural formula (1), or different Fn's may be present in a plurality of molecules of the compound represented by the structural formula (1).

m and n each independently represent 0 or 1. p represents an integer of 0 or more and 4 or less, and when p represents 2 or more, structures in p sets of parentheses may be identical to or different from each other, provided that when p represents 2 or more, the case where oxygen atoms (O) are continuous is excluded. q represents an integer of 0 or more and 3 or less, and when q represents 2 or more, structures in q sets of parentheses may be identical to or different from each other. r represents an integer of 1 or more and 6 or less, and when r represents 2 or more, structures in r sets of parentheses may be identical to or different from each other.

The number of reactive functional groups of the compound represented by the structural formula (1) is determined by a combination of the numbers represented by q and r. The structural formula (1) has at least one Fn.

The compound represented by the structural formula (1) is preferably such that a structure except Fn, i.e., a structure except the reactive functional group has a conjugated structure containing 20 or more sp2 carbon atoms from the viewpoint of its hole transporting property. The structure more preferably has a conjugated structure containing 24 or more sp2 carbon atoms. In the conjugated structure containing sp2 carbon atoms, 20 or more sp2 carbon atoms are preferably continuously bonded to each other, and 24 or more sp2 carbon atoms are more preferably continuously bonded to each other.

The conjugated structure means a structure in which sp2 carbon atoms are continuously bonded to each other. The conjugated structure has the following property: the structure delocalizes an electron in a molecule of the hole transportable compound to facilitate the transfer of charge between its molecules.

It should be noted that the above-mentioned suitable range relates to the structure except Fn out of the compound represented by the structural formula (1), and hence an sp2 carbon atom in Fn is not included upon counting of sp2 carbon atoms. For example, an sp2 carbon atom in the double bond (C═C) or carbonyl group (C═O) of an acryloyloxy group or methacryloyloxy group as an example of Fn is not included. An sp2 carbon atom in a reactive phenol group is also not included.

The molecular weight of the compound represented by the structural formula (1) is preferably 300 or more, and is preferably 1,000 or less. The molecular weight is more preferably 300 or more and 1,000 or less. When the molecular weight is 300 or more, conjugation in a molecule of the compound extends to additionally improve its hole transporting ability. In addition, when the molecular weight is 1,000 or less, good solubility and good film formability can be obtained upon preparation of a coating liquid and application of the coating liquid.

The compound represented by the structural formula (1) is preferably such that the structure except Fn is a structure formed only of a carbon atom and a hydrogen atom, or a structure formed only of a carbon atom, a hydrogen atom, and an oxygen atom. Such structure enables the compound to show additionally high deterioration resistance and an additionally high hole transporting property.

Specific examples of the compound represented by the structural formula (1) are shown below. It should be noted that the compound represented by the structural formula (1) is not limited to these compounds. In addition, Fn in Exemplified Compounds shown below may be substituted with any other Fn described above. The substituent that Ar or Ph can have may be substituted with any other substituent described above.

Exemplified Compound No. 1

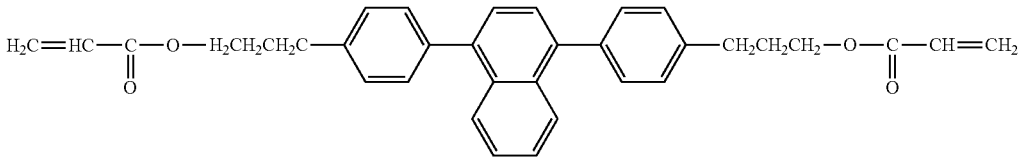

Exemplified Compound No. 2

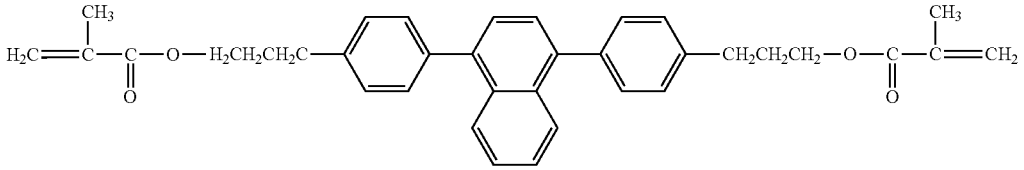

Exemplified Compound No. 3

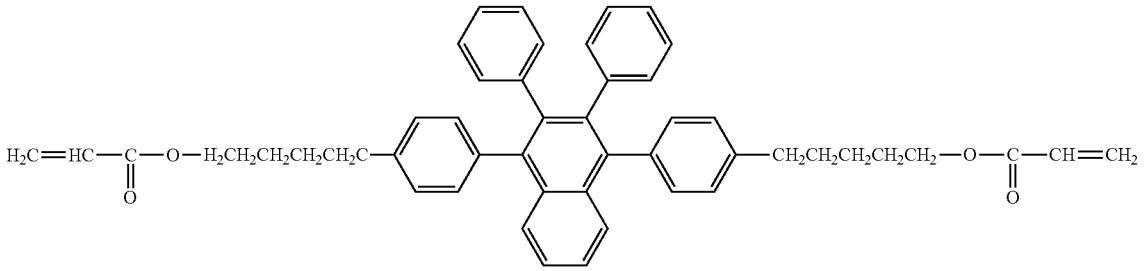

Exemplified Compound No. 4

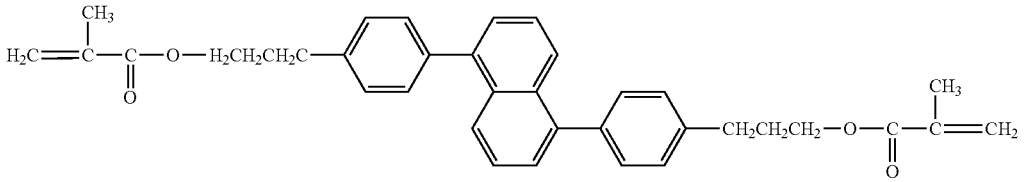

Exemplified Compound No. 5

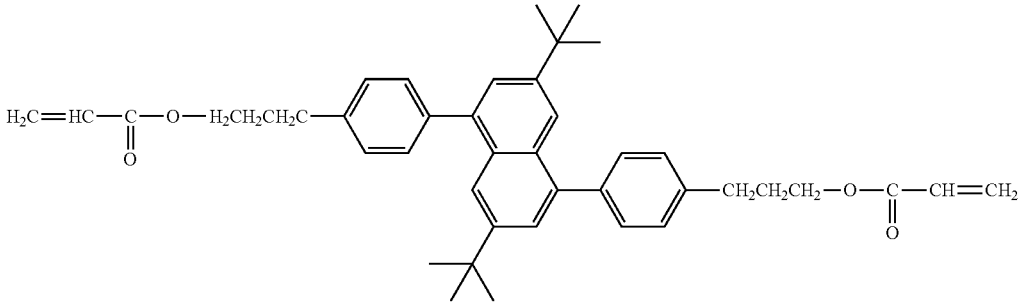

-continued
Exemplified Compound No. 6
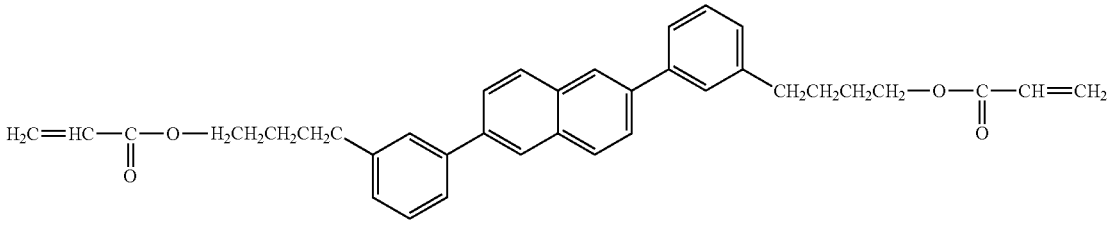
Exemplified Compound No. 7
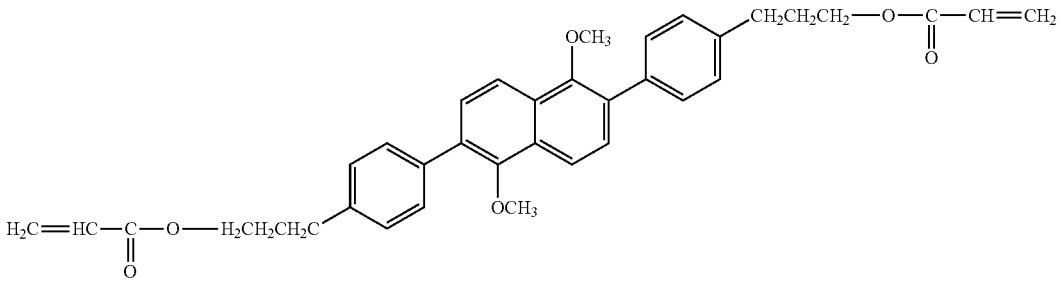
Exemplified Compound No. 8
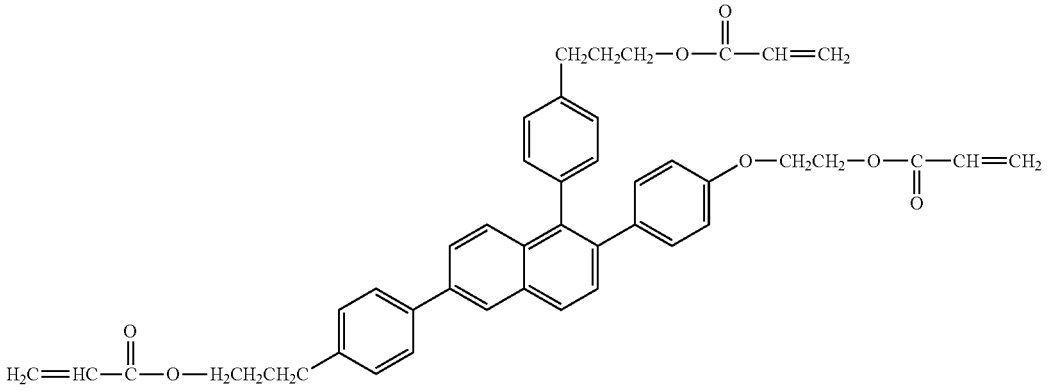
Exemplified Compound No. 9
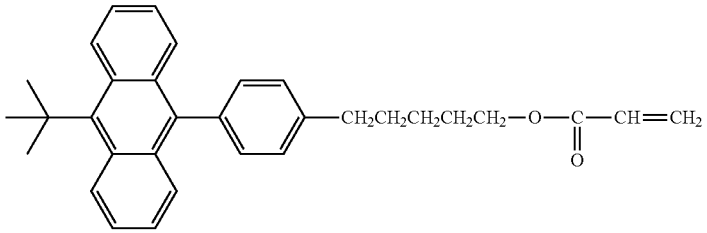
Exemplified Compound No. 10
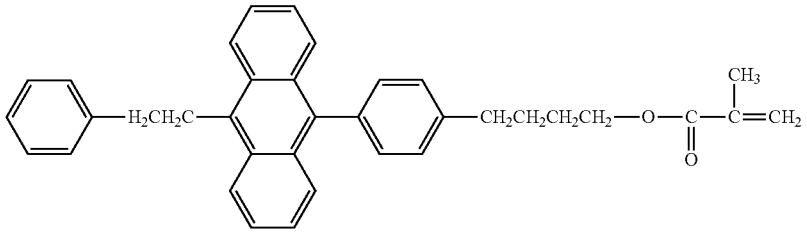

-continued
Exemplified Compound No. 11
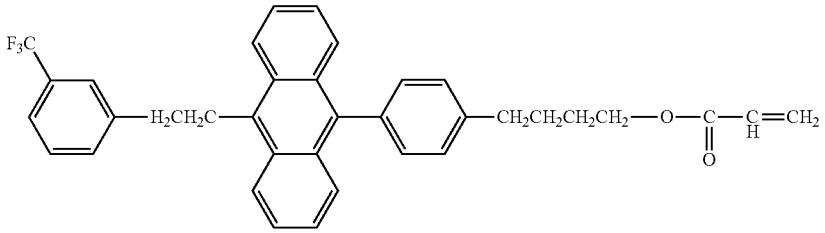
Exemplified Compound No. 12
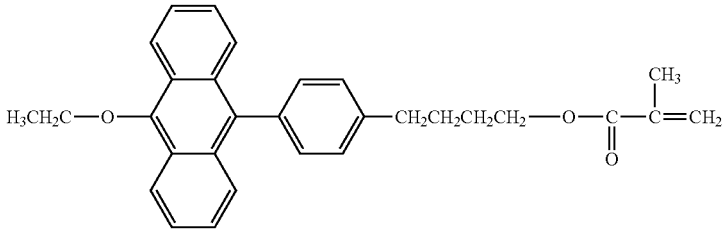
Exemplified Compound No. 13
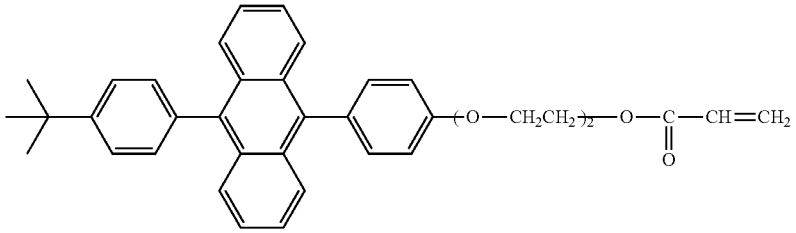
Exemplified Compound No. 14
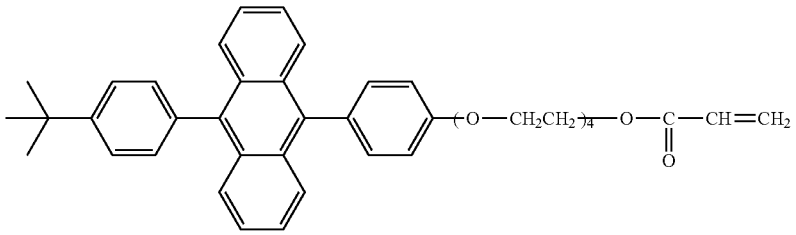
Exemplified Compound No. 15
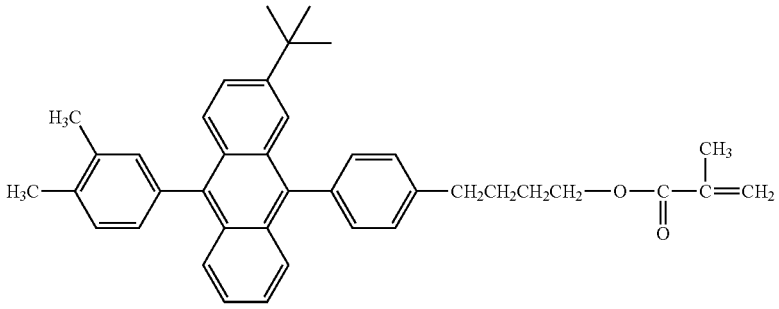
Exemplified Compound No. 16
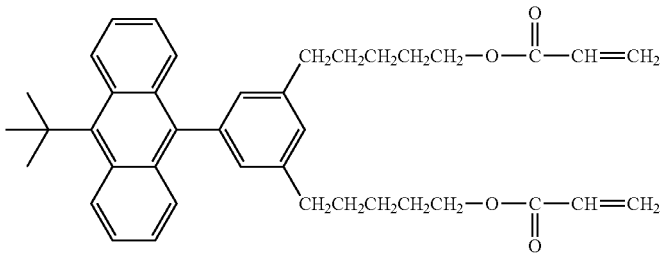

-continued
Exemplified Compound No. 17
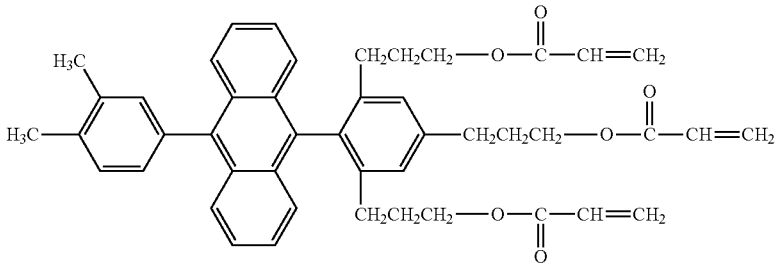
Exemplified Compound No. 18
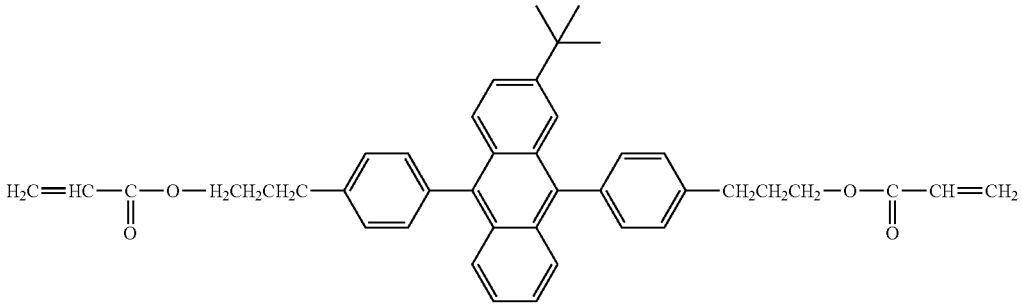
Exemplified Compound No. 19
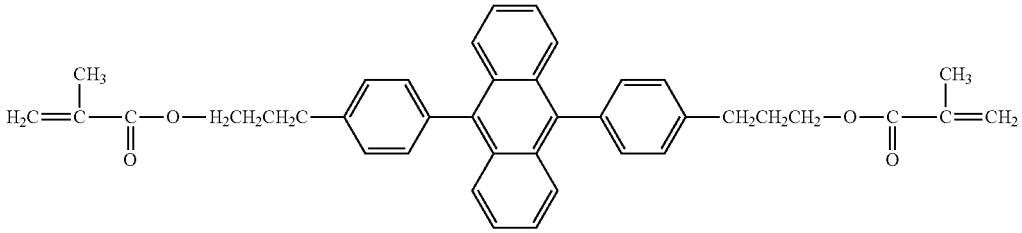
Exemplified Compound No. 20
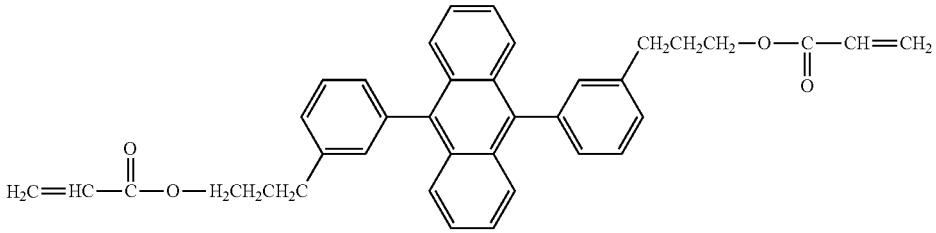
Exemplified Compound No. 21
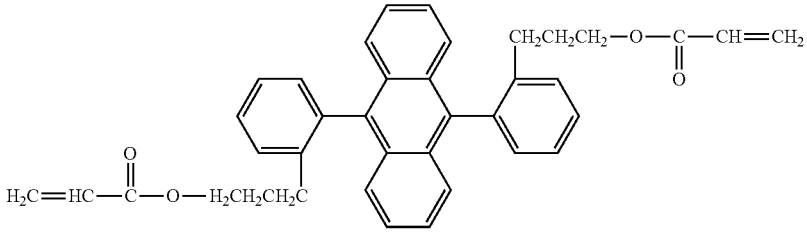
Exemplified Compound No. 22
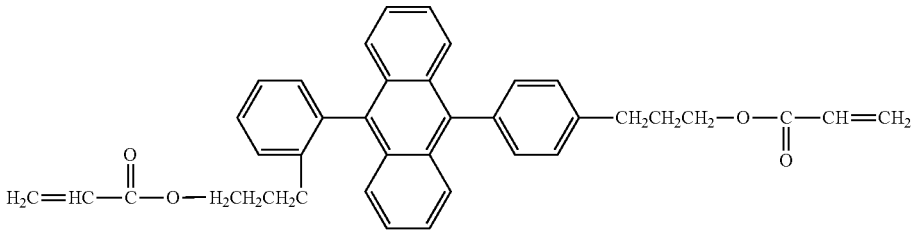

-continued
Exemplified Compound No. 23
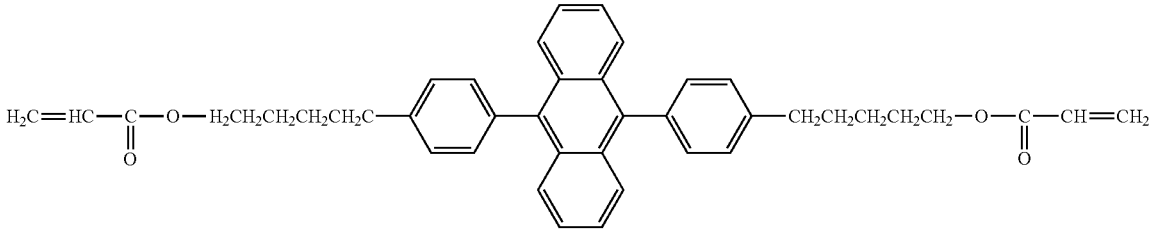
Exemplified Compound No. 24
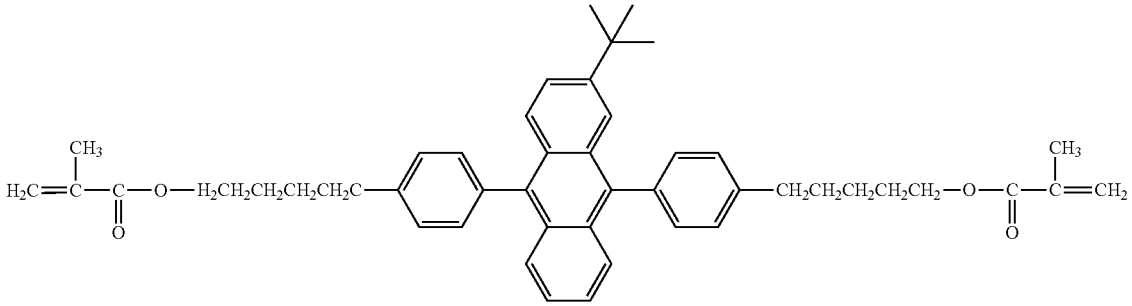
Exemplified Compound No. 25
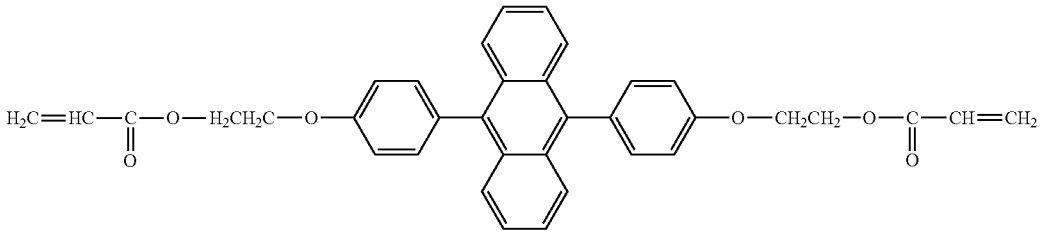
Exemplified Compound No. 26
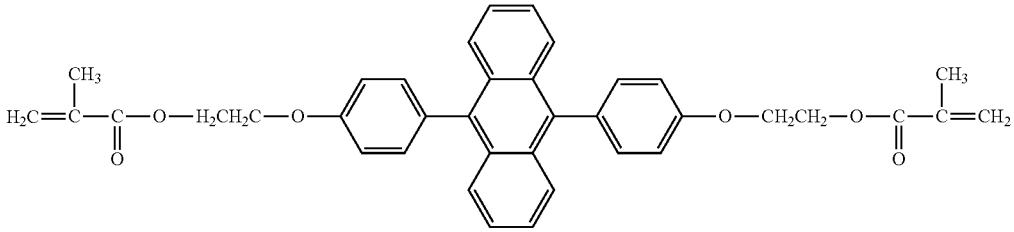
Exemplified Compound No. 27
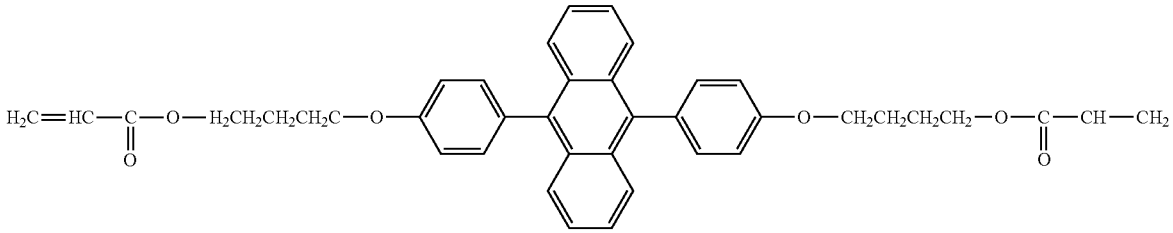
Exemplified Compound No. 28
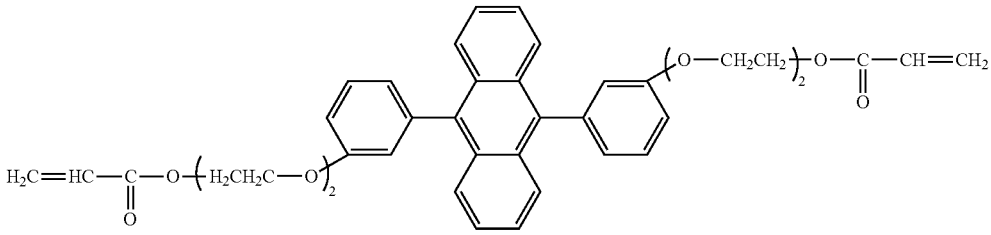

-continued
Exemplified Compound No. 29
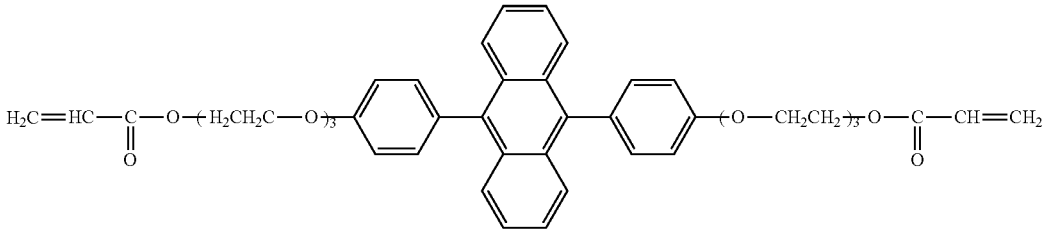
Exemplified Compound No. 30
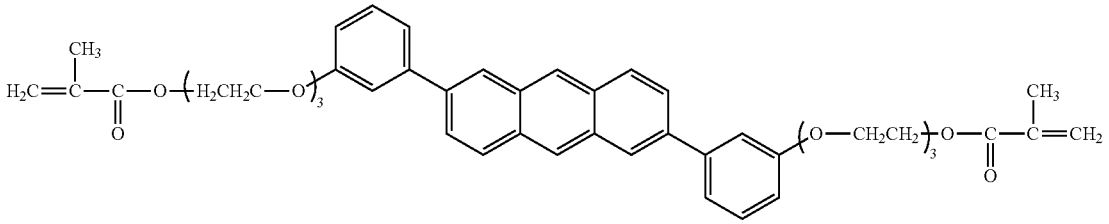
Exemplified Compound No. 31
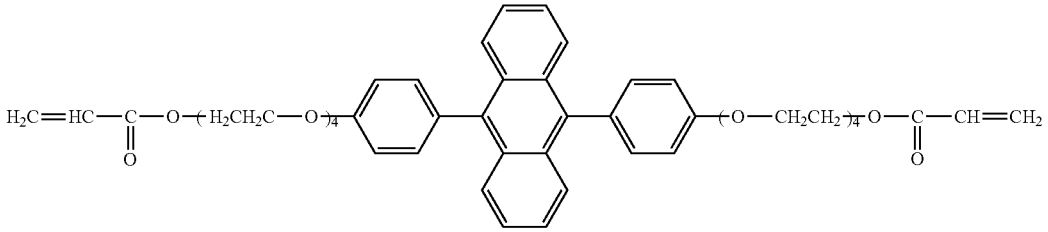
Exemplified Compound No. 32
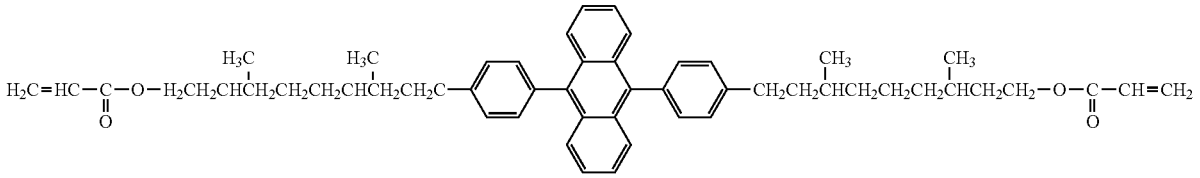
Exemplified Compound No. 33
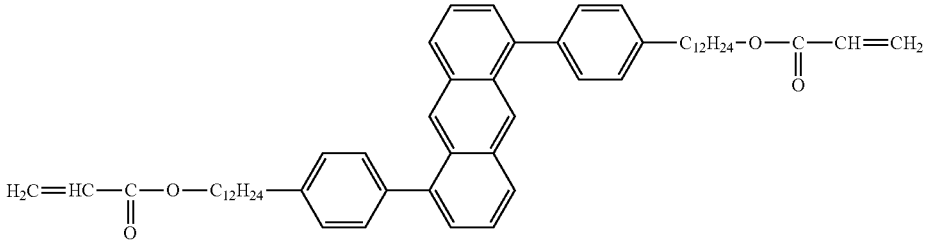
Exemplified Compound No. 34
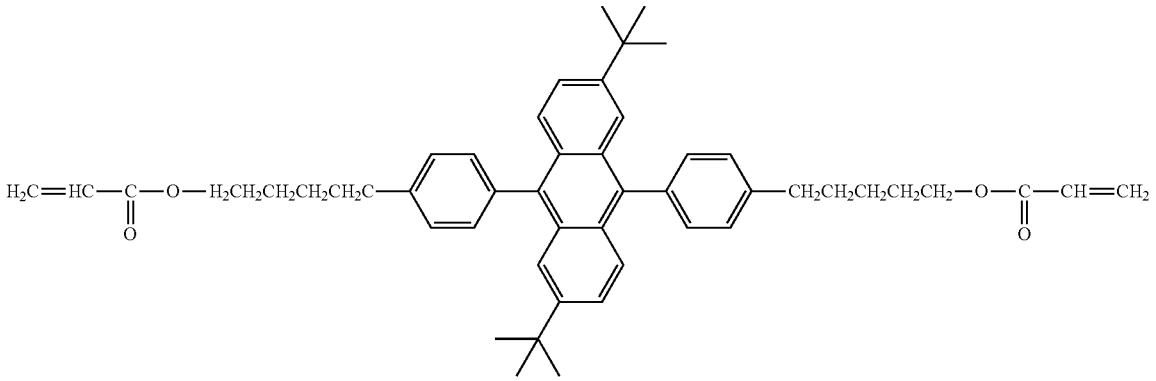

-continued
Exemplified Compound No. 35
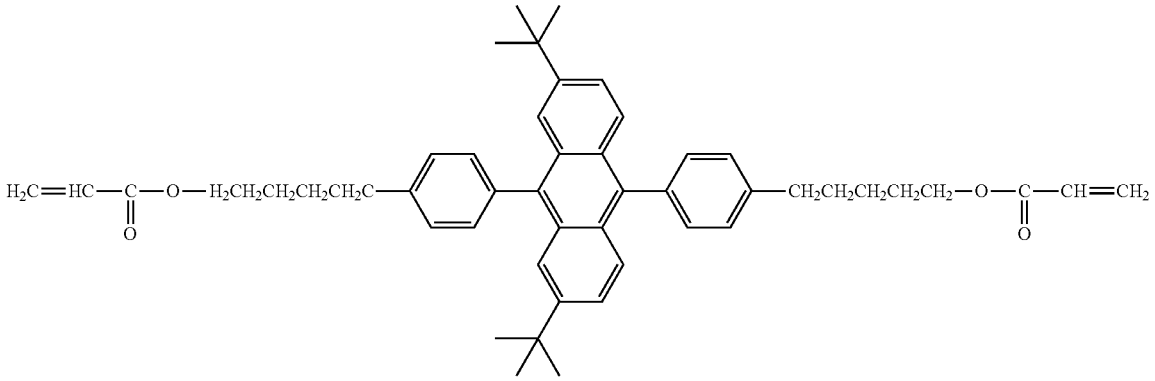
Exemplified Compound No. 36
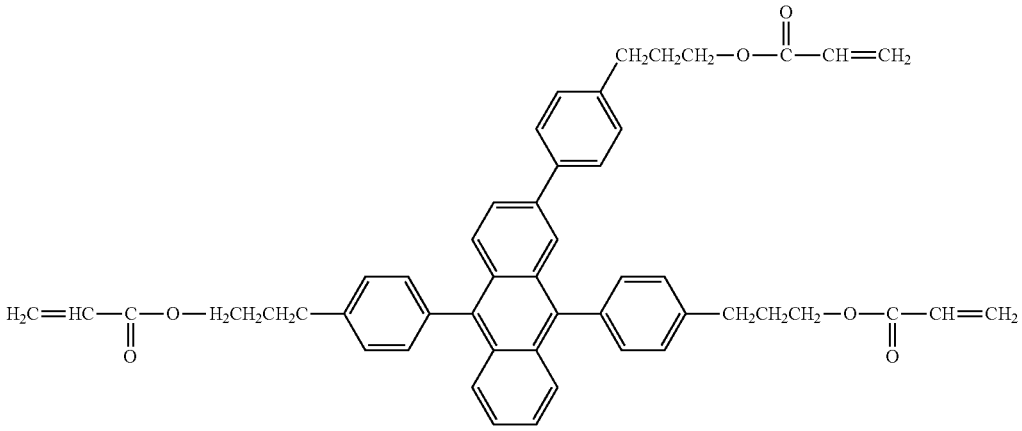
Exemplified Compound No. 37
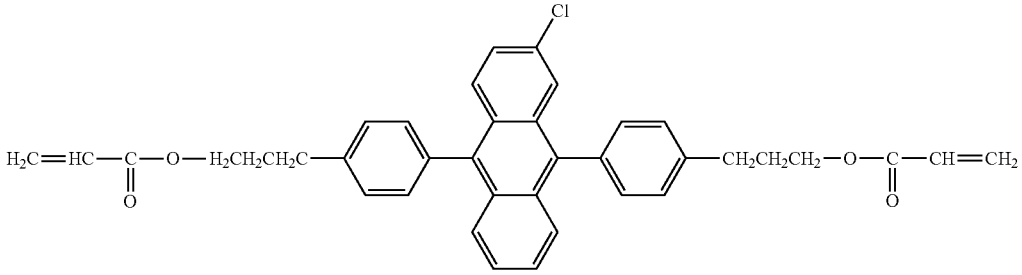
Exemplified Compound No. 38
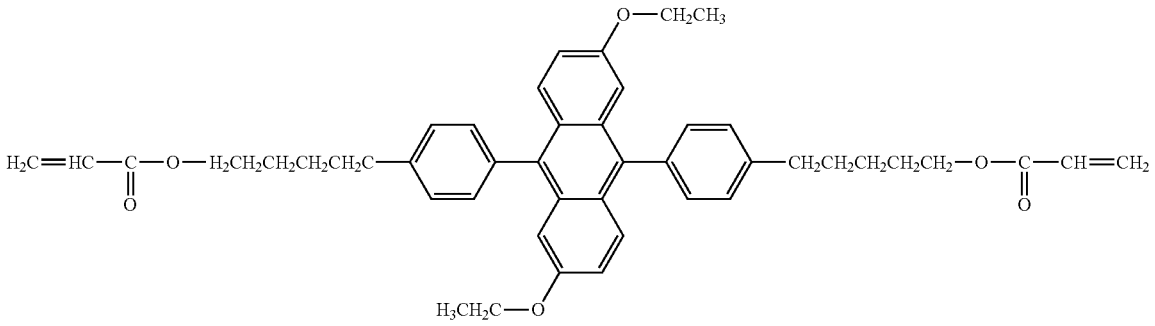

-continued
Exemplified Compound No. 39
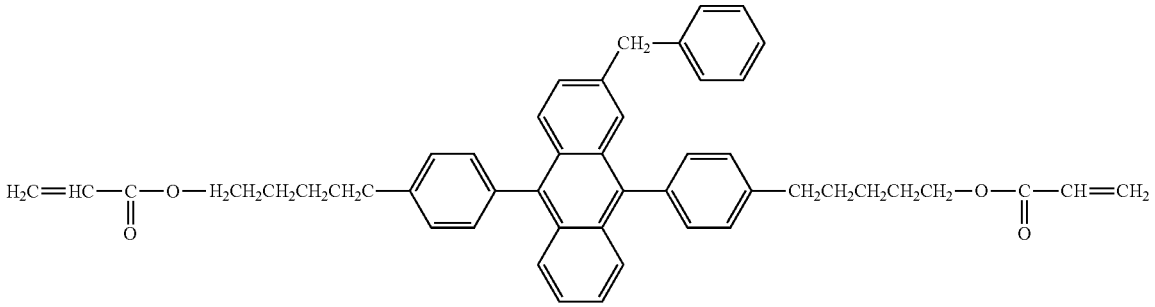
Exemplified Compound No. 40
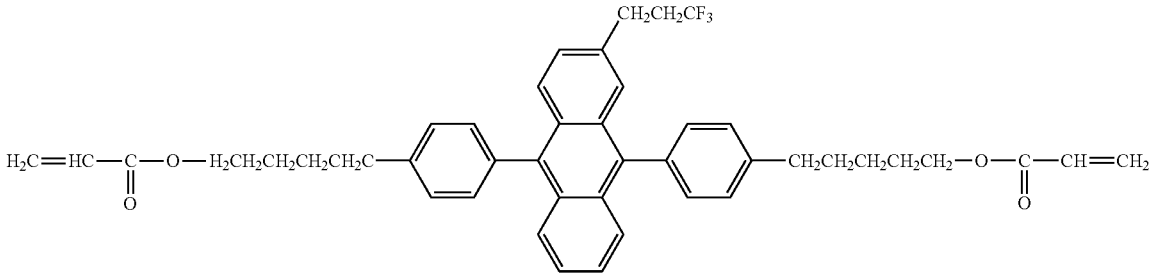
Exemplified Compound No. 41
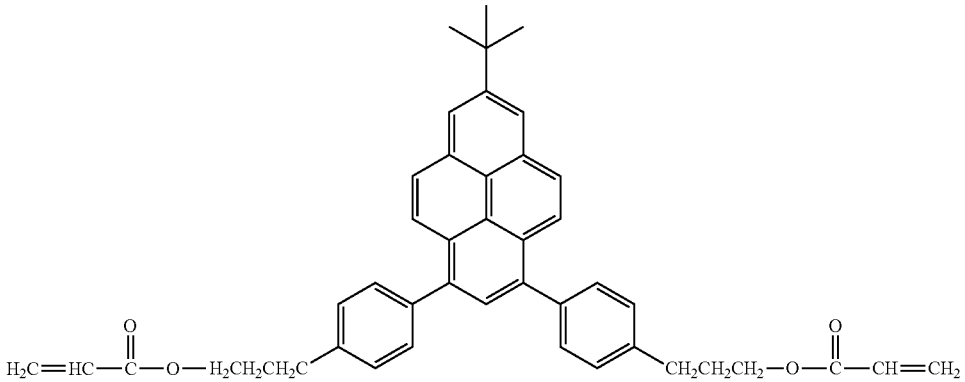
Exemplified Compound No. 42
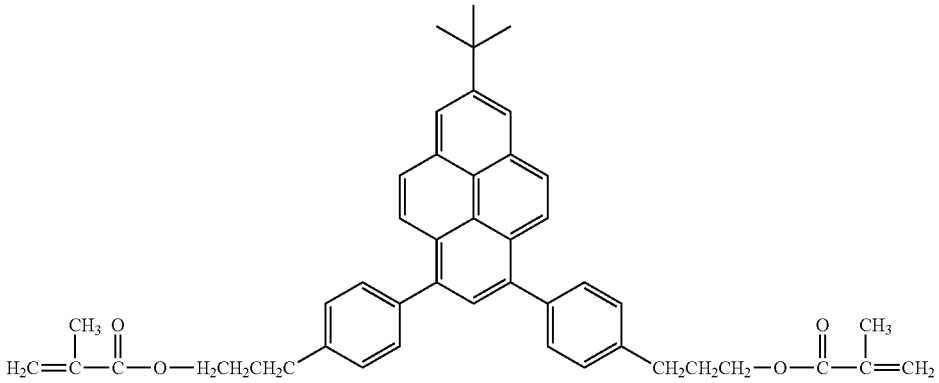

-continued
Exemplified Compound No. 43
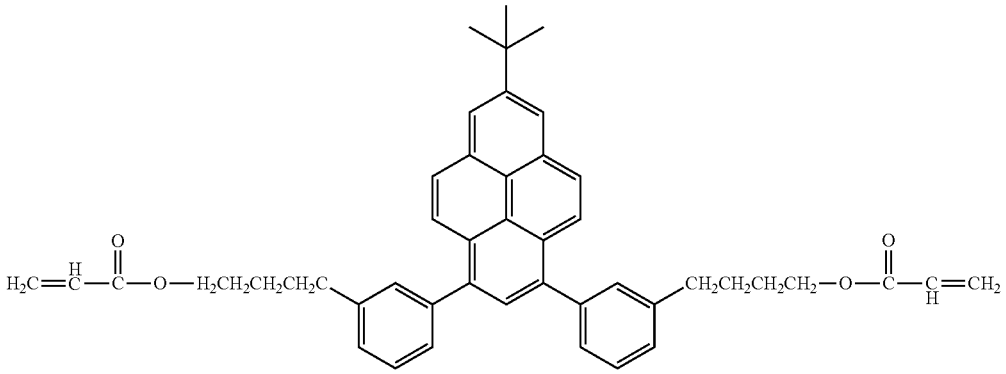
Exemplified Compound No. 44
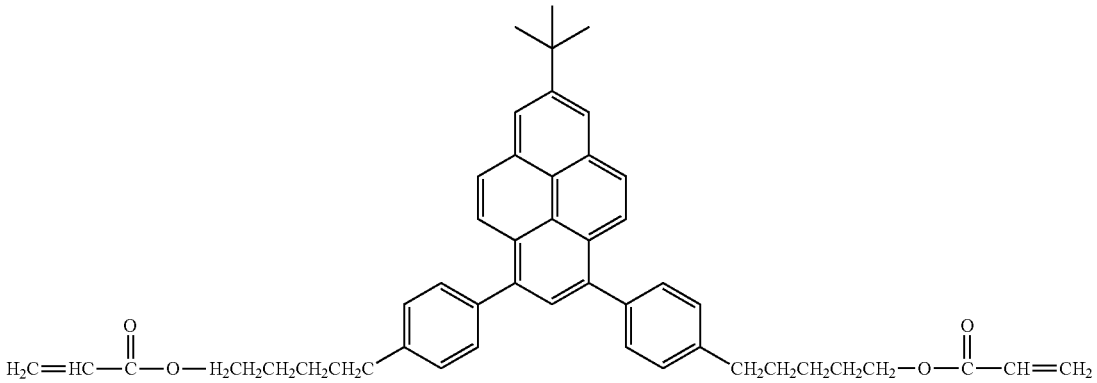
Exemplified Compound No. 45
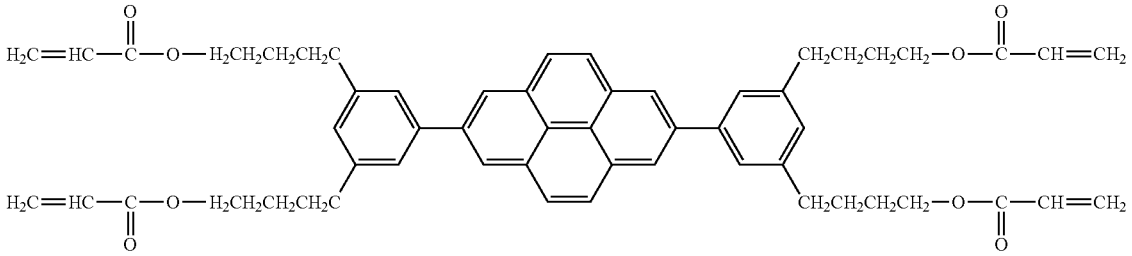
Exemplified Compound No. 46
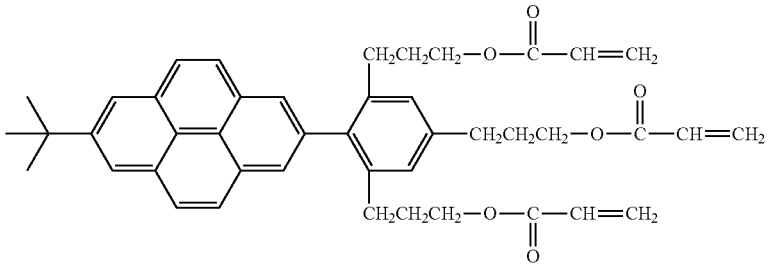

-continued
Exemplified Compound No. 47
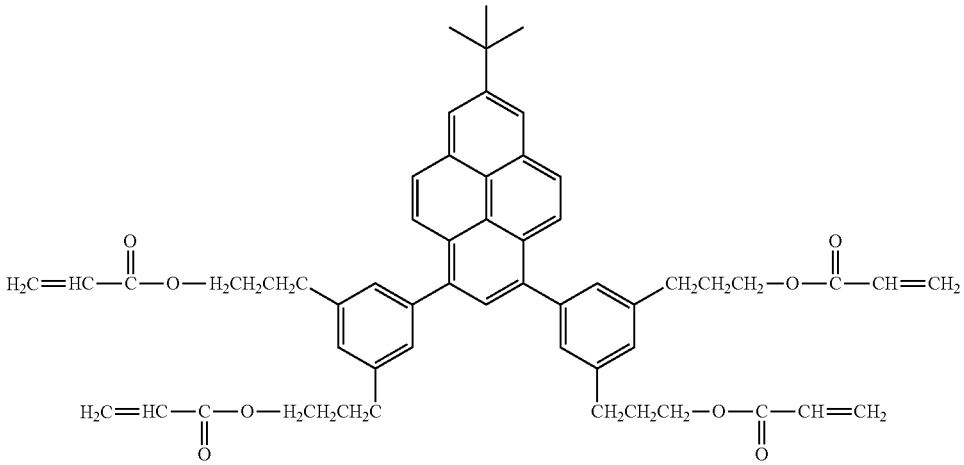
Exemplified Compound No. 48
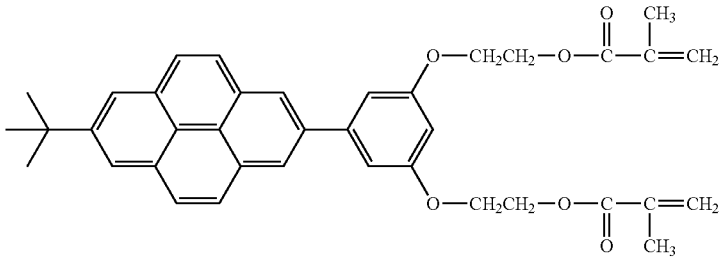
Exemplified Compound No. 49
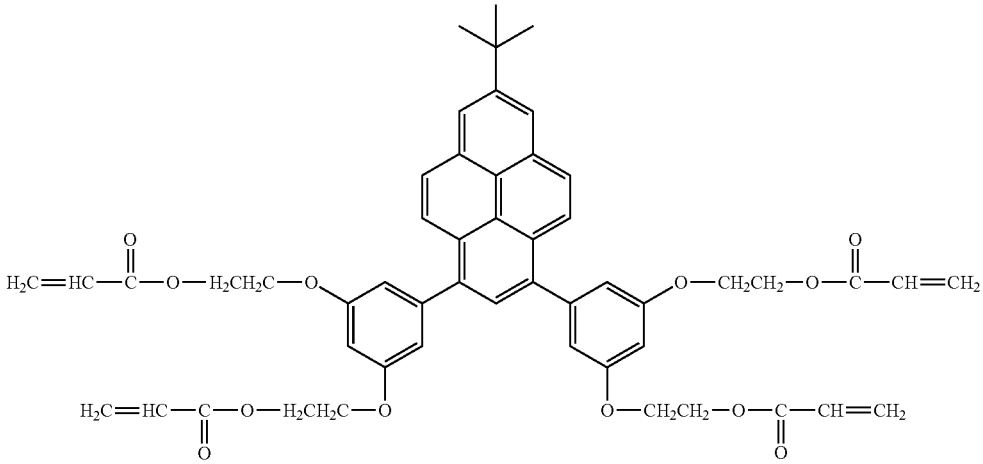
Exemplified Compound No. 50
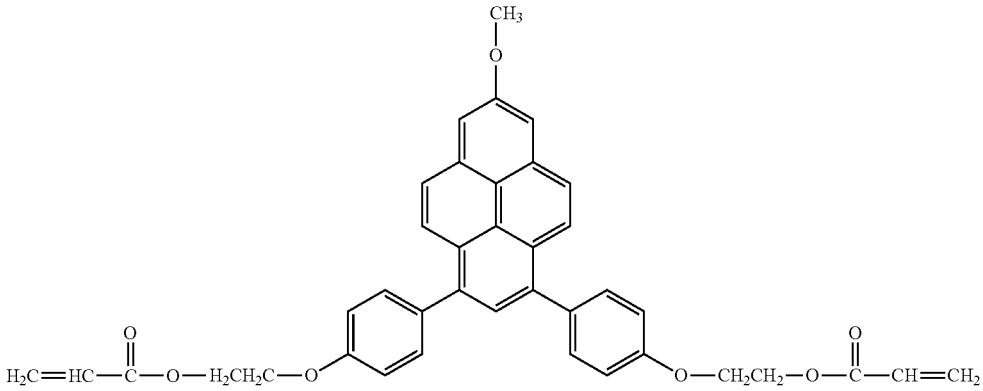

-continued
Exemplified Compound No. 51
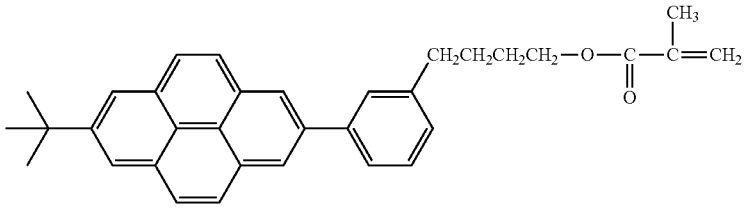
Exemplified Compound No. 52
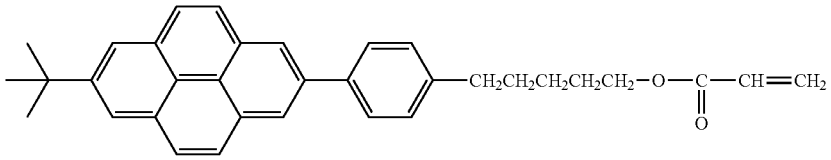
Exemplified Compound No. 53
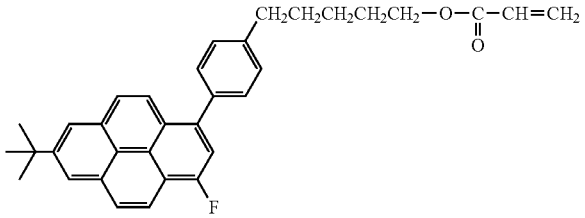
Exemplified Compound No. 54
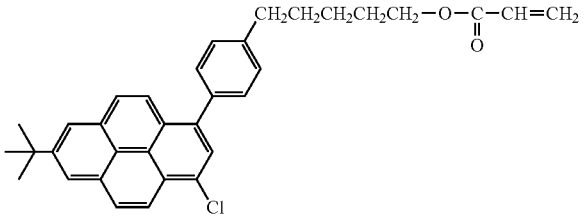
Exemplified Compound No. 55
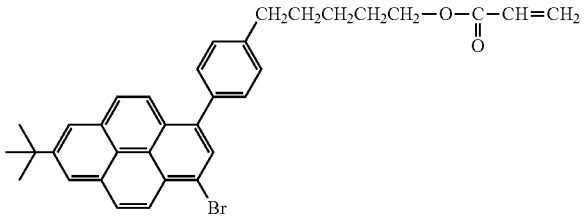
Exemplified Compound No. 56
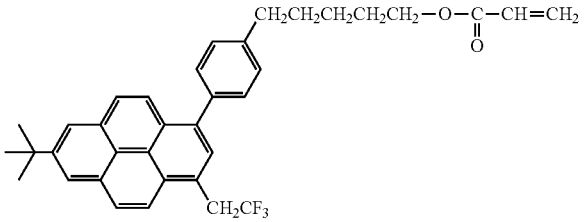
Exemplified Compound No. 57
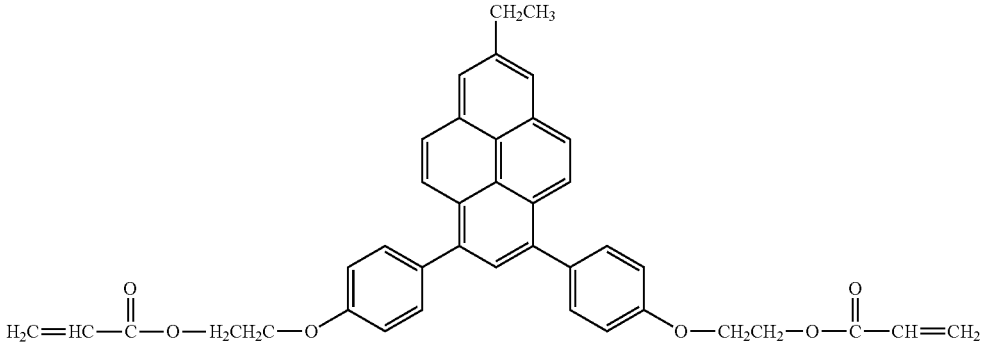
Exemplified Compound No. 58
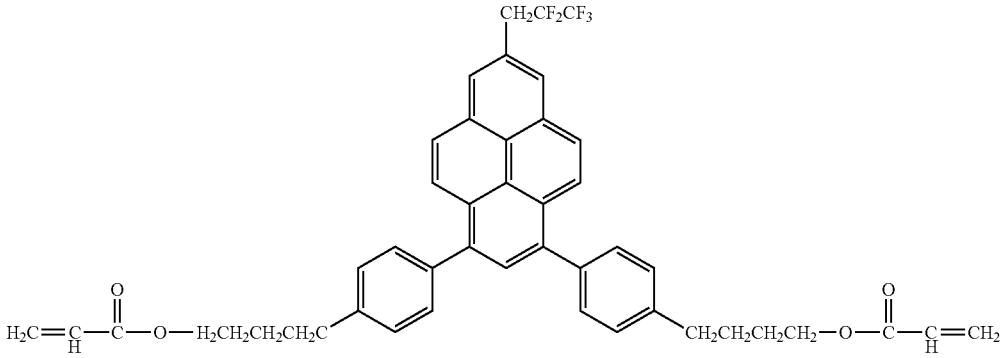

-continued
Exemplified Compound No. 59
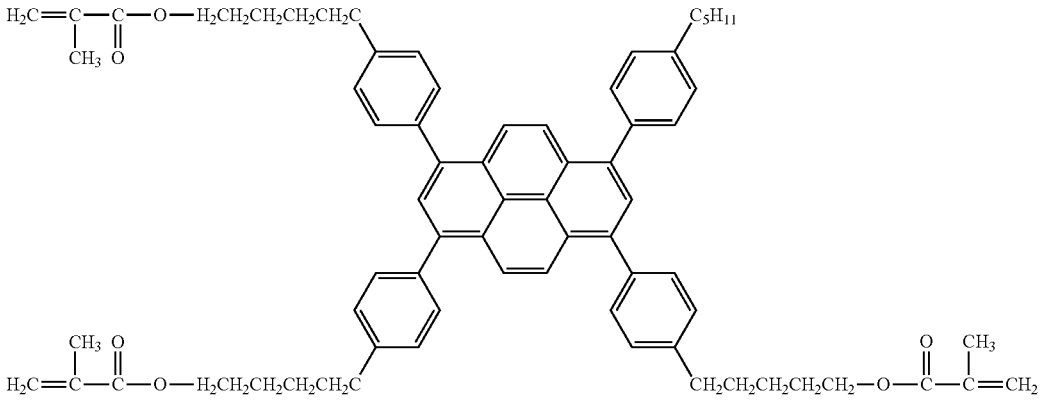
Exemplified Compound No. 60
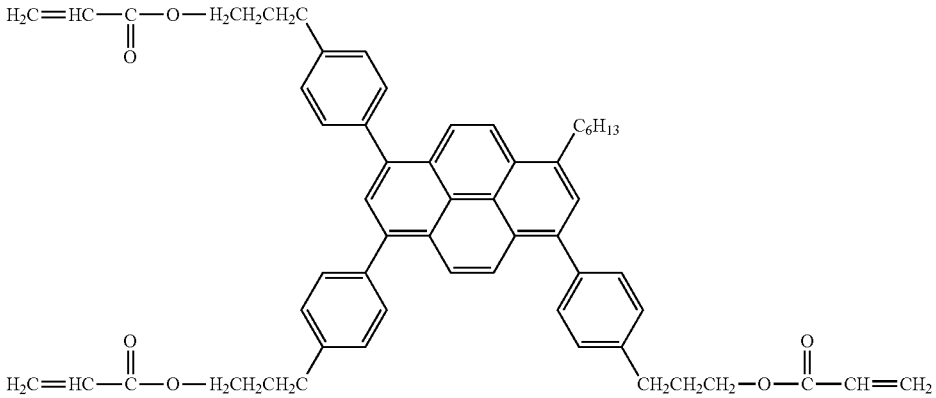
Exemplified Compound No. 61
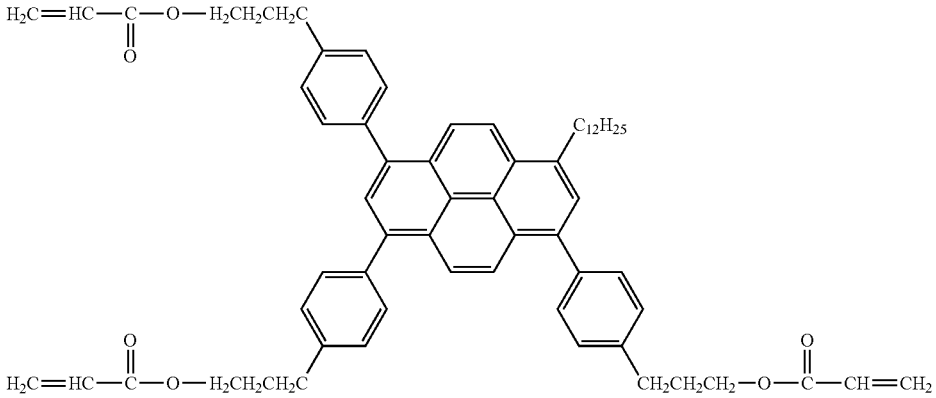
Exemplified Compound No. 62
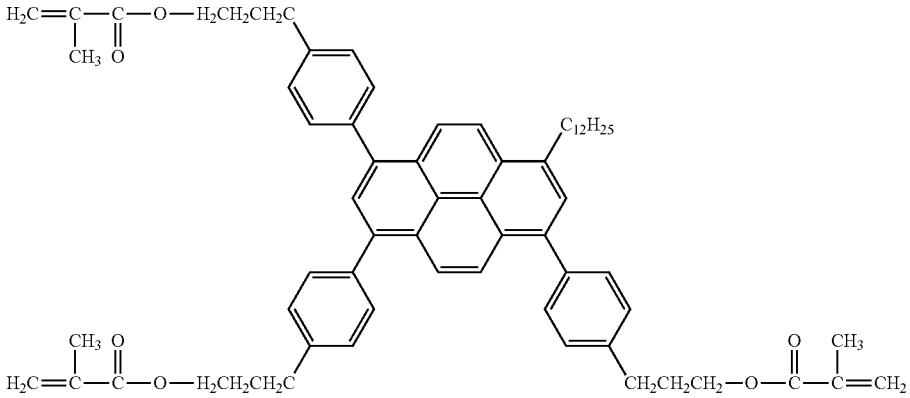

-continued
Exemplified Compound No. 63
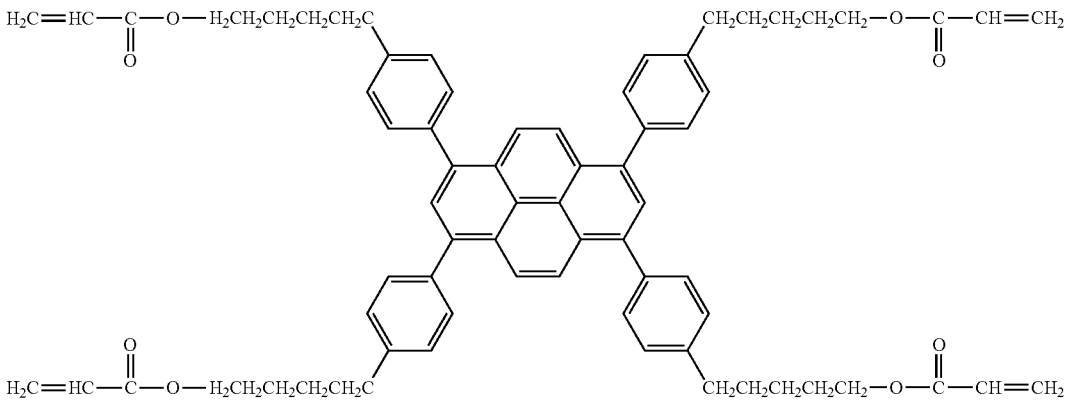
Exemplified Compound No. 64
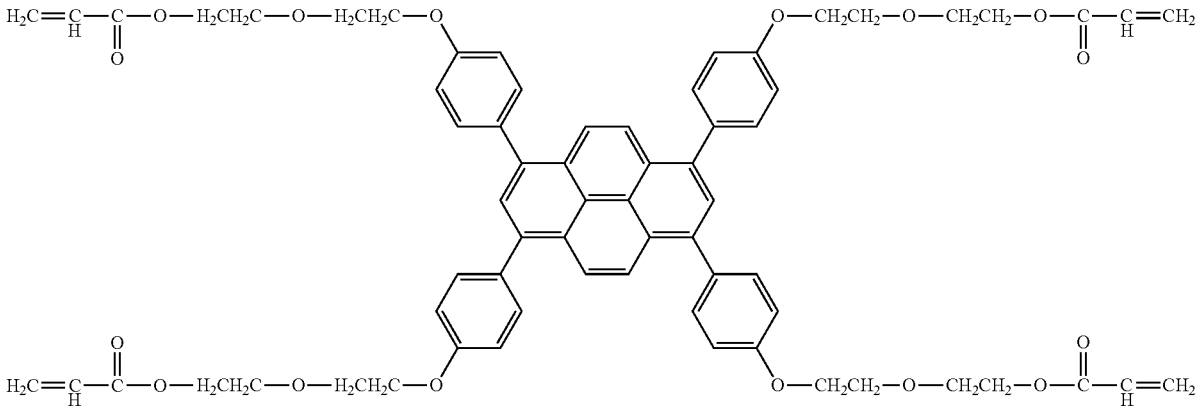
Exemplified Compound No. 65
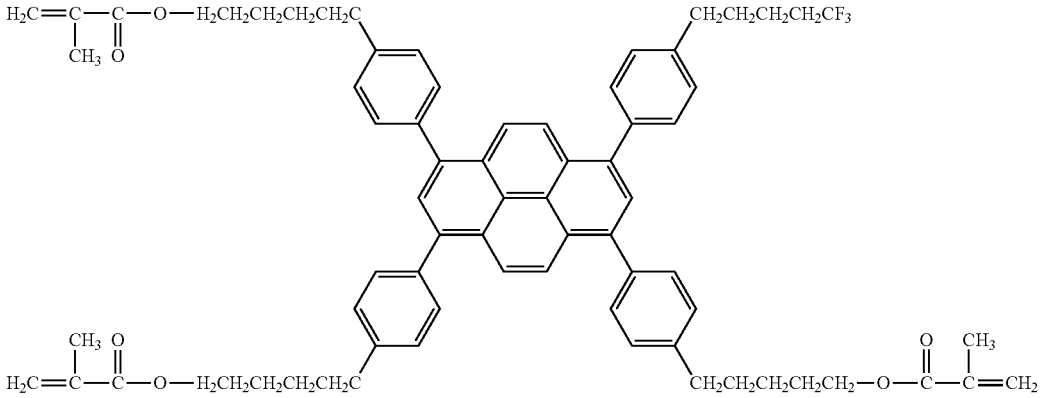

-continued
Exemplified Compound No. 66
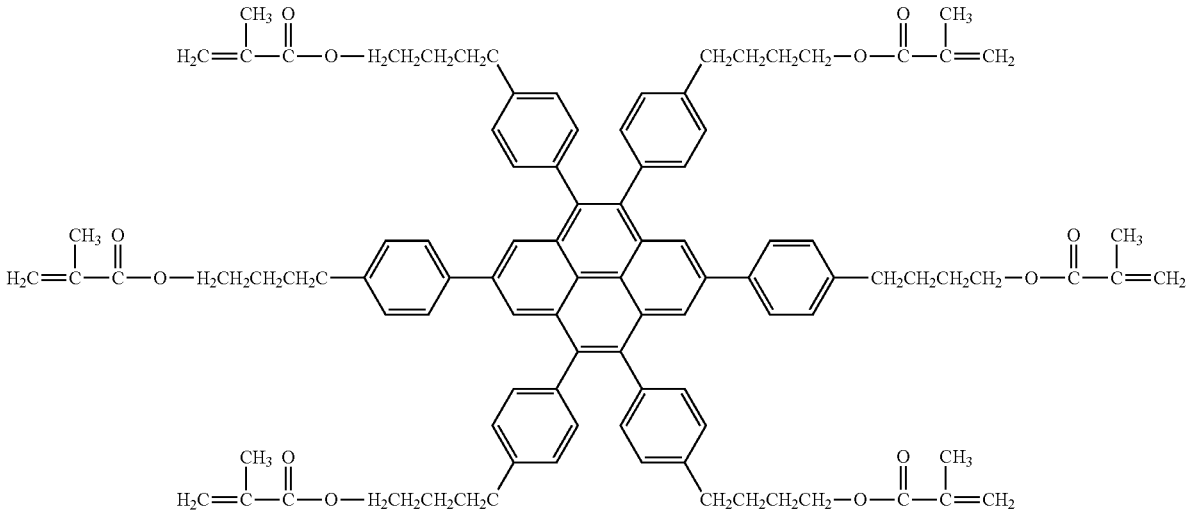
Exemplified Compound No. 67
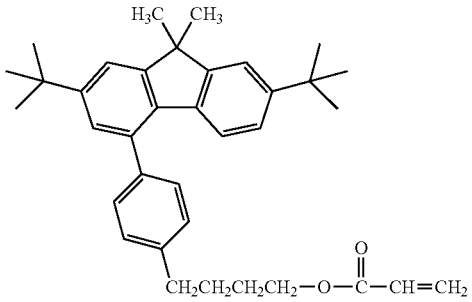
Exemplified Compound No. 68
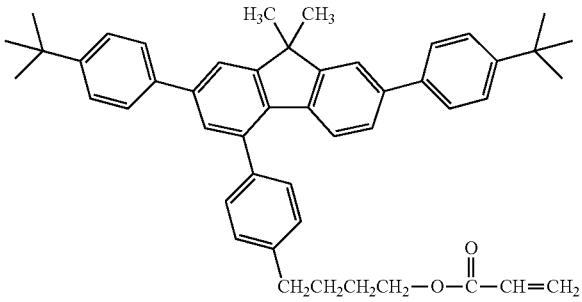
Exemplified Compound No. 69
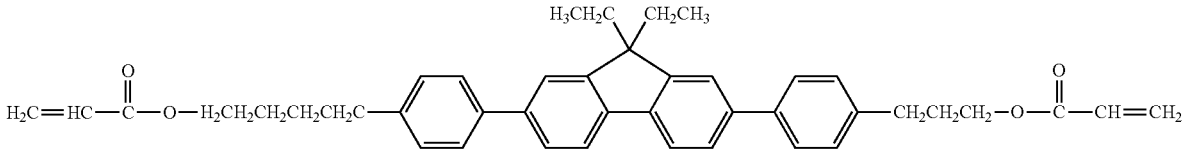
Exemplified Compound No. 70
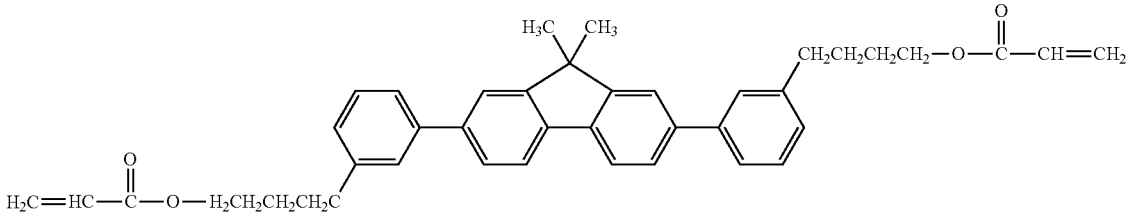
Exemplified Compound No. 71
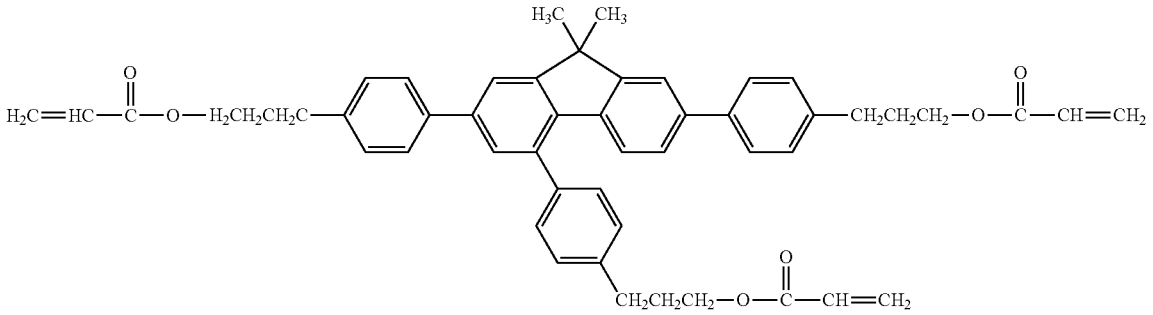

-continued
Exemplified Compound No. 72
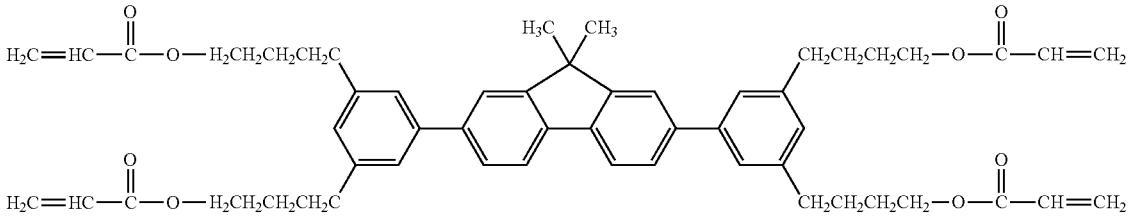
Exemplified Compound No. 73
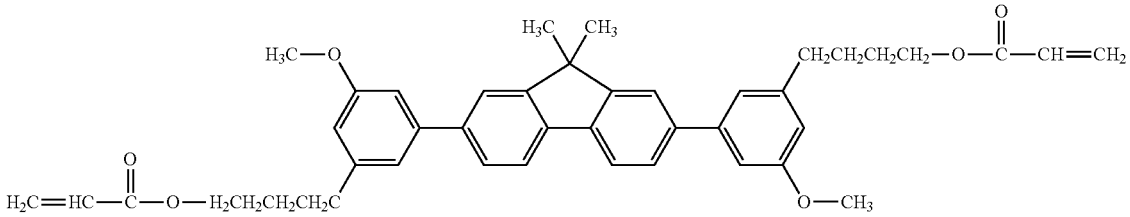
Exemplified Compound No. 74
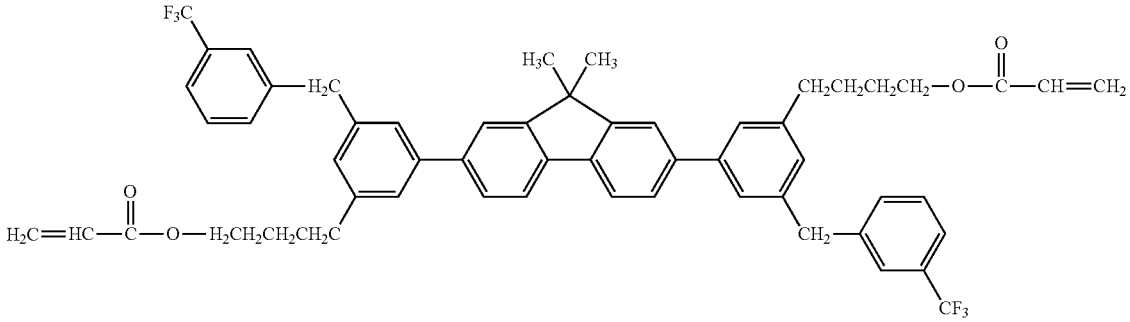
Exemplified Compound No. 75
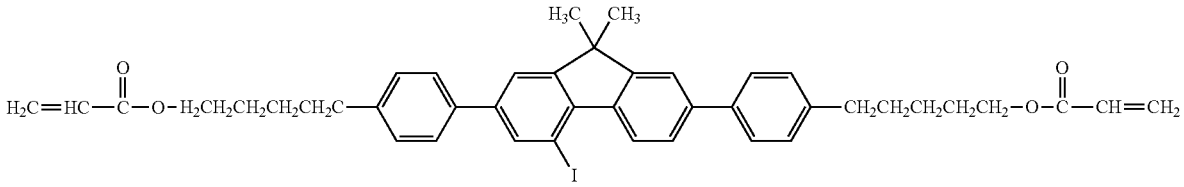
Exemplified Compound No. 76
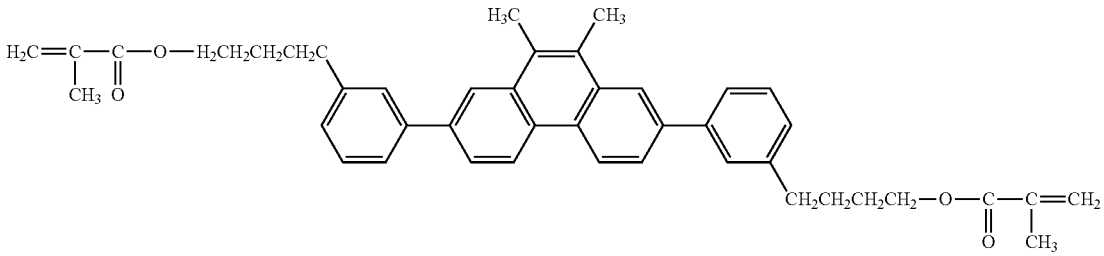
Exemplified Compound No. 77
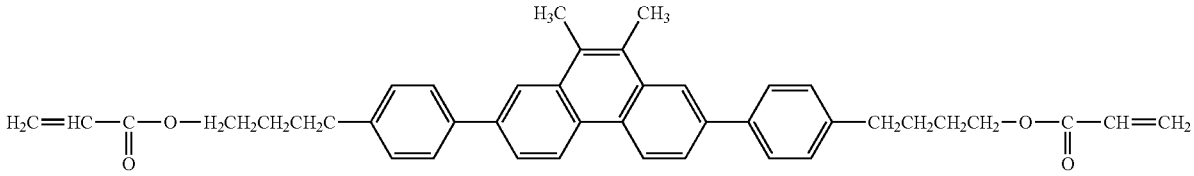

-continued
Exemplified Compound No. 78
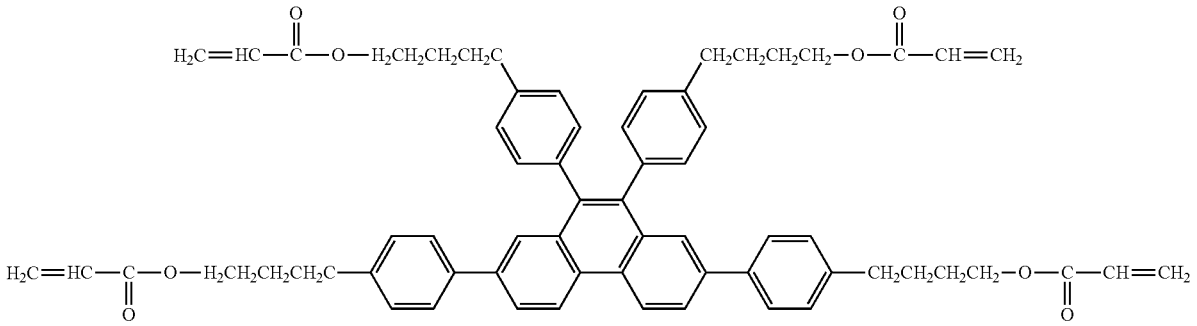
Exemplified Compound No. 79
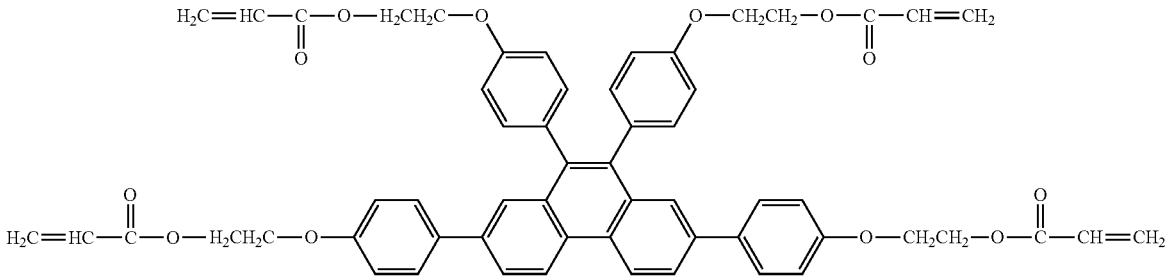
Exemplified Compound No. 80
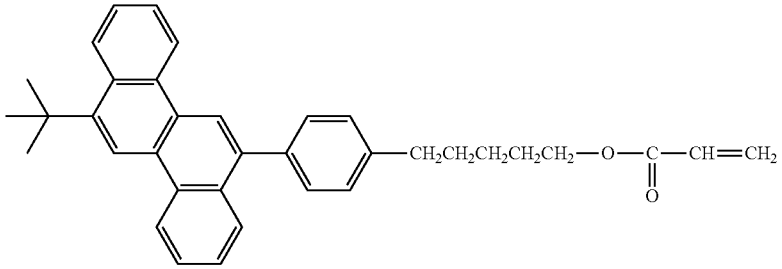
Exemplified Compound No. 81
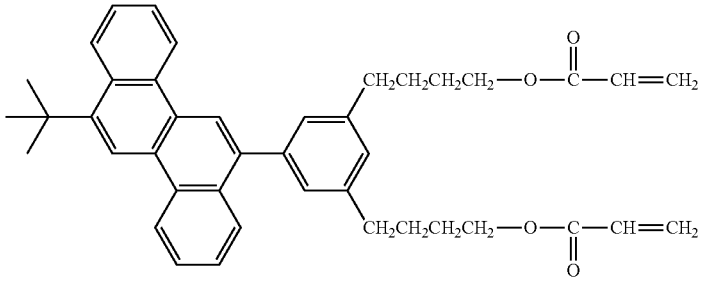
Exemplified Compound No. 82
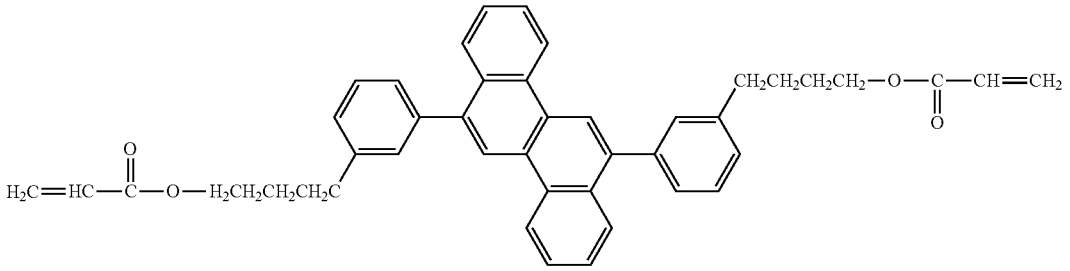

-continued
Exemplified Compound No. 83
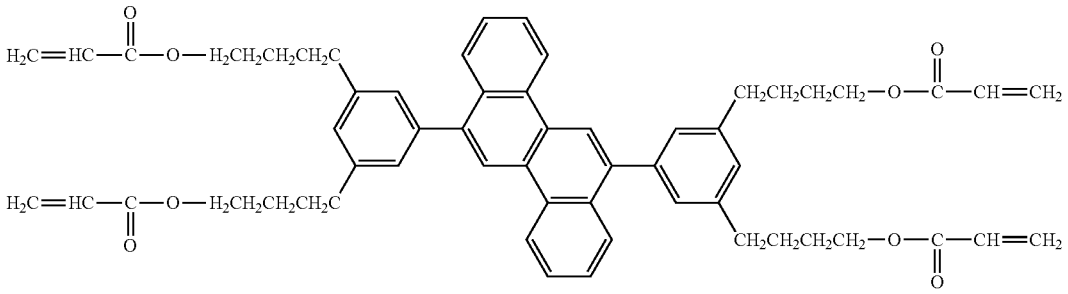
Exemplified Compound No. 84
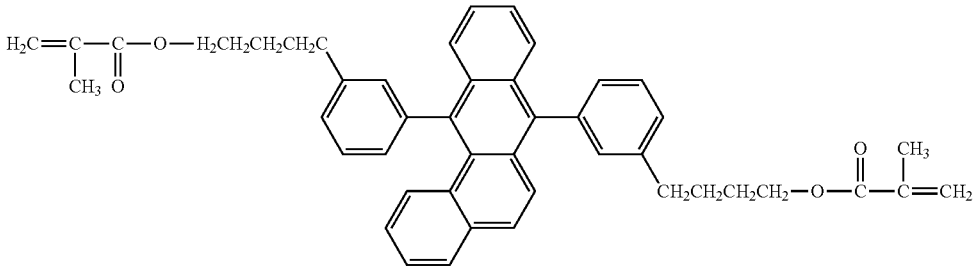
Exemplified Compound No. 85
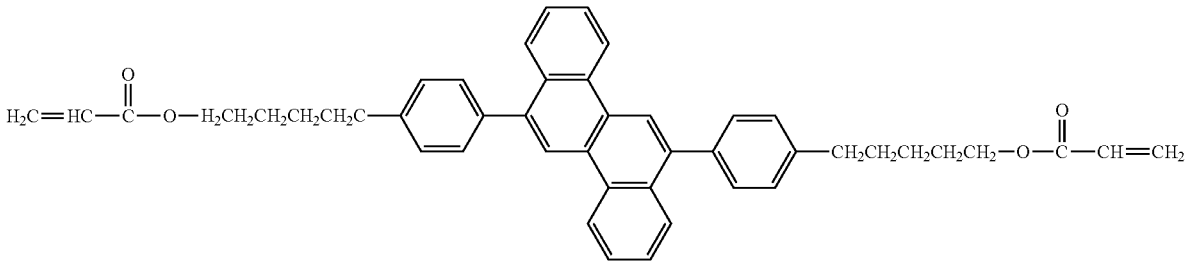
Exemplified Compound No. 86
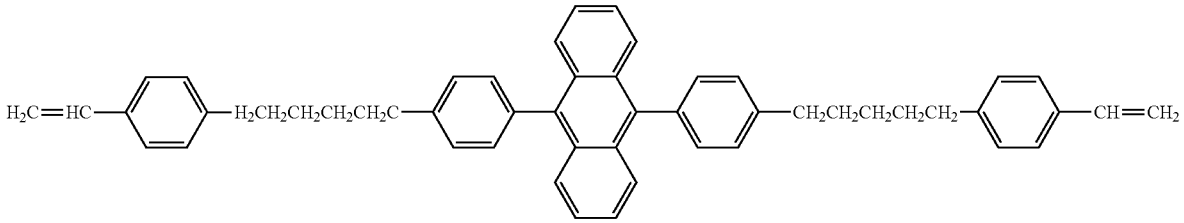
Exemplified Compound No. 87
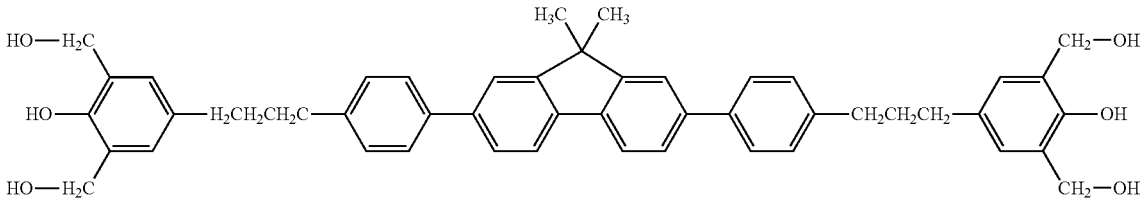
Exemplified Compound No. 88
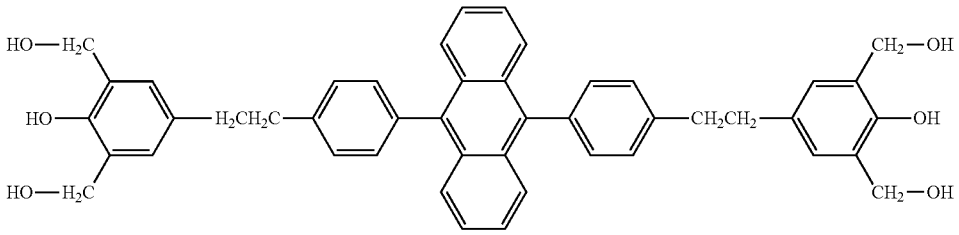

-continued
Exemplified Compound No. 89
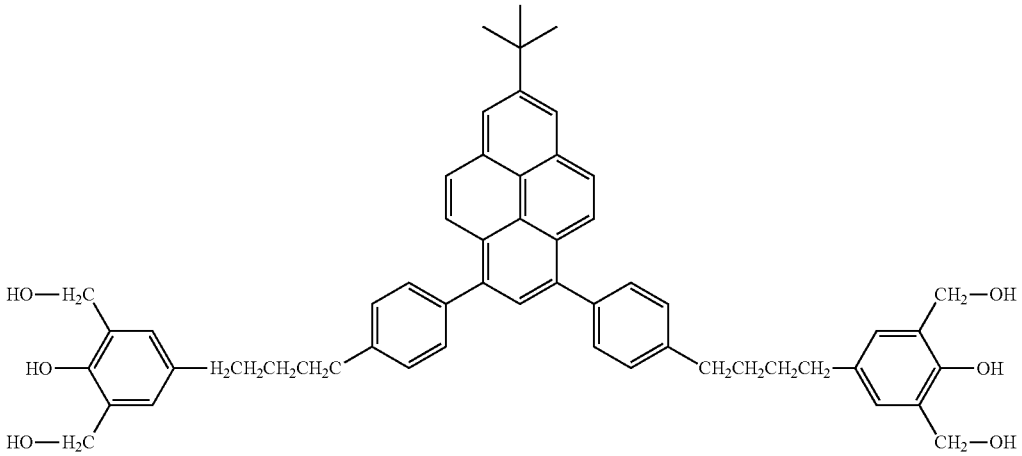
Exemplified Compound No. 90
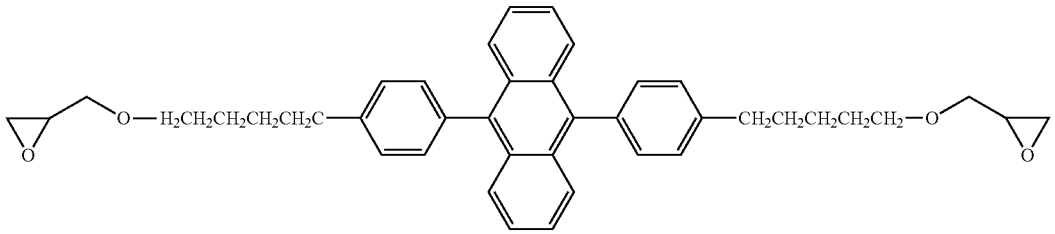
Exemplified Compound No. 91
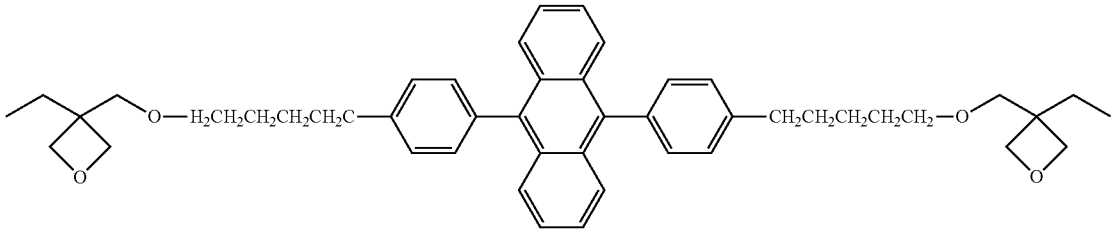
Exemplified Compound No. 92
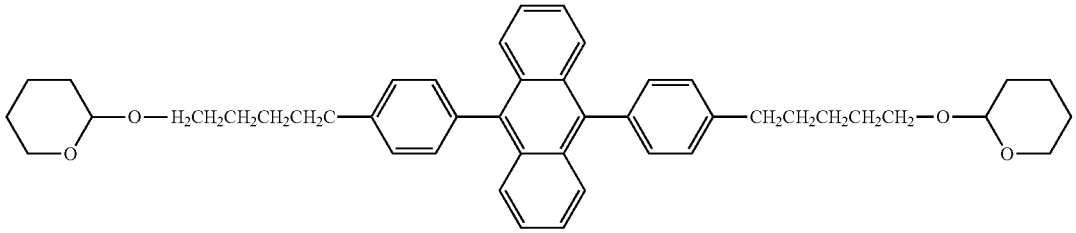
Exemplified Compound No. 93
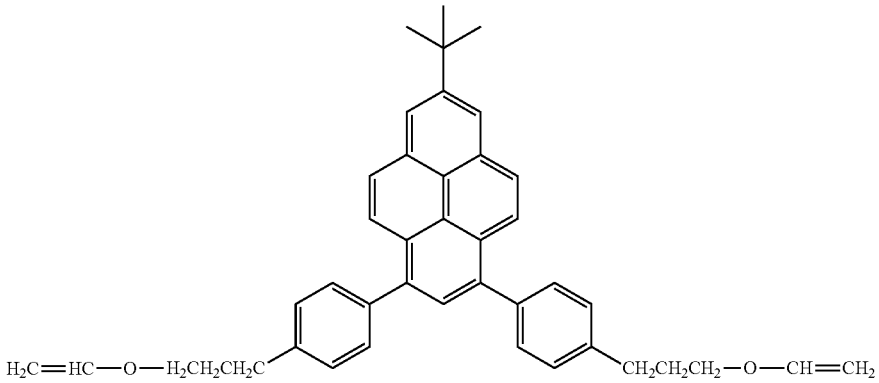

-continued
Exemplified Compound No. 94
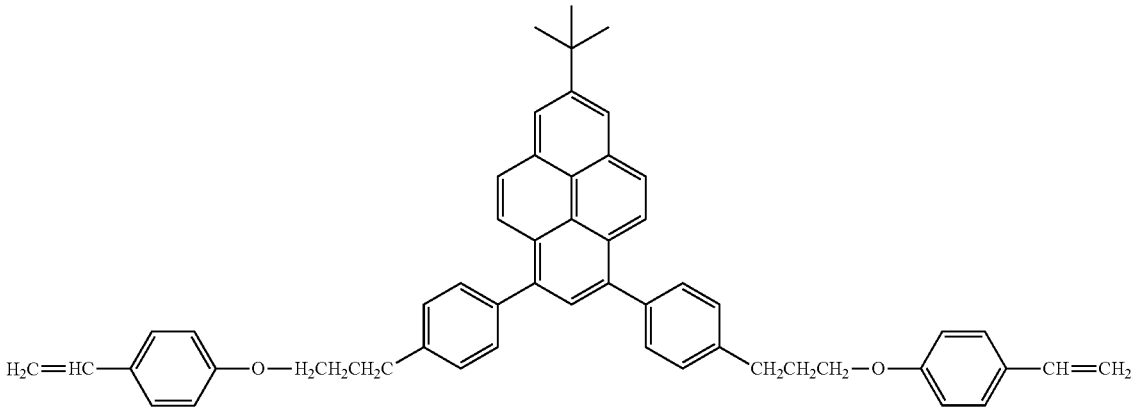
Exemplified Compound No. 95
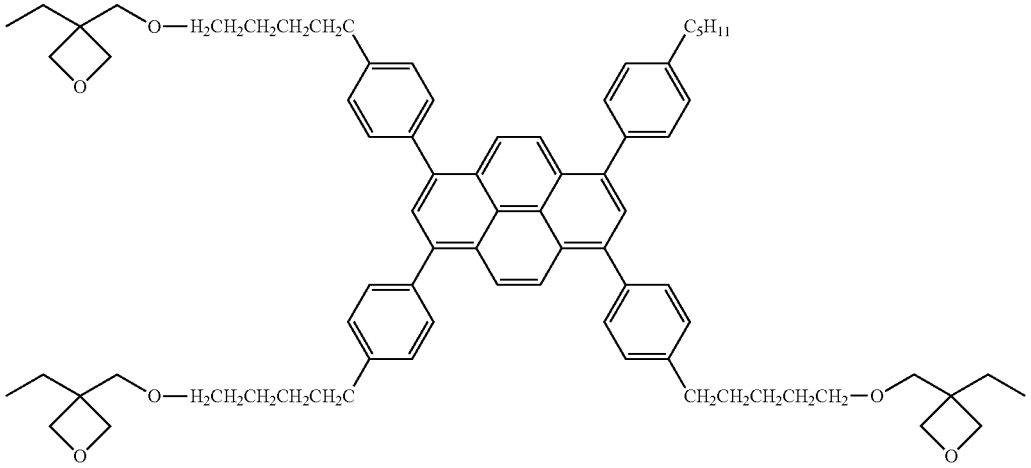
Exemplified Compound No. 96
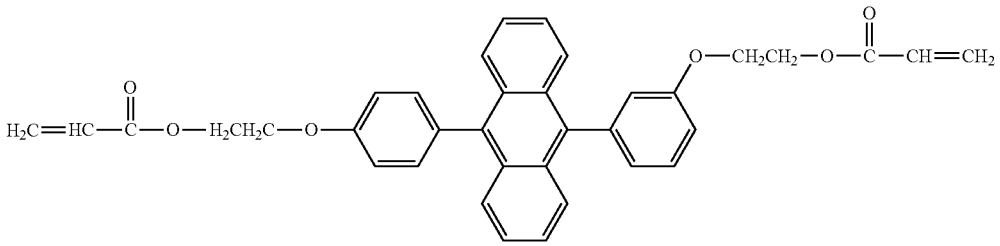
Exemplified Compound No. 97
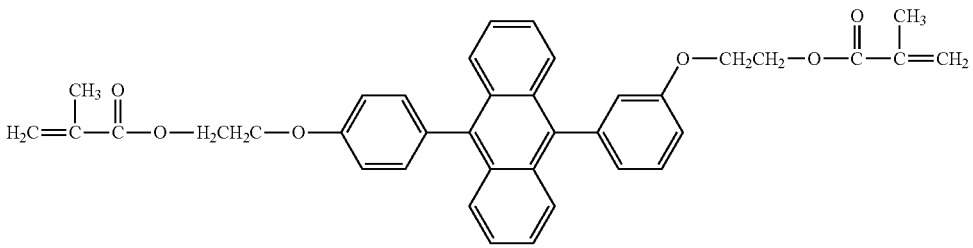

-continued
Exemplified Compound No. 98
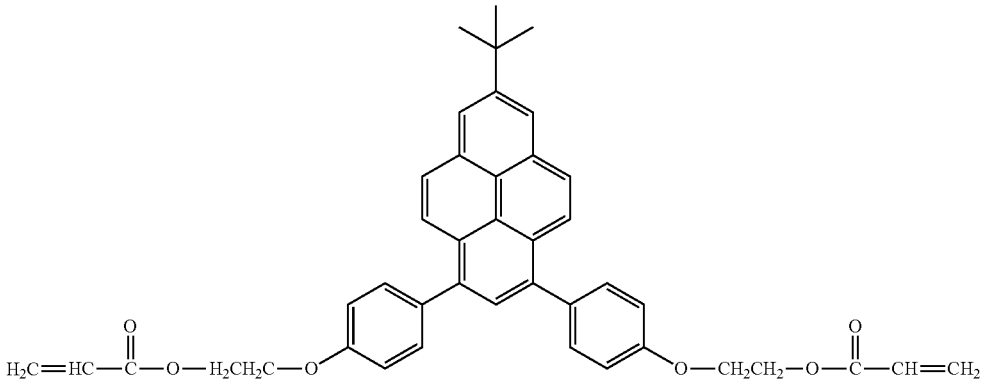
Exemplified Compound No. 99
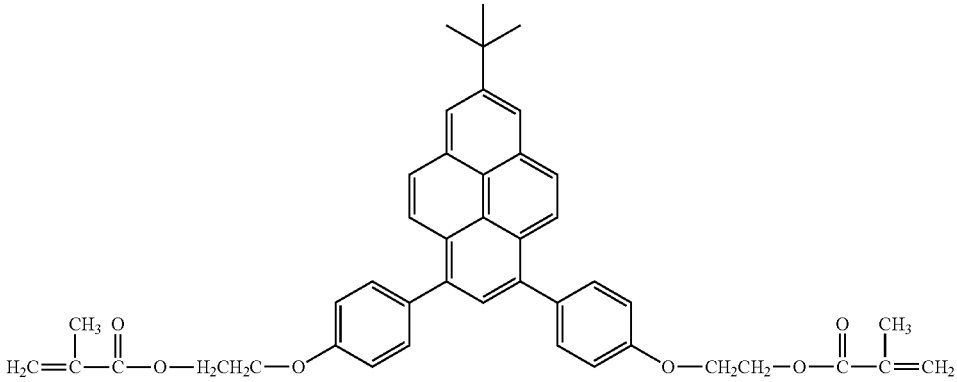
Exemplified Compound No. 100
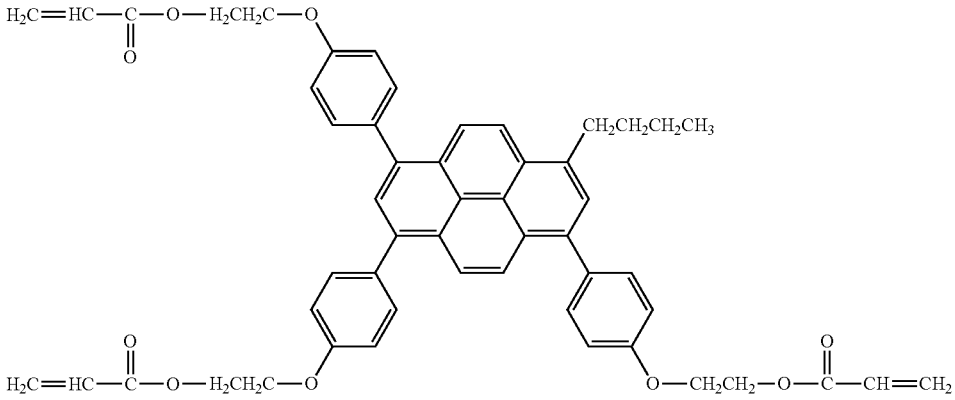
Exemplified Compound No. 101
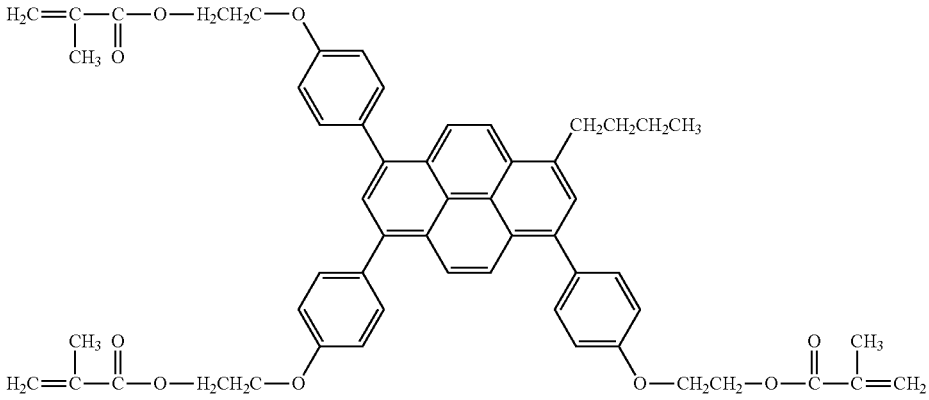

A typical synthesis example of the compound represented by the structural formula (1) is described below.

Exemplified Compound No. 41 was synthesized through a reaction represented by the following reaction formula (1).

24.4 Parts by mass of a dihydroxy compound on the left side in the following reaction formula (1), 210 parts by mass of tetrahydrofuran, and 23 parts by mass of triethylamine were loaded into a three-necked flask, and the mixture was dissolved. After that, the mixture was cooled with ice water. Next, 12.5 parts by mass of acryloyl chloride was slowly dropped to the mixture under cooling to 5° C. or less while attention was paid to a temperature increase. After the completion of the dropping, the mixture was stirred in a cooled state for 1 hour. Next, the temperature of the reaction mixture was gradually increased until an internal temperature became room temperature, and the mixture was continuously stirred overnight.

After the completion of the reaction, 250 parts by mass of a 5% aqueous solution of sodium hydroxide was added to the reaction mixture. 220 Parts by mass of ethyl acetate was loaded into the mixture, an organic layer was separated, and a product was extracted. Further, an extraction operation was performed with 220 parts by mass of ethyl acetate three times. The resultant organic layer was washed with 600 parts by mass of pure water and saline. The water washing was performed until the pH of an aqueous layer became close to 7. The resultant organic layer was dehydrated with anhydrous magnesium sulfate and magnesium sulfate was removed by filtration. After that, the organic layer was concentrated to provide a crude product.

Impurities in the resultant crude product were removed by employing silica gel column chromatography, and a fraction containing the target product was collected. The solvent was removed from the resultant mixed solution, whereby the target diacryl group-introduced hole transportable compound (Exemplified Compound No. 41) was obtained. The compound was obtained in a yield of 12.6 parts by mass and a percent yield of 42.9%.

Reaction formula (1)

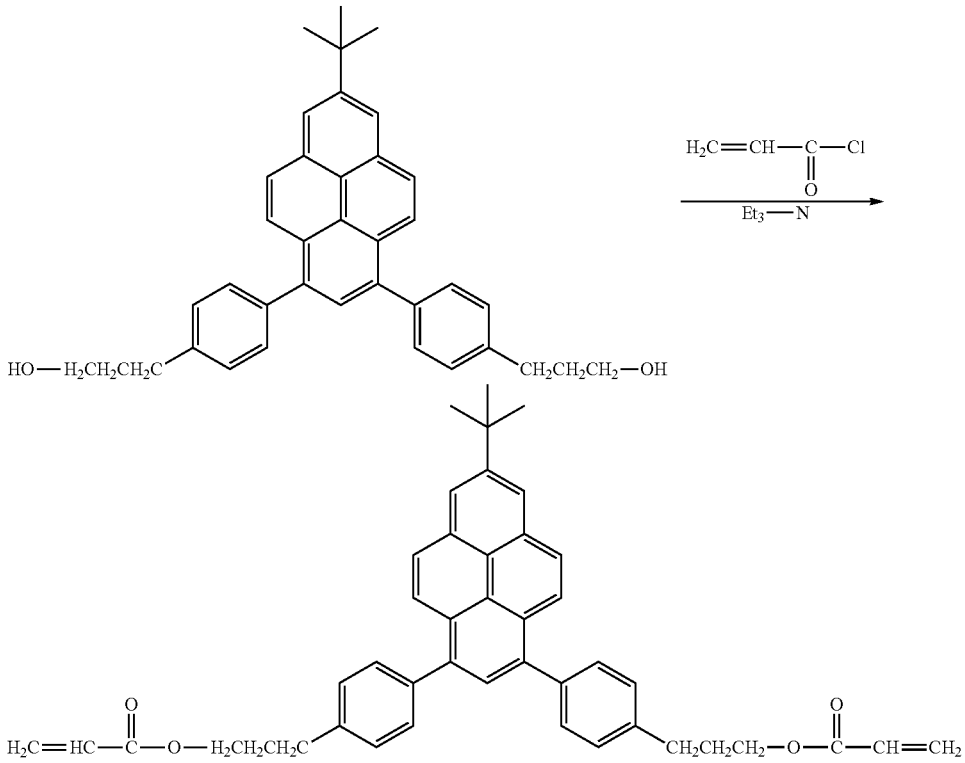

Any other compound represented by the structural formula (1) can be synthesized by causing a dihydroxy compound, a hydroxy compound, or the like corresponding to the target compound represented by the structural formula (1) and a compound capable of forming Fn to react with each other in conformity with the reaction formula (1).

A polymerized product (polymer) (copolymerized product (copolymer)) of a composition containing the compound represented by the structural formula (1), and a compound having a reactive functional group and free of any hole transporting property may be incorporated as the polymerized product of the compound represented by the structural formula (1) into the surface layer of the electrophotographic photosensitive member of the present invention. That is, the polymerized product of the compound represented by the structural formula (1) to be incorporated into the surface layer of the electrophotographic photosensitive member of the present invention may be a polymerized product of only the compound represented by the structural formula (1). In addition, the polymerized product may be a polymerized product (copolymerized product) of the compound represented by the structural formula (1), and the compound having a reactive functional group and free of any hole transporting property. The use of the composition containing the compound represented by the structural formula (1), and the compound having a reactive functional group and free of any hole transporting property can control the mechanical strength of the polymerized product obtained by polymerizing the composition. When the compound having a reactive functional group and free of any hole transporting property is used in combination, a polymerized product of a compound represented by the structural formula (1) having 1 or more (preferably 2 or more, more preferably 3 or more) Fn's, and a compound having 2 or more (preferably 3 or more) reactive functional groups and free of any hole transporting property is preferably incorporated into the surface layer.

Examples of the reactive functional group of the compound having a reactive functional group and free of any hole transporting property include the same functional groups as in the case of Fn. Of those groups, radically polymerizable functional groups, such as a styryl group, a vinyl group, an acryloyloxy group, and a methacryloyloxy group, are preferred. Of those radically polymerizable functional groups, an acryloyloxy group or a methacryloyloxy group is more preferred.

Examples of the compound having a reactive functional group and free of any hole transporting property include the following compounds. It should be noted that the term "X-functional" to be described later, which refers to the number of functional groups, means that the following monomer has X reactive functional groups. For example, the term "monofunctional" means that the following monomer has one reactive functional group.

As a monofunctional polymerizable monomer (compound having a reactive functional group and free of any hole transporting property), there are given, for example, ethyl acrylate, n-propyl acrylate, n-butyl acrylate, isobutyl acrylate, 2-ethylhexyl acrylate, 2-hydroxyethyl acrylate, tetrahydrofurfuryl acrylate, benzyl acrylate, cyclohexyl acrylate, ethoxy-diethylene glycol acrylate, isoamyl acrylate, lauryl acrylate, stearyl acrylate, phenoxyethyl acrylate, phenoxydiethylene glycol acrylate, and ethoxylated o-phenylphenol acrylate.

As a difunctional polymerizable monomer (compound having a reactive functional group and free of any hole transporting property), there are given, for example, 1,4-butanediol diacrylate, 1,5-pentanediol diacrylate, 3-methyl-1,5-pentanediol diacrylate, 1,6-hexanediol diacrylate, 1,9-nonanediol diacrylate, 1,10-decanediol diacrylate, triethylene glycol diacrylate, neopentyl glycol diacrylate, and tricyclodecanedimethanol diacrylate.

As a trifunctional polymerizable monomer (compound having a reactive functional group and free of any hole transporting property), there are given, for example, trimethylolpropane triacrylate, pentaerythritol triacrylate, and ethoxylated isocyanuric acid triacrylate.

As a tetrafunctional polymerizable monomer (compound having a reactive functional group and free of any hole transporting property), there are given, for example, pentaerythritol tetraacrylate and dimethylolpropane tetraacrylate.

As a hexafunctional polymerizable monomer (compound having a reactive functional group and free of any hole transporting property), there is given, for example, dipentaerythritol hexaacrylate.

The compounds given above as examples of the compound having a reactive functional group and free of any hole transporting property have acryloyloxy groups as reactive functional groups. In addition to those compounds, compounds obtained by substituting the acryloyloxy groups of those compounds with other reactive functional groups such as a methacryloyloxy group can also be given.

The molecular weight of the compound having a reactive functional group and free of any hole transporting property is preferably 100 or more and 1,000 or less.

A polymerized product of a composition containing the compound represented by the structural formula (1) and any other hole transportable compound having a reactive functional group may be incorporated into the surface layer of the electrophotographic photosensitive member of the present invention to the extent that the expression of the effects of the present invention is not impaired. That is, the polymerized product of the compound represented by the structural formula (1) to be incorporated into the surface layer of the electrophotographic photosensitive member of the present invention may be a polymerized product (copolymerized product) of the compound represented by the structural formula (1) and the other hole transportable compound having a reactive functional group. Of course, a polymerized product of a composition containing the compound represented by the structural formula (1), the other hole transportable compound having a reactive functional group, and the compound having a reactive functional group and free of any hole transporting property may be incorporated into the surface layer of the electrophotographic photosensitive member of the present invention.

The hole transportable compound having a reactive functional group except the compound represented by the structural formula (1) is, for example, an aromatic amine compound having a reactive functional group. When the aromatic amine compound having a reactive functional group is used in combination, the mixing ratio of the compound represented by the structural formula (1) is preferably 50 mass % or more, more preferably 70 mass % or more. The mixing ratio of the compound represented by the structural formula (1) is determined from the equation "mass of the compound represented by the structural formula (1)/(mass of the compound represented by the structural formula (1)+mass of the aromatic amine compound having a reactive functional group)×100 [mass %]."

Fine particles may be incorporated into the surface layer of the electrophotographic photosensitive member of the present invention from the viewpoint of the wear resistance of the surface of the electrophotographic photosensitive member. The fine particles may be inorganic fine particles or organic fine particles. Particles each containing, for example, the following oxide are used as the inorganic fine particles: aluminum oxide (alumina), silicon oxide (silica), zinc oxide, tin oxide, or titanium oxide.

Examples of the organic fine particles include organic resin fine particles.

As an organic resin for the organic resin fine particles, there are given, for example, a polyolefin resin, a polytetrafluoroethylene resin, a polystyrene resin, a polyacrylate resin, a polymethacrylate resin, a polyamide resin, a polyester resin, and a polyurethane resin.

The thickness of the surface layer is preferably 0.1 μm or more and 40 μm or less, more preferably 0.1 μm or more and 15 μm or less.

The surface layer of the electrophotographic photosensitive member of the present invention can be formed by: forming a coat of a surface layer coating liquid containing the compound represented by the structural formula (1) and a solvent; and curing the coat.

Examples of the solvent to be used for the surface layer coating liquid include an alcohol-based solvent, a sulfoxide-based solvent, a ketone-based solvent, an ether-based solvent, an ester-based solvent, an aliphatic halogenated hydrocarbon-based solvent, an aliphatic hydrocarbon-based solvent, and an aromatic hydrocarbon-based solvent.

As a method of curing the coat of the surface layer coating liquid, that is, subjecting the compound represented by the structural formula (1) to polymerization (curing polymerization), there is given, for example, a method of subjecting the compound to polymerization by using heat, light such as UV light, or a radiation such as an electron beam. An auxiliary agent such as a polymerization initiator, an acid, an alkali, or a compound such as a complex may be caused to coexist as required. The coat is cured by subjecting the compound represented by the structural formula (1) to polymerization (curing polymerization) with heating or irradiation with light or a radiation through a reaction of Fn (reactive functional group). Thus, the surface layer containing the polymerized product of the compound represented by the structural formula (1) is formed.

Of the heating, light, and radiations, radiations are preferred. An electron beam is more preferred among the radiations.

The compound is preferably polymerized with an electron beam because an extremely compact (high-density) three-dimensional network structure is obtained and the wear resistance of the surface of the electrophotographic photosensitive member additionally improves. In addition, productivity improves because the polymerization reaction is efficiently performed within a short time period.

An accelerator to be used when the coat is irradiated with an electron beam is, for example, a scanning-, electrocurtain-, broad beam-, pulse-, or laminar-type accelerator.

When an electron beam is used, the acceleration voltage of the electron beam is preferably 150 kV or less from the viewpoints of polymerization efficiency and the suppression of the deterioration of the characteristics of the material due to the electron beam. In addition, an electron beam absorbed dose on the surface of the coat of the surface layer coating liquid is preferably 5 kGy or more and 50 kGy or less, more preferably 1 kGy or more and 10 kGy or less.

When the compound represented by the structural formula (1) or the composition containing the compound is polymerized with an electron beam, the following is preferred from the viewpoint of the suppression of the inhibitory action of oxygen on the polymerization: after having been irradiated with the electron beam in an inert gas atmosphere, the compound is heated in the inert gas atmosphere. Examples of the inert gas include nitrogen, argon, and helium.

Now, the entire construction of an electrophotographic photosensitive member of the present invention is described.

<Electrophotographic Photosensitive Member>

A preferred construction of the electrophotographic photosensitive member is a construction in which a charge generating layer and a hole transporting layer are laminated in the stated order on a support. As required, a conductive layer or an undercoat layer may be formed between the charge generating layer and the support, and a protective layer may be formed on the hole transporting layer. In general, the charge generating layer and the hole transporting layer are collectively referred to as "photosensitive layer". In addition, the photosensitive layer may be a single-layer photosensitive layer containing a charge generating substance and a hole transporting substance.

The surface layer of the electrophotographic photosensitive member means a layer positioned on the outermost surface out of the respective layers of the electrophotographic photosensitive member.

The ionization potential of the surface layer is preferably 5.5 eV or more and 6.4 eV or less, more preferably 5.8 eV or more and 6.2 eV or less from the viewpoints of the deterioration resistance of the surface layer, and its hole injecting and transporting properties.

When the electrophotographic photosensitive member has a hole transporting layer and a protective layer on the hole transporting layer, the protective layer is the surface layer and the protective layer contains the polymerized product of the compound represented by the structural formula (1). The protective layer can be called a second hole transporting layer because the polymerized product of the compound represented by the structural formula (1) is a hole transportable compound (hole transporting substance). In the electrophotographic photosensitive member having such first hole transporting layer and second hole transporting layer (protective layer), the ionization potential of the first hole transporting layer is preferably 5.0 eV or more and 6.0 eV or less, more preferably 5.2 eV or more and 5.8 eV or less.

The ionization potential means an energy value needed for emitting an electron from a molecule or the like constituting a layer.

When the surface of a sample (the layer) is irradiated with UV light, the number of photoelectrons to be emitted varies depending on the energy of the UV light. The ionization potential of the layer can be determined by measuring the energy value.

In the present invention, the ionization potential was measured with an atmospheric photoelectron spectrometer manufactured by Riken Keiki Co., Ltd. (trade name: AC-3). Part of the surface of the sample (the layer) whose ionization potential was to be measured was peeled and collected, the peeled surface was loaded into the measuring apparatus, and its threshold energy of electron emission was measured. Thus, the ionization potential was measured.

When the electrophotographic photosensitive member has the first hole transporting layer and the second hole transporting layer (protective layer) as hole transporting layers, their respective ionization potentials can be measured. When the ionization potential of the first hole transporting layer is measured, the measurement can be performed by peeling and collecting the sample in a state before the lamination of the second hole transporting layer or the like on its surface.

<Support>

A conductive support containing a material having conductivity is preferred as the support to be used in the present invention. Examples of the material for the support include: metals and alloys such as iron, copper, gold, silver, aluminum, zinc, titanium, lead, nickel, tin, antimony, indium, chromium, an aluminum alloy, and stainless steel. In addition, there may be used a support made of a metal or support made of a resin having a coat formed by depositing aluminum, an aluminum alloy, an indium oxide-tin oxide alloy, or the like through vacuum evaporation. In addition, there may also be used a support obtained by impregnating a plastic or paper with conductive particles such as carbon black, tin oxide particles, titanium oxide particles, or silver particles, or a support containing a conductive resin. The shape of the support is, for example, a cylinder-like, belt-like, sheet-like, or plate-like shape. Of those shapes, a cylinder-like shape is preferred.

The surface of the support may be subjected to a cutting treatment, a surface roughening treatment, an alumite treatment, or the like from the viewpoints of, for example, the suppression of an interference fringe due to the scattering of laser light, the alleviation of a defect in the surface of the support, and an improvement in conductivity of the support.

A conductive layer may be formed between the support and the undercoat layer or charge generating layer to be described later for the purpose of, for example, the suppression of an interference fringe due to the scattering of laser or the like, resistance control, or the covering of a flaw of the support.

The conductive layer can be formed by: applying a conductive layer coating liquid obtained by subjecting conductive particles (such as carbon black, a conductive pigment, and a resistance regulating pigment) to a dispersion treatment together with a binder resin; and drying the resultant coat. A compound that undergoes curing polymerization through heating, UV irradiation, radiation irradiation, or the like may be added to the conductive layer coating liquid. The surface of the conductive layer obtained by dispersing the conductive particles tends to be roughened.

The thickness of the conductive layer is preferably 0.1 μm or more and 50 μm or less, more preferably 0.5 μm or more and 40 μm or less, still more preferably 1 μm or more and 30 μm or less.

Examples of the binder resin to be used for the conductive layer include: a polymer and copolymer of a vinyl compound such as styrene, vinyl acetate, vinyl chloride, an acrylic acid ester, a methacrylic acid ester, vinylidene fluoride, or trifluoroethylene; and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicone resin, an epoxy resin, and an isocyanate resin.

Examples of the conductive particles (conductive pigment and the resistance regulating pigment) include particles of a metal (alloy) such as aluminum, zinc, copper, chromium, nickel, silver, or stainless steel, and plastic particles each having the metal (alloy) deposited on its surface through evaporation. In addition, there are given particles of a metal oxide such as zinc oxide, titanium oxide, tin oxide, antimony oxide, indium oxide, bismuth oxide, and/or tin-doped indium oxide, or antimony- and/or tantalum-doped tin oxide. One kind of those particles may be used alone, or two or more kinds thereof may be used in combination.

The undercoat layer (intermediate layer) may be formed between the support or the conductive layer and the charge generating layer for the purposes of, for example, an improvement in adhesiveness of the charge generating layer, an improvement in property by which a hole is injected from the support, and the protection of the charge generating layer from an electrical breakdown.

The undercoat layer can be formed by: applying an undercoat layer coating liquid obtained by dissolving a binder resin in a solvent; and drying the resultant coat.

Examples of the binder resin to be used for the undercoat layer include a polyvinyl alcohol resin, poly-N-vinylimidazole, a polyethylene oxide resin, ethyl cellulose, an ethylene-acrylic acid copolymer, casein, a polyamide resin, an N-methoxymethylated 6-nylon resin, a copolymerized nylon resin, a phenol resin, a polyurethane resin, an epoxy resin, an acrylic resin, a melamine resin, and a polyester resin.

Metal oxide particles may be incorporated into the undercoat layer.

Examples of the metal oxide particles include particles containing titanium oxide, zinc oxide, tin oxide, zirconium oxide, or aluminum oxide. Additional examples of the metal oxide particles include metal oxide particles each having a surface treated with a surface treatment agent such as a silane coupling agent.

The thickness of the undercoat layer is preferably 0.05 μm or more and 30 μm or less, more preferably 1 μm or more and 25 μm or less.

Organic resin fine particles or a leveling agent may be incorporated into the undercoat layer.

The charge generating layer can be formed by: applying a charge generating layer coating liquid obtained by subjecting a charge generating substance to a dispersion treatment together with a binder resin and a solvent to form a coat; and drying the resultant coat. Alternatively, the charge generating layer may be a deposited film of the charge generating substance.

Examples of the charge generating substance include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyestuffs, anthanthrone pigments, pyranthrone pigments, xanthene dyes, quinone imine dyes, and styryl dyes. One kind of those charge generating substances may be used alone, or two or more kinds thereof may be used. Of those charge generating substances, from the viewpoint of sensitivity, phthalocyanine pigments or azo pigments are preferred, and phthalocyanine pigments are more preferred.

Of the phthalocyanine pigments, oxytitanium phthalocyanines, chlorogallium phthalocyanines, or hydroxygallium phthalocyanines are preferred from the viewpoint of charge generation efficiency. Further, of the hydroxygallium phthalocyanines, a hydroxygallium phthalocyanine crystal of a crystal form having peaks at Bragg angles 2θ in CuKα characteristic X-ray diffraction of 7.4°±0.3° and 28.2°±0.3° is preferred from the viewpoint of sensitivity.

Examples of the binder resin to be used for the charge generating layer include: polymers of vinyl compounds such as styrene, vinyl acetate, vinyl chloride, an acrylic acid ester, a methacrylic acid ester, vinylidene fluoride, and trifluoroethylene; and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicone resin, and an epoxy resin.

The mass ratio between the charge generating substance and the binder resin (charge generating substance/binder resin) preferably falls within the range of 1/4 or more and 1/0.3 or less.

The thickness of the charge generating layer is preferably 0.05 μm or more and 1 μm or less, more preferably 0.1 μm or more and 0.5 μm or less.

When the hole transporting layer is the surface layer, the layer contains the polymerized product of the compound represented by the structural formula (1) as described above.

When the protective layer (second hole transporting layer) is formed on the hole transporting layer, the hole transporting layer (first hole transporting layer) can be formed by: forming a coat of a hole transporting layer coating liquid obtained by mixing the hole transporting substance (hole transportable compound) and a binder resin in a solvent; and drying the coat.

Examples of the hole transporting substance include a carbazole compound, a hydrazone compound, an N,N-dialkylaniline compound, a diphenylamine compound, a triphenylamine compound, a triphenylmethane compound, a pyrazoline compound, a styryl compound, and a stilbene compound.

Examples of the binder resin to be used for the hole transporting layer include an acrylic acid ester, a methacrylic acid ester, a polyvinyl alcohol resin, a polyvinyl acetal resin, a polycarbonate resin, a polyester resin, and a curable resin such as a curable phenol resin, a curable urethane resin, a curable melamine resin, a curable epoxy resin, a curable acrylic resin, or a curable methacrylic resin.

Examples of the solvent to be used for the hole transporting layer coating liquid include an alcohol-based solvent, a sulfoxide-based solvent, a ketone-based solvent, an ether-based solvent, an ester-based solvent, an aliphatic halogenated hydrocarbon-based solvent, and an aromatic hydrocarbon-based solvent.

The thickness of the hole transporting layer is preferably 1 μm or more and 100 μm or less, more preferably 3 μm or more and 50 μm or less, still more preferably 5 μm or more and 40 μm or less.

Various additives can be added to the respective layers of the electrophotographic photosensitive member of the present invention. Examples of the additives include an organic pigment, an organic dye, a coat surface adjustor, an electron transporting substance (electron transportable compound), an oil, a wax, an antioxidant, a light absorber, a polymerization initiator, a radical deactivator, organic resin fine particles, and inorganic particles.

The surface of each layer of the electrophotographic photosensitive member may be subjected to surface processing with, for example, an abrasive sheet, a shape transfer mold member, glass beads, or zirconia beads. In addition, unevenness may be formed in the surface with a constituent material for the coating liquid.

As a method of applying the coating liquid for each of the layers, there is given, for example, a dip coating method, a spray coating method, a circular amount regulating type (ring) coating method, a spin coating method, a roller coating method, a Mayer bar coating method, or a blade coating method.

Now, an electrophotographic apparatus including a process cartridge including the electrophotographic photosensitive member of the present invention is described.

An example of the construction of the electrophotographic apparatus including the process cartridge of the present invention is illustrated in FIG. 1.

In FIG. 1, a cylindrical electrophotographic photosensitive member 1 is rotationally driven in an arrow direction in FIG. 1 at a predetermined peripheral speed. The peripheral surface (the surface) of the electrophotographic photosensitive member 1 to be rotationally driven is charged to a predetermined positive or negative potential by a charging unit 2. Next, the charged peripheral surface of the electrophotographic photosensitive member 1 receives exposure light (image exposure light) 3 output from an exposing unit (not shown) such as slit exposure or laser beam scanning exposure. Thus, electrostatic latent images corresponding to a target image are formed on the peripheral surface of the electrophotographic photosensitive member 1. Any one of a voltage obtained by superimposing an AC component on a DC component and a voltage consisting only of the DC component may be used as a voltage to be applied to the charging unit (such as a charging roller) 2.

The electrostatic latent images formed on the peripheral surface of the electrophotographic photosensitive member 1 are developed with toner (developer) of a developing unit 4 to be turned into toner images. Next, the toner images formed on the peripheral surface of the electrophotographic photosensitive member 1 are transferred onto a transfer material (such as paper or an intermediate transfer member) 6 by a transfer bias from a transferring unit (such as a transfer roller) 5. The transfer material 6 is fed in synchronization with the rotation of the electrophotographic photosensitive member 1.

The peripheral surface (the surface) of the electrophotographic photosensitive member 1 after the transfer of the toner images is subjected to an electricity eliminating treatment with pre-exposure light 7 from a pre-exposing unit (not shown), and is then cleaned through the removal of transfer residual toner by a cleaning unit 8. Thus, the electrophotographic photosensitive member 1 is repeatedly used in image formation. It should be noted that the pre-exposing unit may be operated before or after the cleaning step, and the pre-exposing unit is not necessarily needed.

A process cartridge 9 including a plurality of components selected from, for example, the electrophotographic photosensitive member 1, the charging unit 2, the developing unit 4, the transferring unit 5, and the cleaning unit 8, the plurality of components being housed in a container and integrally supported, may be detachably mountable to the main body of the electrophotographic apparatus. In FIG. 1, the process cartridge 9 includes the electrophotographic photosensitive member 1, the charging unit 2, the developing unit 4, and the cleaning unit 8 integrally supported, and is detachably mountable to the main body of the electrophotographic apparatus.

Figure 2:
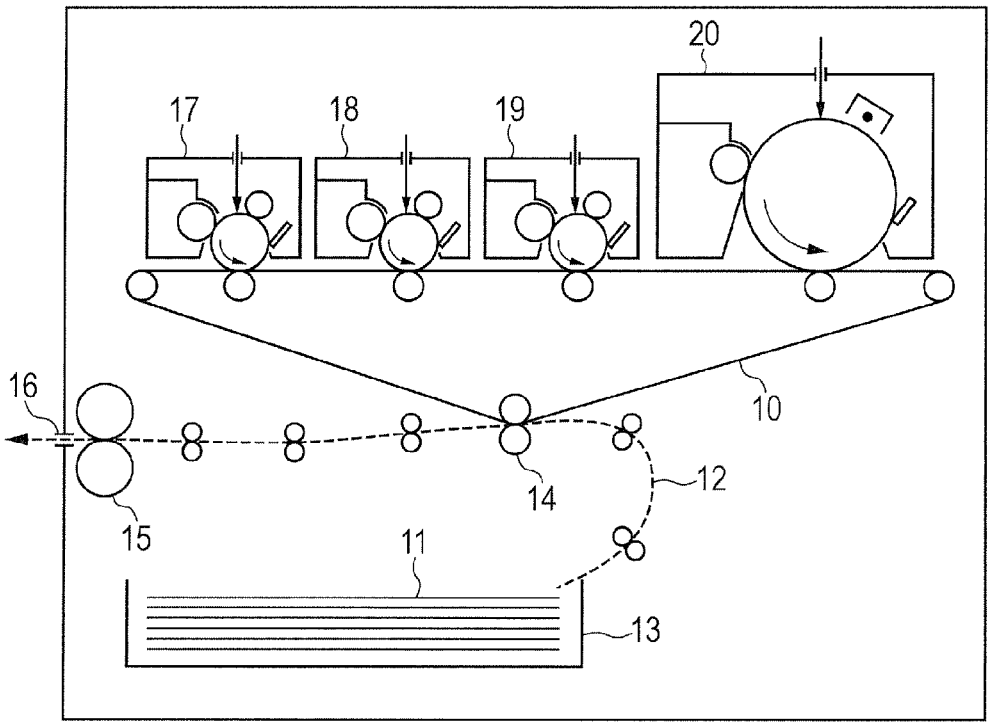
FIG. 2 is a schematic view for illustrating an example of an electrophotographic apparatus including an electrophotographic photosensitive member.

Another example of the construction of the electrophotographic apparatus including the process cartridge of the present invention is illustrated in FIG. 2.

In FIG. 2, the following process cartridges are arranged side by side along an intermediate transfer member 10: a process cartridge 17 for a yellow color, a process cartridge 18 for a magenta color, a process cartridge 19 for a cyan color, and a process cartridge 20 for a black color, which correspond to a yellow color, a magenta color, a cyan color, and a black color, respectively. As illustrated in FIG. 2, there is no need to standardize the diameter of, and a constituent material for, the electrophotographic photosensitive member, the developer, the charging unit, and the other units for the respective colors. In, for example, the electrophotographic apparatus of FIG. 2, the diameter of the electrophotographic photosensitive member for a black color is larger than those of the electrophotographic photosensitive members for a yellow color, a magenta color, and a cyan color. In addition, while a system involving applying a voltage obtained by superimposing an AC component on a DC component to a charging unit is adopted for each of the charging units for a yellow color, a magenta color, and a cyan color, a system involving employing corona discharge is adopted for the charging unit for a black color.

When an image forming operation starts, the toner images of the respective colors are sequentially transferred and superimposed on the intermediate transfer member 10 by a primary transferring unit according to the image forming process. In tandem with the foregoing, transfer paper 11 is sent from a sheet feeding tray 13 by a sheet feeding path 12, and is then fed to a secondary transferring unit 14 in timing with the rotation operation of the intermediate transfer member. The toner images on the intermediate transfer member 10 are transferred onto the transfer paper 11 by a transfer bias from the secondary transferring unit 14. The toner images transferred onto the transfer paper 11 are conveyed along the sheet feeding path 12, fixed on the transfer paper by a fixing unit 15, and discharged from a sheet discharging portion 16. In this example, the primary transferring unit, the intermediate transfer member, and the secondary transferring unit are transferring units.

Now, the present invention is described in more detail by way of Examples. It should be noted that the term "part(s)" in Examples refers to "part(s) by mass". In addition, an electrophotographic photosensitive member is hereinafter sometimes simply referred to as "photosensitive member".

Production of Electrophotographic Photosensitive Member

Example 1

A cylindrical aluminum cylinder having an outer diameter of 30.0 mm, a length of 357.5 mm, and a wall thickness of 0.7 mm was used as a support (conductive support).

Next, 10 parts of zinc oxide particles (specific surface area: 19 $m^2/g$, powder resistivity: $4.7\times10^6$ Ω·cm) were mixed with 50 parts of toluene by stirring, and 0.08 part of a silane coupling agent was added to the mixture, followed by stirring for 6 hours. After that, toluene was removed by distillation under reduced pressure and the residue was dried by heating at 130° C. for 6 hours to provide surface-treated zinc oxide particles. KBM602 (compound name: N-2-(aminoethyl)-3-aminopropylmethyldimethoxysilane) manufactured by Shin-Etsu Chemical Co., Ltd. was used as the silane coupling agent.

Next, 15 parts of a polyvinyl butyral resin (weight-average molecular weight: 40,000, trade name: BM-1, manufactured by Sekisui Chemical Co., Ltd.) and 15 parts of a blocked isocyanate (trade name: Sumidur 3175, manufactured by Sumika Bayer Urethane Co., Ltd.) were dissolved in a mixed solvent containing 73.5 parts of methyl ethyl ketone and 73.5 parts of 1-butanol to prepare a solution. 80.8 Parts of the surface-treated zinc oxide particles and 0.8 part of 2,3,4-trihydroxybenzophenone (manufactured by Tokyo Chemical Industry Co., Ltd.) were added to the solution. The mixture was loaded into a sand mill apparatus using glass beads each having a diameter of 0.8 mm, followed by a dispersion treatment under an atmosphere having a temperature of 23±3° C. for 3 hours. After the dispersion treatment, 0.01 part of silicone oil (trade name: SH28PA, manufactured by Dow Corning Toray Co., Ltd.) and 5.6 parts of cross-linked polymethyl methacrylate (PMMA) particles (trade name: TECHPOLYMER SSX-102, manufactured by Sekisui Plastics Co., Ltd., average primary particle diameter: 2.5 μm) were added to the resultant, and the mixture was stirred to prepare an undercoat layer coating liquid.

The undercoat layer coating liquid was applied onto the support by immersion to form a coat, and the resultant coat was dried for 40 minutes at 160° C. to form an undercoat layer having a thickness of 18 μm.

Next, a hydroxygallium phthalocyanine crystal (charge generating substance) of a crystal form having peaks at Bragg angles 2θ±0.2° in CuKα characteristic X-ray diffraction of 7.4° and 28.2° was prepared. 2 Parts of the hydroxygallium phthalocyanine crystal, 0.02 part of a calixarene compound represented by the following structural formula (A), 1 part of polyvinyl butyral (trade name: S-LEC BX-1, manufactured by Sekisui Chemical Co., Ltd.), and 60 parts of cyclohexanone were loaded into a sand mill using glass beads each having a diameter of 1 mm, followed by a dispersion treatment for 4 hours. After the dispersion treatment, 70 parts of ethyl acetate were added to the resultant to prepare a charge generating layer coating liquid.

(A)

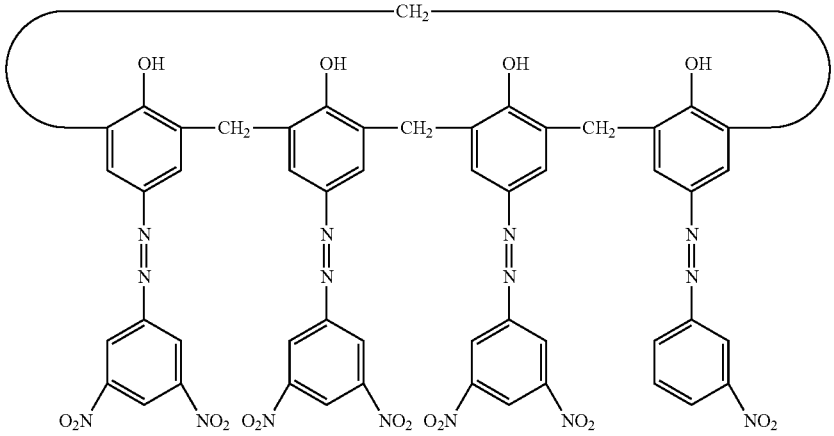

The charge generating layer coating liquid was applied onto the undercoat layer by immersion, and the resultant coat was dried for 15 minutes at 90° C. to form a charge generating layer having a thickness of 0.19 μm.

Next, 6 parts of a compound represented by the following structural formula (B), 3 parts of a compound represented by the following structural formula (C), 1 part of a compound represented by the following structural formula (D), and 10 parts of a bisphenol Z-type polycarbonate resin (trade name: Iupilon Z400, manufactured by Mitsubishi Engineering-Plastics Corporation) were dissolved in a mixed solvent containing 60 parts of monochlorobenzene and 20 parts of dimethoxymethane to prepare a hole transporting layer coating liquid.

(B)

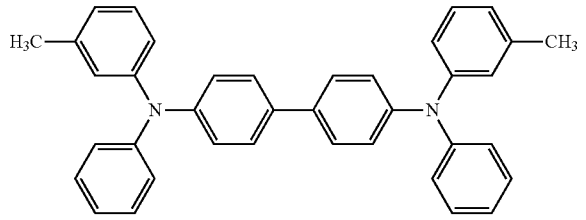

-continued (C)

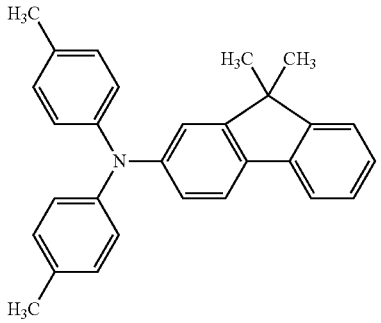

(D)

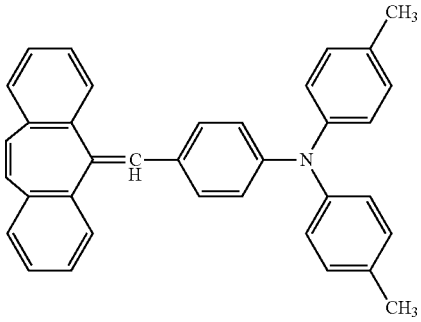

The hole transporting layer coating liquid was applied onto the charge generating layer by immersion, and the resultant coat was dried for 50 minutes at 100° C. to form a hole transporting layer (first hole transporting layer) having a thickness of 16 μm.

The ionization potential of the hole transporting layer (first hole transporting layer) was measured with an atmospheric photoelectron spectrometer (trade name: AC-3, manufactured by Riken Keiki Co., Ltd.). The measurement was performed in a measurement light quantity of 2 nW and in the range of from 4.2 eV or more to 7.0 eV or less. The ionization potential was 5.5 eV.

Next, 3 parts of Exemplified Compound No. 41 was dissolved in a mixed solvent containing 5 parts of 1-methoxy-2-propanol and 2 parts of ethylene glycol dimethyl ether to prepare a protective layer coating liquid.

The protective layer coating liquid was applied onto the hole transporting layer (first hole transporting layer) by immersion, and the resultant coat was dried for 10 minutes at 50° C., followed by a polymerization curing treatment through electron beam irradiation and heating under the following conditions.

In an atmosphere having an oxygen concentration of 100 ppm or less, the coat was subjected to electron beam irradiation with an electron beam irradiation apparatus under the conditions of an irradiation distance of 30 mm, an acceleration voltage of 70 kV, a beam current of 10 mA, and an irradiation time of 6.4 seconds while the aluminum cylinder having formed thereon the coat was rotated at a speed of 300 rpm. After the electron beam irradiation, the temperature of the surface of the coat was caused to reach 130° C. over 20 seconds with an induction heating apparatus. Next, the aluminum cylinder having formed thereon the coat was taken out to the air atmosphere and further heated for 10 minutes at 100° C. to form a protective layer (second hole transporting layer) having a thickness of 2.5 μm.

Thus, Example Photosensitive Member 1 was produced.

Part of the protective layer was peeled and loaded into the measuring apparatus, and its ionization potential was measured by the same method as that for the hole transporting layer (first hole transporting layer). The ionization potential was 5.9 eV.

Example 2

An electrophotographic photosensitive member (Example Photosensitive Member 2) was produced in the same manner as in Example 1 except that in Example 1, a protective layer was formed as described below.

A protective layer coating liquid was prepared by dissolving 4 parts of Exemplified Compound No. 24 in 100 parts of ethylene glycol dimethyl ether.

The protective layer coating liquid was applied onto the hole transporting layer with a spray. The resultant coat was dried for 10 minutes at 50° C., and was subjected to a polymerization curing treatment based on electron beam irradiation and heating under the same conditions as those of Example 1. Next, the aluminum cylinder having formed thereon the coat was taken out to the air atmosphere, and was further heated for 10 minutes at 100° C. Thus, a protective layer having a thickness of 2.5 μm was formed.

Thus, Example Photosensitive Member 2 was produced.

The ionization potential of the protective layer was measured by the same method as that of Example 1. The ionization potential of the protective layer of Example Photosensitive Member 2 was 6.0 eV.

Example 3

An electrophotographic photosensitive member (Example Photosensitive Member 3) was produced in the same manner as in Example 1 except that in Example 1, a protective layer was formed as described below.

A protective layer coating liquid was prepared by dissolving 3 parts of Exemplified Compound No. 26 and 1 part of 1,10-bis(acryloyloxy)decane in 100 parts of ethylene glycol dimethyl ether.

The protective layer coating liquid was applied onto the hole transporting layer with a spray in the same manner as in Example 2, and the resultant coat was dried and cured to form a protective layer.

Thus, Example Photosensitive Member 3 was produced.

The ionization potential of the protective layer was measured by the same method as that of Example 1. The ionization potential of the protective layer of Example Photosensitive Member 3 was 5.8 eV.

Example 4

An electrophotographic photosensitive member (Example Photosensitive Member 4) was produced in the same manner as in Example 1 except that in Example 1, a protective layer was formed as described below.

A protective layer coating liquid was prepared by dissolving 4 parts of a mixture of Exemplified Compound No. 34 and Exemplified Compound No. 35 (mixing ratio (mass ratio):1:1) in 100 parts of ethylene glycol dimethyl ether.

The protective layer coating liquid was applied onto the hole transporting layer with a spray in the same manner as in Example 2, and the resultant coat was dried and cured to form a protective layer.

Thus, Example Photosensitive Member 4 was produced.

The ionization potential of the protective layer was measured by the same method as that of Example 1. The ionization potential of the protective layer of Example Photosensitive Member 4 was 5.8 eV.

Example 5

An electrophotographic photosensitive member (Example Photosensitive Member 5) was produced in the same manner as in Example 1 except that in Example 1, a protective layer was formed as described below.

A protective layer coating liquid was prepared by dissolving 4 parts of Exemplified Compound No. 43 in a mixed solvent containing 5 parts of 1-methoxy-2-propanol and 2 parts of ethylene glycol dimethyl ether.

The protective layer coating liquid was applied onto the hole transporting layer by immersion in the same manner as in Example 1, and the resultant coat was dried and cured in the same manner as in Example 1 to form a protective layer.

Thus, Example Photosensitive Member 5 was produced.

The ionization potential of the protective layer was measured by the same method as that of Example 1. The ionization potential of the protective layer of Example Photosensitive Member 5 was 5.9 eV.

Example 6

An electrophotographic photosensitive member (Example Photosensitive Member 6) was produced in the same manner as in Example 1 except that in Example 1, a protective layer was formed as described below.

A protective layer coating liquid was prepared by dissolving 3 parts of Exemplified Compound No. 44 and 1 part of 1,6-bis(acryloyloxy)hexane in a mixed solvent containing 5 parts of 1-methoxy-2-propanol and 2 parts of ethylene glycol dimethyl ether.

The protective layer coating liquid was applied onto the hole transporting layer by immersion in the same manner as in Example 1, and the resultant coat was dried and cured in the same manner as in Example 1 to form a protective layer.

Thus, Example Photosensitive Member 6 was produced.

The ionization potential of the protective layer was measured by the same method as that of Example 1. The ionization potential of the protective layer of Example Photosensitive Member 6 was 5.8 eV.

Example 7

An electrophotographic photosensitive member (Example Photosensitive Member 7) was produced in the same manner as in Example 1 except that in Example 1, a protective layer was formed as described below.

A protective layer coating liquid was prepared by dissolving 3 parts of Exemplified Compound No. 48 and 1 part of trimethylolpropane trimethacrylate in 100 parts of ethylene glycol dimethyl ether.

The protective layer coating liquid was applied onto the hole transporting layer with a spray in the same manner as in Example 2, and the resultant coat was dried and cured in the same manner as in Example 1 to form a protective layer.

Thus, Example Photosensitive Member 7 was produced.

The ionization potential of the protective layer was measured by the same method as that of Example 1. The ionization potential of the protective layer of Example Photosensitive Member 7 was 5.8 eV.

Example 8

The same aluminum cylinder as that used in Example 1 was used as a support.

Next, 60 parts of titanium oxide ($TiO_2$, the same applies hereinafter) particles covered with oxygen-deficient tin oxide ($SnO_2$, the same applies hereinafter) (powder resistivity: 100 Ω·cm, coverage with tin oxide (mass ratio): 35%), 36.5 parts of a phenol resin (trade name: PLYOPHEN J-325, manufactured by DIC Corporation, resin solid content: 60%), and 20 parts of methoxypropanol were loaded into a horizontal sand mill disperser using glass beads each having a diameter of 1 mm, followed by a dispersion treatment to prepare a dispersion.

The glass beads were removed from the dispersion with a mesh. After that, 1.6 parts of silicone resin particles (average particle diameter: 2 μm, trade name: TOSPEARL 120, manufactured by GE Toshiba Silicones Co., Ltd.) and 0.008 part of silicone oil (SH28PA) were added to the dispersion, and the mixture was stirred to prepare a conductive layer coating liquid.

The average particle diameter of the titanium oxide particles covered with oxygen-deficient tin oxide in the conductive layer coating liquid was 0.35 μm.

The conductive layer coating liquid was applied onto the support by immersion, and the resultant coat was dried and cured for 30 minutes at 140° C. to form a conductive layer having a thickness of 18 μm.

Next, 10 parts of a methoxymethylated 6-nylon resin (trade name: TORESIN EF-30T, manufactured by Teikoku Chemical Industry Co., Ltd.) was dissolved in a mixed solvent containing 100 parts of methanol and 50 parts of n-butanol to prepare an undercoat layer coating liquid. The undercoat layer coating liquid was applied onto the conductive layer by immersion, and the resultant coat was dried for 30 minutes at 100° C. to form an undercoat layer having a thickness of 0.45 μm. Next, a charge generating layer and a hole transporting layer (first hole transporting layer) were formed in the stated order in the same manner as in Example 1.

Next, a protective layer was formed as described below.

A protective layer coating liquid was prepared by dissolving 4 parts of Exemplified Compound No. 49 in 100 parts of ethylene glycol dimethyl ether.

The protective layer coating liquid was applied onto the hole transporting layer (first hole transporting layer) with a spray, and the resultant coat was dried and cured in the same manner as in Example 1 to form a protective layer.

Thus, Example Photosensitive Member 8 was produced.

The ionization potential of the protective layer was measured by the same method as that of Example 1. The ionization potential of the protective layer of Example Photosensitive Member 8 was 5.7 eV.

Example 9

An electrophotographic photosensitive member (Example Photosensitive Member 9) was produced in the same manner as in Example 1 except that in Example 1, a protective layer was formed as described below.

12 Parts of Exemplified Compound No. 51, 8 parts of trimethylolpropane triacrylate, 2 parts of 1-hydroxycyclohexyl phenyl ketone (photopolymerization initiator), 2 parts of 2,2-bis(4,4-di-t-butylperoxycyclohexyl)propane, and 580 parts of tetrahydrofuran were mixed to prepare a protective layer coating liquid.

The protective layer coating liquid was applied onto the hole transporting layer (first hole transporting layer) with a spray, and the resultant coat was dried for 10 minutes at 45° C., and was subjected to a photocuring treatment under the following conditions.

Under an atmosphere having an oxygen concentration of from 6,000 ppm to 8,000 ppm, the coat was subjected to photoirradiation with a metal halide lamp having an output of 160 W/cm under the conditions of an irradiation distance of 100 mm, an irradiation intensity of 600 mW/cm$^2$, and an irradiation time of 2 minutes while the aluminum cylinder having applied thereto the coat was rotated at a speed of 100 rpm. After the photoirradiation, the resultant was heated for 30 minutes at 135° C. to form a protective layer having a thickness of 2.5 μm.

Thus, Example Photosensitive Member 9 was produced.

The ionization potential of the protective layer was measured by the same method as that of Example 1. The ionization potential of the protective layer of Example Photosensitive Member 9 was 6.0 eV.

Example 10

An electrophotographic photosensitive member (Example Photosensitive Member 10) was produced in the same manner as in Example 1 except that in Example 1, a protective layer was formed as described below.

12 Parts of Exemplified Compound No. 59, 8 parts of 1,6-bis(methacryloyloxy)hexane, 2 parts of 1-hydroxycyclohexyl phenyl ketone as a photopolymerization initiator, 2 parts of 2,2-bis(4,4-di-t-butylperoxycyclohexyl)propane, and 580 parts of tetrahydrofuran were mixed to prepare a protective layer coating liquid.

The protective layer coating liquid was applied onto the hole transporting layer with a spray, and the resultant coat was subjected to a photocuring treatment in the same manner as in Example 9.

Thus, Example Photosensitive Member 10 was produced.

The ionization potential of the protective layer was measured by the same method as that of Example 1. The ionization potential of the protective layer of Example Photosensitive Member 10 was 5.8 eV.

Example 11

An electrophotographic photosensitive member (Example Photosensitive Member 11) was produced in the same manner as in Example 1 except that in Example 1, a protective layer was formed as described below.

A protective layer coating liquid was prepared by dissolving 5 parts of Exemplified Compound No. 68 shown above and 5 parts of a compound represented by the following structural formula (E) in a mixed solvent containing 16 parts of 1-methoxy-2-propanol and 7 parts of ethylene glycol dimethyl ether.

(E)

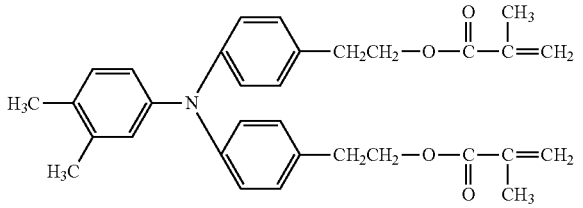

The protective layer coating liquid was applied onto the first hole transporting layer by immersion, and the resultant coat was dried and cured in the same manner as in Example 1 to form a protective layer.

Thus, Example Photosensitive Member 11 was produced.

The ionization potential of the protective layer was measured by the same method as that of Example 1. The ionization potential of the protective layer of Example Photosensitive Member 11 was 5.6 eV.

Example 12

An electrophotographic photosensitive member (Example Photosensitive Member 12) was produced in the same manner as in Example 1 except that in Example 1, a protective layer was formed as described below.

A protective layer coating liquid was prepared by dissolving 7 parts of Exemplified Compound No. 68 shown above and 3 parts of the compound represented by the structural formula (E) in a mixed solvent containing 16 parts of 1-methoxy-2-propanol and 7 parts ethylene glycol dimethyl ether.

The protective layer coating liquid was applied onto the first hole transporting layer by immersion, and the resultant coat was dried and cured in the same manner as in Example 1 to form a protective layer.

Thus, Example Photosensitive Member 12 was produced.

The ionization potential of the protective layer was measured by the same method as that of Example 1. The ionization potential of the protective layer of Example Photosensitive Member 12 was 5.6 eV.

Example 13

An electrophotographic photosensitive member (Example Photosensitive Member 13) was produced in the same manner as in Example 1 except that a protective layer was formed as described below.

10 Parts of Exemplified Compound No. 82, 10 parts of 1,6-bis(acryloyloxy)hexane, and 570 parts of tetrahydrofuran were mixed to prepare a protective layer coating liquid.

The protective layer coating liquid was applied onto the hole transporting layer with a spray, and the resultant coat was dried and cured in the same manner as in Example 2 to form a protective layer.

Thus, Example Photosensitive Member 13 was produced.

The ionization potential of the protective layer was measured by the same method as that of Example 1. The ionization potential of the protective layer of Example Photosensitive Member 13 was 6.0 eV.

Example 14

An electrophotographic photosensitive member (Example Photosensitive Member 14) was produced in the same manner as in Example 1 except that in Example 1, a protective layer was formed as described below.

A protective layer coating liquid was prepared by dissolving 4 parts of Exemplified Compound No. 89 in 100 parts of tetrahydrofuran.

The protective layer coating liquid was applied onto the hole transporting layer with a spray, and the resultant coat was dried and thermally cured for 60 minutes at 150° C. to form a protective layer having a thickness of 2.5 μm.

Thus, Example Photosensitive Member 14 was produced.

The ionization potential of the protective layer was measured by the same method as that of Example 1. The ionization potential of the protective layer of Example Photosensitive Member 14 was 5.9 eV.

Example 15

An electrophotographic photosensitive member (Example Photosensitive Member 15) was produced in the same manner as in Example 1 except that in Example 1, a protective layer was formed as described below.

A protective layer coating liquid was prepared by dissolving 4 parts of Exemplified Compound No. 90 and 0.01 part of p-toluenesulfonic acid in 100 parts of tetrahydrofuran.

The protective layer coating liquid was applied onto the hole transporting layer with a spray, and the resultant coat was dried and thermally cured for 60 minutes at 150° C. to form a protective layer having a thickness of 2.5 μm.

Thus, Example Photosensitive Member 15 was produced.

The ionization potential of the protective layer was measured by the same method as that of Example 1. The ionization potential of the protective layer of Example Photosensitive Member 15 was 6.0 eV.

Example 16

An electrophotographic photosensitive member (Example Photosensitive Member 16) was produced in the same manner as in Example 1 except that in Example 1, a protective layer was formed as described below.

A protective layer coating liquid was prepared by mixing 20 parts of Exemplified Compound No. 98 and 570 parts of tetrahydrofuran.

The protective layer coating liquid was applied onto the hole transporting layer with a spray, and the resultant coat was dried and cured in the same manner as in Example 2 to form a protective layer.

Thus, Example Photosensitive Member 16 was produced.

The ionization potential of the protective layer was measured by the same method as that of Example 1. The ionization potential of the protective layer of Example Photosensitive Member 16 was 5.8 eV.

Example 17

An electrophotographic photosensitive member (Example Photosensitive Member 17) was produced in the same manner as in Example 1 except that in Example 1, a protective layer was formed as described below.

A protective layer coating liquid was prepared by mixing 20 parts of Exemplified Compound No. 101 and 570 parts of tetrahydrofuran.

The protective layer coating liquid was applied onto the hole transporting layer with a spray, and the resultant coat was dried and cured in the same manner as in Example 2 to form a protective layer.

Thus, Example Photosensitive Member 17 was produced.

The ionization potential of the protective layer was measured by the same method as that of Example 1. The ionization potential of the protective layer of Example Photosensitive Member 17 was 5.7 eV.

Example 18

An undercoat layer and a charge generating layer were formed on a support in the same manner as in Example 1.

Next, a hole transporting layer coating liquid was prepared by dissolving 10 parts of the compound represented by the formula (D) and 10 parts of a bisphenol Z-type polycarbonate resin (trade name: Iupilon Z400, manufactured by Mitsubishi Engineering-Plastics Corporation) in a mixed solvent containing 60 parts of monochlorobenzene and 20 parts of dimethoxymethane.

The hole transporting layer coating liquid was applied onto the charge generating layer by immersion, and the resultant coat was dried for 50 minutes at 100° C. to form a hole transporting layer (first hole transporting layer) having a thickness of 16 μm. The ionization potential of the hole transporting layer was 5.6 eV.

Next, a protective layer was formed by using Exemplified Compound No. 41 in the same manner as in Example 1.

Thus, Example Photosensitive Member 18 was produced.

The ionization potential of the protective layer was measured by the same method as that of Example 1. The ionization potential of the protective layer of Example Photosensitive Member 18 was 5.9 eV.

Example 19

An undercoat layer, a charge generating layer, and a hole transporting layer (first hole transporting layer) were formed on a support in the same manner as in Example 18.

Next, 20 parts of Exemplified Compound No. 96 and 570 parts of tetrahydrofuran were mixed to prepare a protective layer coating liquid.

The protective layer coating liquid was applied onto the hole transporting layer with a spray, and the resultant coat was dried and cured in the same manner as in Example 2 to form a protective layer.

Thus, Example Photosensitive Member 19 was produced.

The ionization potential of the protective layer was measured by the same method as that of Example 1. The ionization potential of the protective layer of Example Photosensitive Member 19 was 5.8 eV.

Example 20

An undercoat layer and a charge generating layer were formed on a support in the same manner as in Example 1.

Next, a hole transporting layer coating liquid was prepared by dissolving 10 parts of a compound represented by the following formula (F) and 10 parts of a bisphenol Z-type polycarbonate resin (trade name: Iupilon Z400, manufactured by Mitsubishi Engineering-Plastics Corporation) in a mixed solvent containing 60 parts of monochlorobenzene and 20 parts of dimethoxymethane.

(F)

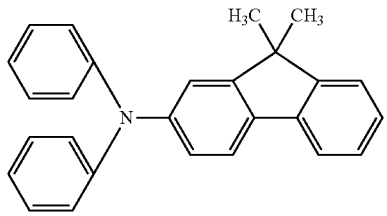

The hole transporting layer coating liquid was applied onto the charge generating layer by immersion, and the resultant coat was dried for 50 minutes at 100° C. to form a hole transporting layer (first hole transporting layer) having a thickness of 16 μm. The ionization potential of the first hole transporting layer was 5.7 eV.

Next, a protective layer was formed by using Exemplified Compound No. 41 in the same manner as in Example 1.

Thus, Example Photosensitive Member 20 was produced.

The ionization potential of the protective layer was measured by the same method as that of Example 1. The ionization potential of the protective layer of Example Photosensitive Member 20 was the same as that of the protective layer of Example Photosensitive Member 1.

Example 21

An undercoat layer, a charge generating layer, and a hole transporting layer (first hole transporting layer) were formed on a support in the same manner as in Example 20.

Next, a protective layer was formed by using Exemplified Compound No. 96 in the same manner as Example 19.

Thus, Example Photosensitive Member 21 was produced.

The ionization potential of the protective layer was measured by the same method as that of Example 1. The ionization potential of the protective layer of Example Photosensitive Member 21 was 5.8 eV.

Example 22

An undercoat layer and a charge generating layer were formed on a support in the same manner as in Example 1.

Next, a hole transporting layer coating liquid was prepared by dissolving 8 parts of a compound represented by the following formula (G) and 10 parts of a bisphenol Z-type polycarbonate resin (trade name: Iupilon Z400, manufactured by Mitsubishi Engineering-Plastics Corporation) in a mixed solvent containing 60 parts of monochlorobenzene and 20 parts of dimethoxymethane.

(G)

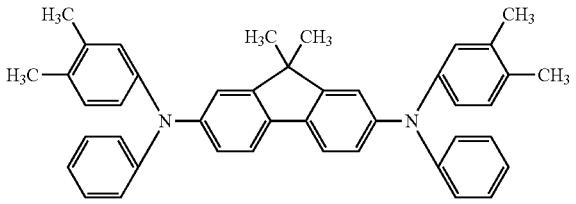

The hole transporting layer coating liquid was applied onto the charge generating layer by immersion, and the resultant coat was dried for 50 minutes at 100° C. to form a hole transporting layer (first hole transporting layer) having a thickness of 16 μm. The ionization potential of the first hole transporting layer was 5.3 eV.

Next, a protective layer was formed by using Exemplified Compound No. 41 in the same manner as in Example 1.

Thus, Example Photosensitive Member 22 was produced.

The ionization potential of the protective layer was measured by the same method as that of Example 1. The ionization potential of the protective layer of Example Photosensitive Member 22 was the same as that of the protective layer of Example Photosensitive Member 1.

Comparative Example 1

An electrophotographic photosensitive member (Comparative Example Photosensitive Member 1) was produced in the same manner as in Example 1 except that in Example 1, a protective layer was formed as described below.

10 Parts of Comparative Compound No. 1 shown below, 10 parts of trimethylolpropane triacrylate, 2 parts of 1-hydroxycyclohexyl phenyl ketone (polymerization initiator), 2 parts of 2,2-bis(4,4-di-t-butylperoxycyclohexyl)propane, and 580 parts of tetrahydrofuran were mixed to prepare a protective layer coating liquid.

Comparative Compound No. 1

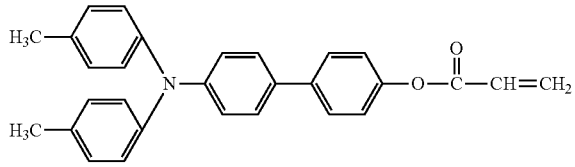

A protective layer was formed by using the protective layer coating liquid in the same manner as in Example 9.

Thus, Comparative Example Photosensitive Member 1 was produced.

The ionization potential of the protective layer was measured by the same method as that of Example 1. The ionization potential of the protective layer of Comparative Example Photosensitive Member 1 was 5.6 eV.

Comparative Example 2

An electrophotographic photosensitive member (Comparative Example Photosensitive Member 2) was produced in the same manner as in Example 1 except that in Example 1, a protective layer was formed as described below.

10 Parts of Comparative Compound No. 2 shown below, 10 parts of 1,6-bis(acryloyloxy)hexane, and 570 parts of tetrahydrofuran were mixed to prepare a protective layer coating liquid.

Comparative Compound No. 2

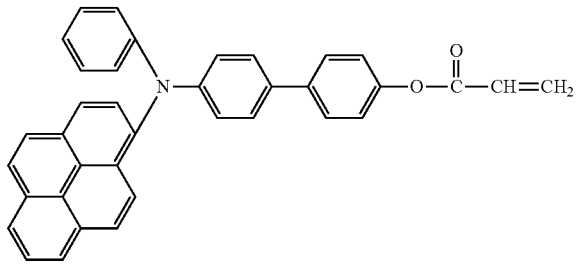

The protective layer coating liquid was applied onto the hole transporting layer with a spray, and the resultant coat was dried and cured in the same manner as in Example 9 to form a protective layer.

Thus, Comparative Example Photosensitive Member 2 was produced.

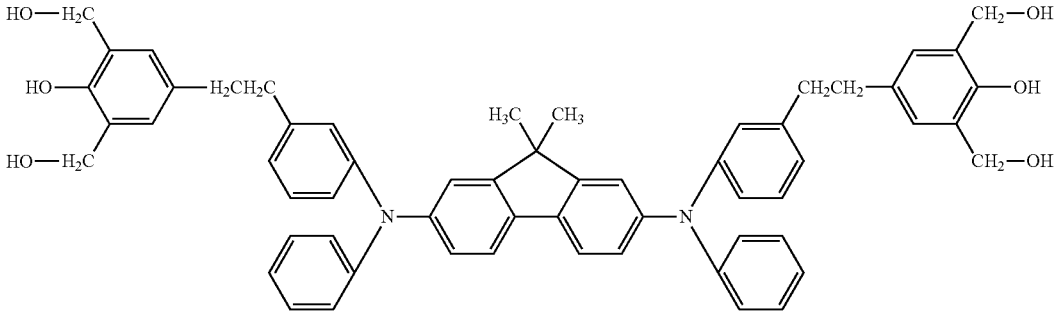

The ionization potential of the protective layer was measured by the same method as that of Example 1. The ionization potential of the protective layer of Comparative Example Photosensitive Member 2 was 5.6 eV.

Comparative Example 3

An electrophotographic photosensitive member (Comparative Example Photosensitive Member 3) was produced in the same manner as in Example 1 except that in Example 1, a protective layer was formed as described below.

A protective layer coating liquid was prepared by dissolving 4 parts of Comparative Compound No. 3 shown below in 100 parts of tetrahydrofuran.

Comparative Compound No. 3

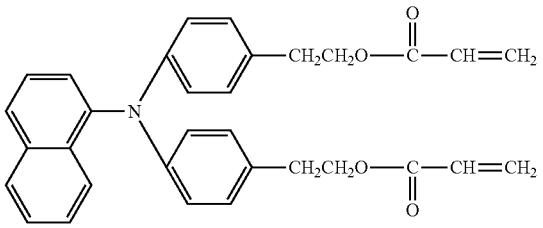

The protective layer coating liquid was applied onto the hole transporting layer with a spray, and the resultant coat was dried and cured in the same manner as in Example 1 to form a protective layer.

Thus, Comparative Example Photosensitive Member 3 was produced.

The ionization potential of the protective layer was measured by the same method as that of Example 1. The ionization potential of the protective layer of Comparative Example Photosensitive Member 3 was 5.5 eV.

Comparative Example 4

An electrophotographic photosensitive member (Comparative Example Photosensitive Member 4) was produced in the same manner as in Example 14 except that in Example 14, a protective layer was formed as described below.

A protective layer coating liquid was prepared by dissolving 4 parts of Comparative Compound No. 4 shown below in 100 parts of tetrahydrofuran.

Comparative Compound No. 4

The protective layer coating liquid was applied onto the hole transporting layer with a spray, and the resultant coat was dried and cured (thermally cured) for 60 minutes at 150° C. to form a protective layer.

Thus, Comparative Example Photosensitive Member 4 was produced.

The ionization potential of the protective layer was measured by the same method as that of Example 1. The ionization potential of the protective layer of Comparative Example Photosensitive Member 4 was 5.5 eV.

Comparative Example 5

An electrophotographic photosensitive member (Comparative Example Photosensitive Member 5) was produced in the same manner as in Example 1 except that in Example 1, a protective layer was formed as described below.

A protective layer coating liquid was prepared by dissolving 4 parts of Comparative Compound No. 5 shown below in 100 parts of tetrahydrofuran.

Comparative Compound No. 5

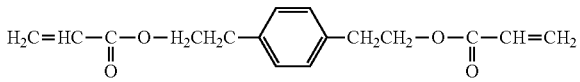

The protective layer coating liquid was applied onto the hole transporting layer with a spray, and was dried and cured in the same manner as in Example 1 to form a protective layer.

Thus, Comparative Example Photosensitive Member 5 was produced.

The ionization potential of the surface of the protective layer was measured by the same method as that of Example 1. However, no ionization potential was detected in the measurable range of up to 7.0 eV. The ionization potential is considered to be higher than the measurable range.

Comparative Compound No. 5 was free of any condensed polycyclic aromatic hydrocarbon group, and hence the injection and transportation of a hole from the hole transporting layer (first hole transporting layer) into the protective layer (second hole transporting layer) hardly occurred, and the electrophotographic characteristics were not good. An image evaluation, a wear amount evaluation, and the like could not be performed because an evaluation by a long-term durability test was difficult.

Comparative Example 6

An electrophotographic photosensitive member (Comparative Example Photosensitive Member 6) was produced in the same manner as in Example 1 except that in Example 1, a protective layer was formed as described below.

A protective layer coating liquid was prepared by dissolving 4 parts of Comparative Compound No. 6 shown below in 100 parts of tetrahydrofuran.

Comparative Compound No. 6

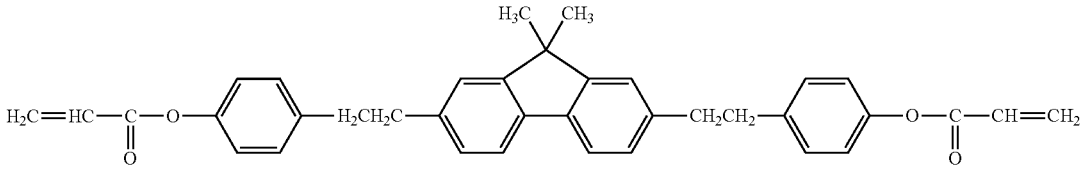

The protective layer coating liquid was applied onto the hole transporting layer with a spray, and the resultant coat was dried and cured in the same manner as in Example 1 to form a protective layer.

The ionization potential of the surface of the protective layer was measured by the same method as that of Example 1. The ionization potential of the protective layer of Comparative Example Photosensitive Member 6 was 6.7 eV.

Comparative Compound No. 6 has a condensed polycyclic aromatic hydrocarbon group, but unlike the compound represented by the structural formula (1), the compound does not have a structure in which an aromatic ring in the condensed polycyclic aromatic hydrocarbon group and a benzene ring are directly bonded to each other. A conjugated structure in a molecule of Comparative Compound No. 6 has only 12 continuous sp2 carbon atoms. Accordingly, the injection and transportation of a hole from the hole transporting layer (first hole transporting layer) into the protective layer (second hole transporting layer) hardly occurred, and the electrophotographic characteristics were not good as in Comparative Example 5. An image evaluation, a wear amount evaluation, and the like could not be performed because an evaluation by a long-term durability test was difficult.

<Evaluation: Sensitivity and Residual Potential>

Each of Example Photosensitive Members 1 to 22 and Comparative Example Photosensitive Members 1 to 6 produced in the foregoing was evaluated for its sensitivity and residual potential under the following conditions.

A photosensitive member testing apparatus (trade name: CYNTHIA 59, manufactured by GEN-TECH, Inc.) was used. First, a condition for a charging apparatus was set so that the surface potential of a charged electrophotographic photosensitive member became −700 V under an environment having a temperature of 23° C. and a humidity of 50% RH. The electrophotographic photosensitive member was irradiated with monochromatic light having a wavelength of 780 nm, and the quantity of the light needed for reducing the potential of −700 V to −200 V was measured and defined as sensitivity [μJ/cm$^2$]. Further, the potential of the surface of the electrophotographic photosensitive member when the electrophotographic photosensitive member was irradiated with light having a quantity of 20 [μJ/cm$^2$] was measured and defined as a residual potential [V].

<Evaluation: Image Deletion>

Image deletion was evaluated with Example Photosensitive Members 1 to 22 and Comparative Example Photosensitive Members 1 to 4 produced in the foregoing under the following conditions.

A reconstructed machine of a copying machine (trade name: iR-C3380F, manufactured by Canon Inc.) was used as an electrophotographic apparatus. With regard to the reconstructed points, the machine was reconstructed so that image exposure laser power, the quantity of a current flowing from a charging roller to the support of an electrophotographic photosensitive member (hereinafter sometimes referred to as "total current"), and a voltage to be applied to the charging roller could be regulated and measured. Further, a cassette heater was removed.

First, the electrophotographic apparatus and the electrophotographic photosensitive members were left to stand in an environment having a temperature of 30° C. and a humidity of 80% RH for 24 hours or more. After that, each of the electrophotographic photosensitive members according to Examples and Comparative Examples was mounted to the cartridge for a cyan color of the electrophotographic apparatus.

Next, a solid image was output on A4 size plain paper with a cyan color alone and an image exposure light quantity was set so that a density on the paper measured with a spectral densitometer (trade name: X-Rite 504, manufactured by X-Rite Inc.) became 1.45.

Next, the applied voltage was applied while being changed from −400 V to −1,600 V by 100 V, and a total current at each applied voltage was measured. Then, a graph whose axis of abscissa and axis of ordinate indicated the applied voltage and the total current, respectively, was created, and the applied voltage at which a current component (hereinafter sometimes referred to as "discharge current") diverging from a first-order approximation curve in the applied voltage range of from −400 V to −800 V became 100 μA was determined. The total current was set to the total current value at the applied voltage at which the discharge current became 100 μA.

Next, an A4 size square lattice image having a line width of 0.1 mm and a line interval of 10 mm was read with a scanner and continuously output on 5,000 sheets with a cyan color alone. After the image output, the main power source of the electrophotographic apparatus was turned off and the apparatus was left to stand for 3 days. After the standing, the main power source of the electrophotographic apparatus was turned on. Immediately after that, the square lattice image was similarly output on 1 sheet, the image deletion of the output image was visually observed, and the image deletion was evaluated by the following criteria.

Evaluation ranks were as described below.

Rank 5: No abnormality is observed in the lattice image.

Rank 4: A horizontal line of the lattice image is broken but no abnormality is observed in a vertical line thereof.

Rank 3: A horizontal line of the lattice image disappears but no abnormality is observed in a vertical line thereof.

Rank 2: A horizontal line of the lattice image disappears and a vertical line thereof is broken.

Rank 1: A horizontal line of the lattice image disappears and a vertical line thereof also disappears.

In this case, a horizontal line in the lattice image means a line parallel to the cylinder axis direction of the cylindrical electrophotographic photosensitive member and a vertical line therein means a line vertical to the cylinder axis direction of the electrophotographic photosensitive member.

<Evaluation: Wear Amount>

The surface (protective layer) of each of Example Photosensitive Members 1 to 22 and Comparative Example Photosensitive Members 1 to 4 produced in the foregoing was evaluated for its wear amount under the following conditions.

A reconstructed machine of a copying machine (trade name: iR ADVANCE C5051F, manufactured by Canon Inc.) was used as an electrophotographic apparatus. With regard to the reconstructed points, the machine was reconstructed so that image exposure laser power could be regulated.

First, the thickness of the protective layer of the electrophotographic photosensitive member before 100,000-sheet output was measured with an interference thickness meter (trade name: MCPD-3700, manufactured by Otsuka Electronics Co., Ltd.).

Next, the electrophotographic apparatus and the electrophotographic photosensitive member were left to stand in an environment having a temperature of 23° C. and a humidity of 50% RH for 24 hours or more. After that, the electrophotographic photosensitive member was mounted onto the cartridge for a cyan color of the electrophotographic apparatus.

Next, a halftone image was output on A4 size plain paper with a cyan color alone and image exposure laser power was set so that the density of the output image measured with a spectral densitometer (trade name: X-Rite 504, manufactured by X-Rite Inc.) became 0.85, followed by continuous output on 100,000 sheets.

Next, the electrophotographic photosensitive member was taken out of the electrophotographic apparatus, the thickness of the protective layer after the 100,000-sheet output was measured, and a difference between the thicknesses of the protective layer before and after the 100,000-sheet output (i.e., the wear amount) was calculated.

<Evaluation: Evaluation of Defective Image Due to Flaw in Surface of Electrophotographic Photosensitive Member>

A situation where a defect in the surface of the electrophotographic photosensitive member after the output on 100,000 sheets appeared as a defect in an output image was evaluated as described below. Each image after the output on 100,000 sheets was visually observed, and an image defect was evaluated by the following criteria.

Rank 5: No abnormality is observed in a halftone image.

Rank 4: A flaw-like image defect slightly occurs in a halftone image.

Rank 3: Less than 10 flaw-like image defects occur in a halftone image.

Rank 2: 10 or more flaw-like image defects occur in a halftone image.

Rank 1: Many flaw-like image defects occur in a halftone image.

The results of the foregoing evaluations are shown in Table 1.

TABLE 1

| | Hole transporting substance of surface layer | Ionization potential of surface layer [eV] | Ionization potential of first hole transporting layer [eV] | Result of evaluation of photosensitive member | | | | |
|---|---|---|---|---|---|---|---|---|
| | | | | Sensitivity [μJ/cm$^2$] | Residual potential [−V] | Image deletion 1 [Rank] | Wear amount [μm] | Image defect [Rank] |
| Example 1 | Exemplified Compound No. 41 | 5.9 | 5.5 | 0.46 | 74 | 5 | 0.3 | 5 |
| Example 2 | Exemplified Compound No. 24 | 6.0 | 5.5 | 0.46 | 84 | 5 | 0.4 | 4 |
| Example 3 | Exemplified Compound No. 26 | 5.8 | 5.5 | 0.46 | 69 | 4 | 0.2 | 4 |
| Example 4 | Mixture of Exemplified Compounds No. 34 and No. 35 | 5.8 | 5.5 | 0.46 | 77 | 5 | 0.3 | 5 |
| Example 5 | Exemplified Compound No. 43 | 5.9 | 5.5 | 0.44 | 86 | 5 | 0.3 | 5 |
| Example 6 | Exemplified Compound No. 44 | 5.8 | 5.5 | 0.47 | 87 | 5 | 0.2 | 5 |
| Example 7 | Exemplified Compound No. 48 | 5.8 | 5.5 | 0.45 | 71 | 4 | 0.2 | 5 |
| Example 8 | Exemplified Compound No. 49 | 5.7 | 5.5 | 0.45 | 70 | 4 | 0.3 | 5 |
| Example 9 | Exemplified Compound No. 51 | 6.0 | 5.5 | 0.48 | 89 | 4 | 0.3 | 5 |
| Example 10 | Exemplified Compound No. 59 | 5.8 | 5.5 | 0.48 | 84 | 4 | 0.4 | 4 |
| Example 11 | Mixture of Exemplified Compound No. 68 and formula (E) | 5.6 | 5.5 | 0.46 | 57 | 3 | 0.3 | 5 |
| Example 12 | Mixture of Exemplified Compound No. 68 and formula (E) | 5.6 | 5.5 | 0.47 | 66 | 4 | 0.4 | 4 |
| Example 13 | Exemplified Compound No. 82 | 6.0 | 5.5 | 0.46 | 78 | 5 | 0.4 | 4 |
| Example 14 | Exemplified Compound No. 89 | 5.9 | 5.5 | 0.47 | 85 | 4 | 0.7 | 5 |
| Example 15 | Exemplified Compound No. 90 | 6.0 | 5.5 | 0.47 | 88 | 3 | 0.6 | 5 |
| Example 16 | Exemplified Compound No. 98 | 5.8 | 5.5 | 0.46 | 64 | 4 | 0.3 | 5 |
| Example 17 | Exemplified Compound No. 101 | 5.7 | 5.5 | 0.46 | 62 | 5 | 0.3 | 5 |
| Example 18 | Exemplified Compound No. 41 | 5.9 | 5.6 | 0.46 | 66 | 5 | 0.3 | 4 |
| Example 19 | Exemplified Compound No. 96 | 5.8 | 5.6 | 0.47 | 66 | 4 | 0.3 | 5 |
| Example 20 | Exemplified Compound No. 41 | 5.9 | 5.7 | 0.47 | 57 | 4 | 0.3 | 4 |
| Example 21 | Exemplified Compound No. 96 | 5.8 | 5.7 | 0.47 | 57 | 5 | 0.3 | 4 |
| Example 22 | Exemplified Compound No. 41 | 5.9 | 5.3 | 0.46 | 86 | 3 | 0.3 | 5 |
| Comparative Example 1 | Comparative Compound No. 1 | 5.6 | 5.5 | 0.40 | 44 | 1 | 0.6 | 2 |
| Comparative Example 2 | Comparative Compound No. 2 | 5.6 | 5.5 | 0.40 | 41 | 1 | 0.8 | 1 |
| Comparative Example 3 | Comparative Compound No. 3 | 5.5 | 5.5 | 0.55 | 89 | 1 | 0.5 | 2 |

TABLE 1-continued

| | Hole transporting substance of surface layer | Ionization potential of surface layer [eV] | Ionization potential of first hole transporting layer [eV] | Result of evaluation of photosensitive member | | | | |
|---|---|---|---|---|---|---|---|---|
| | | | | Sensitivity [μJ/cm$^2$] | Residual potential [−V] | Image deletion 1 [Rank] | Wear amount [μm] | Image defect [Rank] |
| Comparative Example 4 | Comparative Compound No. 4 | 5.5 | 5.5 | 0.40 | 50 | 1 | 0.8 | 3 |
| Comparative Example 5 | Comparative Compound No. 5 | Undetectable | 5.5 | 0.57 | 164 | Unmeasurable | Unmeasurable | Unmeasurable |
| Comparative Example 6 | Comparative Compound No. 6 | 6.7 | 5.5 | 0.56 | 148 | Unmeasurable | Unmeasurable | Unmeasurable |

As can be seen from the results of Table 1, Example Photosensitive Members each had much better performance than that of each of Comparative Example Photosensitive Members in terms of the suppressing effect on image deletion while Example Photosensitive Members each had performance comparable to that of each of Comparative Example Photosensitive Members in terms of the sensitivity and the wear amount. In addition, a suppressing effect on an image defect resulting from the surface of an electrophotographic photosensitive member was observed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-180398, filed Sep. 4, 2014, and Japanese Patent Application No. 2015-117104, filed Jun. 10, 2015, which are hereby incorporated by reference herein in their entirety.

What is claimed is:

1. An electrophotographic photosensitive member, comprising:

a support; and a photosensitive layer formed on the support, wherein a surface layer of the electrophotographic photosensitive member contains a polymerized product of a hole transportable compound represented by the following structural formula (1):

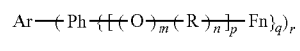

(1)

in the structural formula (1):

Ar represents a substituted or unsubstituted condensed polycyclic aromatic hydrocarbon group, and a substituent of the condensed polycyclic aromatic hydrocarbon group is a group selected from the group consisting of an alkyl group, an alkoxy group, an aralkyl group, a halogen atom, and a halogen-substituted alkyl group;

Ph represents a substituted or unsubstituted group obtained by removing q+1 hydrogen atoms from benzene, and a substituent of the group obtained by removing q+1 hydrogen atoms from benzene is a group selected from the group consisting of an alkyl group, an alkoxy group, an aralkyl group, a halogen atom, and a halogen-substituted alkyl group;

Ar and Ph are bonded to each other through an aromatic ring in Ar and Ph;

R represents a linear or branched alkylene group having 1 to 12 carbon atoms;

Fn represents a reactive functional group said reactive functional group being an acryloyloxy group or a methacryloyloxy group;

m and n each independently represent 0 or 1;

p represents an integer of 0 or more and 4 or less, and when p represents 2 or more, structures in p sets of parentheses may be identical to or different from each other, provided that when p represents 2 or more, a case where oxygen atoms (O) are continuous is excluded;

q represents an integer of 0 or more and 3 or less, and when q represents 2 or more, structures in q sets of parentheses may be identical to or different from each other;

r represents an integer of 1 or more and 6 or less, and when r represents 2 or more, structures in r sets of parentheses may be identical to or different from each other;

the structural formula (1) has at least one Fn;

a structure except Fn in the structural formula (1) has a conjugated structure containing 20 or more sp2 carbon atoms; and the 20 or more sp2 carbon atoms in the conjugated structure are continuously bonded to each other.

2. An electrophotographic photosensitive member according to claim 1, wherein a structure except Fn in the structural formula (1) has a conjugated structure containing 24 or more sp2 carbon atoms.

3. An electrophotographic photosensitive member according to claim 1, wherein the condensed polycyclic aromatic hydrocarbon group is a group obtained by removing r hydrogen atoms from one of fluorene, anthracene, phenanthrene, fluoranthene, and pyrene.

4. An electrophotographic photosensitive member according to claim 1, wherein the surface layer has an ionization potential of 5.5 eV or more and 6.4 eV or less.

5. An electrophotographic photosensitive member according to claim 4, wherein the surface layer has an ionization potential of 5.8 eV or more and 6.2 eV or less.

6. An electrophotographic photosensitive member according to claim 1, wherein:

the electrophotographic photosensitive member comprises a first hole transporting layer and a second hole transporting layer;

the second hole transporting layer is the surface layer; and the first hole transporting layer has an ionization potential of 5.0 eV or more and 6.0 eV or less.

7. An electrophotographic photosensitive member according to claim 6, wherein the first hole transporting layer has an ionization potential of 5.2 eV or more and 5.8 eV or less.

8. An electrophotographic photosensitive member according to claim 1, wherein the compound represented by the structural formula (1) has a molecular weight of 300 or more and 1,000 or less.

9. A process cartridge, comprising:

a electrophotographic photosensitive member; and at least one unit selected from the group consisting of a charging unit, a developing unit, a transferring unit, and a cleaning unit, the electrophotographic photosensitive member and the at least one unit being integrally supported, wherein the process cartridge is detachably mountable to a main body of an electrophotographic apparatus, the electrophotographic photosensitive member comprising:

a support; and a photosensitive layer formed on the support, wherein a surface layer of the electrophotographic photosensitive member contains a polymerized product of a hole transportable compound represented by the following structural formula (1):

(1)

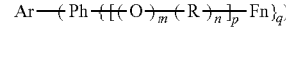

in the structural formula (1):

Ar represents a substituted or unsubstituted condensed polycyclic aromatic hydrocarbon group, and a substituent of the condensed polycyclic aromatic hydrocarbon group is a group selected from the group consisting of an alkyl group, an alkoxy group, an aralkyl group, a halogen atom, and a halogen-substituted alkyl group;

Ph represents a substituted or unsubstituted group obtained by removing q+1 hydrogen atoms from benzene, and a substituent of the group obtained by removing q+1 hydrogen atoms from benzene is a group selected from the group consisting of an alkyl group, an alkoxy group, an aralkyl group, a halogen atom, and a halogen-substituted alkyl group;

Ar and Ph are bonded to each other through an aromatic ring in Ar and Ph;

R represents a linear or branched alkylene group having 1 to 12 carbon atoms;

Fn represents a reactive functional group, said reactive functional group being an acryloyloxy group or a methacryloyloxy group;

m and n each independently represent 0 or 1;

p represents an integer of 0 or more and 4 or less, and when p represents 2 or more, structures in p sets of parentheses may be identical to or different from each other, provided that when p represents 2 or more, a case where oxygen atoms (O) are continuous is excluded;

q represents an integer of 0 or more and 3 or less, and when q represents 2 or more, structures in q sets of parentheses may be identical to or different from each other;

r represents an integer of 1 or more and 6 or less, and when r represents 2 or more, structures in r sets of parentheses may be identical to or different from each other;

the structural formula (1) has at least one Fn;

a structure except Fn in the structural formula (1) has a conjugated structure containing 20 or more sp2 carbon atoms; and the 20 or more sp2 carbon atoms in the conjugated structure are continuously bonded to each other.

10. An electrophotographic apparatus, comprising:

a electrophotographic photosensitive member;

a charging unit;

an exposing unit;

a developing unit; and a transferring unit, the electrophotographic photosensitive member comprising:

a support; and a photosensitive layer formed on the support, wherein a surface layer of the electrophotographic photosensitive member contains a polymerized product of a hole transportable compound represented by the following structural formula (1):

(1)

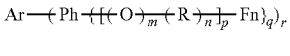

in the structural formula (1):

Ar represents a substituted or unsubstituted condensed polycyclic aromatic hydrocarbon group, and a substituent of the condensed polycyclic aromatic hydrocarbon group is a group selected from the group consisting of an alkyl group, an alkoxy group, an aralkyl group, a halogen atom, and a halogen-substituted alkyl group;

Ph represents a substituted or unsubstituted group obtained by removing q+1 hydrogen atoms from benzene, and a substituent of the group obtained by removing q+1 hydrogen atoms from benzene is a group selected from the group consisting of an alkyl group, an alkoxy group, an aralkyl group, a halogen atom, and a halogen-substituted alkyl group;

Ar and Ph are bonded to each other through an aromatic ring in Ar and Ph;

R represents a linear or branched alkylene group having 1 to 12 carbon atoms;

Fn represents a reactive functional group, said reactive functional group being an acryloyloxy group or a methacryloyloxy group;

m and n each independently represent 0 or 1;

p represents an integer of 0 or more and 4 or less, and when p represents 2 or more, structures in p sets of parentheses may be identical to or different from each other, provided that when p represents 2 or more, a case where oxygen atoms (O) are continuous is excluded;

q represents an integer of 0 or more and 3 or less, and when q represents 2 or more, structures in q sets of parentheses may be identical to or different from each other;

r represents an integer of 1 or more and 6 or less, and when r represents 2 or more, structures in r sets of parentheses may be identical to or different from each other;

the structural formula (1) has at least one Fn;

a structure except Fn in the structural formula (1) has a conjugated structure containing 20 or more sp2 carbon atoms; and the 20 or more sp2 carbon atoms in the conjugated structure are continuously bonded to each other.

11. An electrophotographic photosensitive member, comprising:

a support; and a photosensitive layer formed on the support, wherein a surface layer of the electrophotographic photosensitive member contains a polymerized product of a hole transportable compound represented by the following structural formula (1):

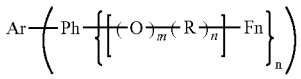

(1)

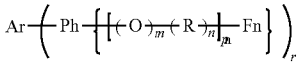

in the structural formula (1):

Ar represents a substituted or unsubstituted condensed polycyclic aromatic hydrocarbon group, and a substituent of the condensed polycyclic aromatic hydrocarbon group is a group selected from the group consisting of an alkyl group, an alkoxy group, an aralkyl group, a halogen atom, and a halogen-substituted alkyl group;

Ph represents a substituted or unsubstituted group obtained by removing q+1 hydrogen atoms from benzene, and a substituent of the group obtained by removing q+1 hydrogen atoms from benzene is a group selected from the group consisting of an alkyl group, an alkoxy group, an aralkyl group, a halogen atom, and a halogen-substituted alkyl group;

Ar and Ph are bonded to each other through an aromatic ring in Ar and Ph;

R represents a linear or branched alkylene group having 1 to 12 carbon atoms;

Fn represents a reactive functional group, said reactive functional group being an acryloyloxy group or a methacryloyloxy group;

m and n each independently represent 0 or 1;

p represents an integer of 0 or more and 4 or less, and when p represents 2 or more, structures in p sets of parentheses may be identical to or different from each other, provided that when p represents 2 or more, a case where oxygen atoms (O) are continuous is excluded;

q represents an integer of 0 or more and 3 or less, and when q represents 2 or more, structures in q sets of parentheses may be identical to or different from each other;

r represents an integer of 1 or more and 6 or less, and when r represents 2 or more, structures in r sets of parentheses may be identical to or different from each other;

the structural formula (1) has at least one Fn; and the hole transportable compound has only one conjugated structure in which the number of sp2 carbon atoms constituting the conjugated structure, is 20 or more.

* * * * *